United States Patent [19]

Eickmann

[11] Patent Number: 4,782,737

[45] Date of Patent: Nov. 8, 1988

[54] CONTROL PINTLE INCLUDING A THRUST MEMBER FOR A RADIAL FLOW DEVICE

[76] Inventor: Karl Eickmann, 2420 Isshiki, Hayama-machi, Kanagawa-ken, Japan

[21] Appl. No.: 945,635

[22] Filed: Dec. 23, 1986

Related U.S. Application Data

[60] Continuation-in-part of Ser. No. 575,620, Jan. 31, 1984, abandoned, which is a division of Ser. No. 264,772, May 18, 1981, abandoned, which is a continuation-in-part of Ser. No. 911,246, May 31, 1978, abandoned, and Ser. No. 910,809, May 30, 1978, abandoned.

[51] Int. Cl.[4] ..... F01B 13/06

[52] U.S. Cl. ..... 91/484; 91/486; 91/492; 91/498

[58] Field of Search ..... 91/484, 487, 491, 492, 91/498, 486; 92/58

[56] References Cited

U.S. PATENT DOCUMENTS

| | | | |
|---|---|---|---|
| 1,998,984 | 4/1935 | Ferris | 91/498 X |
| 2,431,175 | 11/1947 | Hoffer | 91/498 X |
| 3,046,906 | 7/1962 | Budzich | 91/487 |
| 3,768,377 | 10/1973 | Engel et al. | 91/486 |
| 3,800,672 | 4/1974 | Kobald | 91/487 |
| 3,810,418 | 5/1974 | Bosch | 91/484 |
| 4,286,927 | 9/1981 | Boehringer | 91/503 X |

FOREIGN PATENT DOCUMENTS

| | | | |
|---|---|---|---|
| 1453629 | 7/1969 | Fed. Rep. of Germany | 91/484 |
| 2303108 | 7/1974 | Fed. Rep. of Germany | 91/498 |
| 580223 | 8/1924 | France | 91/498 |
| 223553 | 6/1925 | United Kingdom | 91/498 |
| 958028 | 5/1964 | United Kingdom | 91/498 |

*Primary Examiner*—Paul F. Neils

[57] ABSTRACT

A fluid machine such as a pump, compressor, engine, motor or transmission has working chambers in a rotor and a central rotor-hub is provided in the rotor for the reception of a control pintle therein. The control pintle has control ports for the control of flow of fluid into and out of the working chambers of the rotor. Pressure fields form in the clearance between the rotor hub and the control pintle especially around the control ports. Leakage flows from the pressure fields through portions of the clearance between the rotor—hub and the control pintle which reduces the efficiency of the machine. Therefore means are provided in the control pintle to press those portions of the faces of the rotor hub and of the control pintle, which have those local pressure fields, together or to narrow the clearance between these faces in the respective areas where those pressure fields are located in order to reduce the leakage through the clearance between the faces of the rotor hub and the control pintle. In detail, the invention provides, in the central pintle, radially directed thrust chambers with thrust bodies therein at the proper locations and sizes to obtain an economic device with only small leakage.

19 Claims, 10 Drawing Sheets

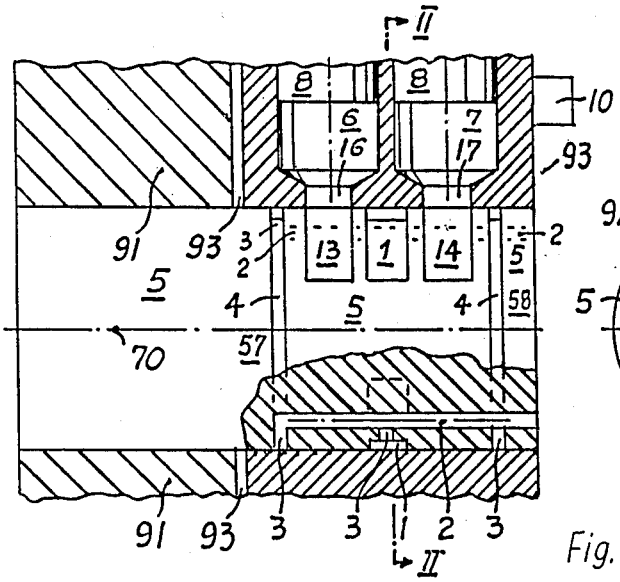
Fig.1
Fig.2
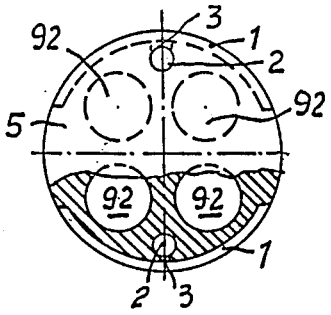
Fig.3
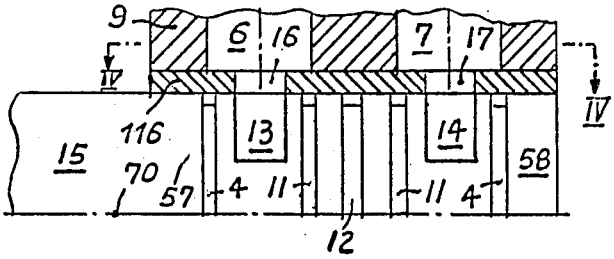
Fig.4
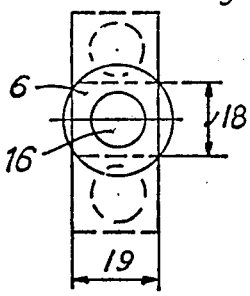
Fig.5
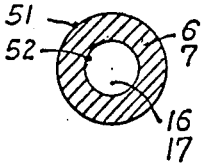
Fig.6
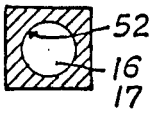

Fig. 27
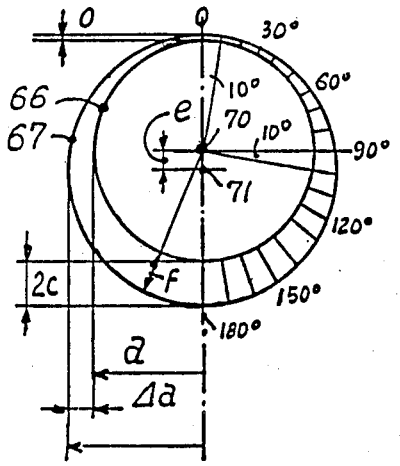
Fig. 21
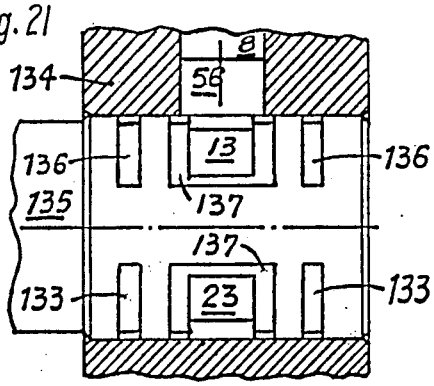
Fig. 22
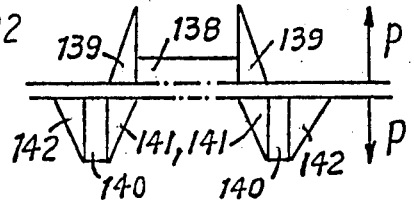
Fig. 28
| α° | 0 | 10 | 20 | 30 | 40 | 50 | 60 | 70 | 80 | 90 | Σ | 90 | 100 | 110 | 120 | 130 | 140 | 150 | 160 | 170 | 180 | Σ |
|---|---|---|---|---|---|---|---|---|---|---|---|---|---|---|---|---|---|---|---|---|---|---|
| F | 0 | .05 | .08 | .16 | .27 | .42 | .57 | .74 | .92 | 1.09 | | 1.09 | 1.27 | 1.43 | 1.57 | 1.70 | 1.81 | 1.90 | 1.95 | 1.99 | 2.0 | |
| $F^3$ | 0 | 0 | 0 | .01 | .02 | .07 | .19 | .41 | .77 | 1.31 | 2.77 | 1.31 | 2.05 | 2.89 | 3.88 | 4.86 | 5.88 | 6.86 | 7.43 | 7.86 | 8 | 51.05 |
| $\overline{F^3}$ | 2.77 / 10 INTERVALS = 0.28 | | | | | | | | | | | 51.05 / 10 INTERVALS = 5.10 | | | | | | | | | | |
Fig. 25
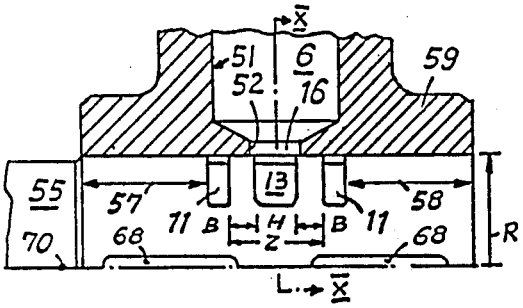
Fig. 26
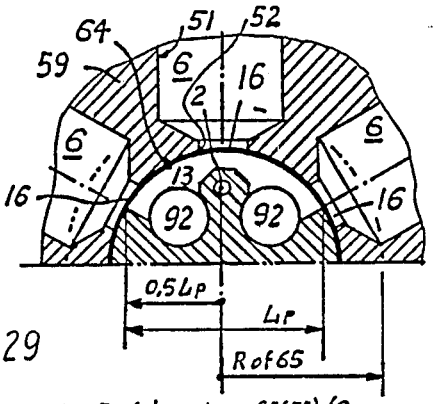
Fig. 29
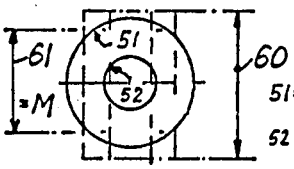
51 = Projection of cylinder 6.
52 = Projection of ROTOR PASSAGE 16.
R = (Diameter of "67")/2.
Lp = Projection of arcus "Lp".
$L = 2R\pi\left[90° - \mathrm{INV.COS.}\left(\frac{0.5L}{R}\right)\right]2/360°$

L/B = ≈ 6

CONTROL PINTLE INCLUDING A THRUST MEMBER FOR A RADIAL FLOW DEVICE

REFERENCE TO RELATED APPLICATIONS

This is a continuation in part application of my application Ser. No. 06-575,620, filed on Jan. 31, 1984, now abandoned, which was filed as a divisional patent application of my now abandoned patent applicaton Ser. No. 06-264,772, which was filed on May 18, 1981 as a continuation in part application of Ser. No. 911,246, which is now abandoned and also of my now abandoned application Ser. No. 910,809. The mentioned application Ser. No. 910,809 was filed on May 30, 1978 and application Ser. No. 911,246 was filed on May 31st, 1978. Benefits of the above mentioned applications are claimed herewith for the respective Figures and disclosures of the present application. The oldest priority claimed thereby is that of application Ser. No. 910,809 of May 30, 1978.

BACKGROUND OF THE INVENTION (a) Field of the Invention

This invention relates to fluid machines which have a rotor or a body with working chambers therein. The body or rotor has a concentric bore, called "rotor hub" and a control body closely fitting therein. The control body has a cylindrical outer face and control parts are provided in the control body and its outer face to control the flow of fluid into and out of the working chambers.

Such machines are, for example, known from my U.S. Pat. Nos. 3,062,151; 3,136,260; 3,223,046; 3,273,342; 3,270,685; 3,277,834; 3,304,883; 3,416,460; 3,747,639; 3,757,648 or 3,468,262 or others.

(b) Description of the Prior Art

It is known from my elder patents, for example, from my U.S. Pat. Nos. 3,062,151; 3,136,260; 3,223,046; 3,273,342; 3,270,685; 3,277,834; 3,304,883; 3,416,460, 3,747,639; 3,757,648 or 3,468,262 or others, to provide a rotor hub in the center of the rotor of a fluid machine which may have either a single or a plurality of working chamber groups in the rotor of the machine.

A control body or pintle is is inserted into the rotor hub and has control ports for the control of flow of fluid into and out of the working chambers of the rotor.

In order to counter balance the fields of pressure which surround the control parts and which include the control ports I have already in my mentioned elder patents provided diameterically located fluid pressure pockets in the control body to build up and maintain therein and therearound counter acting fields of pressure which act in the contrary direction onto the control body and thereby make the control body flat with little or almost no friction in the rotor bore or rotor-hub.

These machines have proven partially to be of high efficiency and greatest reliability and of very little friction at low and medial fluid pressure ranges. They work also satisfactorily temporarily at higher pressures.

However, at the very high pressures in fluid which are presently sometimes desired, a little more friction would be acceptable if the leakage could thereby be reduced.

Recently, a number of patents have been granted to inventors, which have assigned their inventions to the Bosch corporation of Western Germany. Those patents are, for example:

U.S. Pat. Nos. 3,810,418 of Paul Bosch; 3,875,852 of Paul Bosch; 3,866,517 of Ulrich Aldinger, 3,893,376 of Gerhard Nonnenmacher and 3,985,065, also of Gerhard Nonnenmacher.

The latter mentioned patents find equivalent patent application publications (Deutsche Offenlegungsschriften) in Germany. These latter mentioned patents attempt to supply other or better solutions to my first mentioned elder own U.S. patents. However, the latter mentioned patents and applications deal with the same matter as my previously mentioned elder U.S. patents, namely with the centric floating of the control body in the rotor-hub. In all those cases, either the control body floats in the rotor, floats around the control body depending thereon, whether the rotor or the control body is flexibly mounted. At least all these mentioned patents and patent applications claim that the control body would float in a concentrical manner relative to the inner surface of the rotor-hub. As will be shown in the summary of the invention, it is, however, not at all times assured, that the control body always floats concentrically relative to the rotor-hub.

In axial piston pumps or motors it was already customary to press two relative to each other sliding planes or spherical faces together for a good seal. In some of the solutions so applied, it was also already proposed and exercised, to insert thrust bodies into a thrust-chamber. Those solutions are for example shown in U.S. Pat. Nos. 3,800,672 of Walter Kobald; 3,768,377 of William P. Engel, assignor to the Caterpillar Tractor Co., 4,148,249 to Stephan J. Jacobs, wherein a rotor of a radial piston device is axially pressed against a control face and in similar or other patent documents in foreign countries.

It has however never been tried successfully to use thrust bodies of radial direction between a control body and a rotor hub of a radial piston or radical chamber pump or motor.

That is also understandable, because in case of axial thrust arrangements there are plane faces or spherical faces pressed parallel to each other. If now the thrust means of axial piston pumps or motors would be applied to a cylindrical control body in a rotor hub for example of a radial piston machine, the bodies from axial flow devices would not be applicable and in addition the control body would weld on the inner face of the rotor hub, because the faces of the control body and of the rotor-hub would meet in a line, where they would weld.

SUMMARY OF THE INVENTION

It is therefore the aim of this invention to provide arrangements to reduce the leakage and/or friction on control bodies and rotors in fluid machines with single or plural working chamber groups. The invention is especially suitable for rotors which have a control rotor-hub of substantially cylindrical configuration and therein a relatively closely fitting control body of corresponding cylindrical configuration.

During the control of flow of fluid by the control body into and out of the rotor certain losses occur at this operation. The losses consist to a great extent of friction between the rotor hub face or rotor face and the outer face of the control body and in addition of loss of fluid by leakage through the clearance between the rotor face and the control face of the control body or through a portion or portions of said clearance.

By my aforementioned patents the friction has been reduced to a very small minimum because the control bodies were assumed by the means of my patents to float almost exactly concentrically within the rotor bore or rotor hub. The rotor face and the control face did therefore never touch each other and there remained no reason for slide friction. The remaining friction was mainly friction in fluid due to shear in the fluid film in the control clearance. Also the leakage was reduced by my earlier patents because, when a body floats eccentrically in a bore the leakage seems 2.5 times compared to the leakage at a concentrically floating body in a bore. Since the means of my mentioned earlier patents assumed the control body to float about concentrically in the rotor hub they thereby reduced the leakage almost 2.5 times compared to the devices and machines of the prior art prior to my mentioned patents.

In relation to the present invention it is desired that the total loss of the sum of friction and of leakage of the control clearance becomes a minimum.

At low pressure the leakage loses were smaller than the friction losses, especially, when the machine ran with high rotary speed. At medial pressures the losses of friction and of leakage at the places of the machine here under discussion were about equal. At higher pressures the leakage became a greater power loss than the friction, because the greater leakage sometimes even reduced the friction in my devices because the higher leakage force the control body to float more centrically than the smaller leakage could force the control body to do. Centrically means: "concentrically".

Presently however it is sometimes desired that the pump or motor act with pressures above 4000 psi permanently. It is even sometimes desired to use hydrostatic bearings instead of roller bearings in order to obtain a high life time at high pressures. Further, some applications demand a reduction of leakage regardless of the sum of the power losses.

For these high pressure applications which appear sometimes presently it is desired to reduce the leakage between rotor face and control body even at all costs. It is then accepted to have a little higher friction loss between rotor and control body when the leakage can thereby be drastically or at least considerably reduced.

It is therefore an object of this invention to reduce the leakage between rotor face and control face of the control body in a fluid machine, for example, in a pump, a compressor, an engine, a motor or in a transmission.

In order to materialize the object and aim of the invention, several novel arrangements may be associated to the control clearance between the rotor face and the control face of the rotor and control body of the machine, which may be applied either single or, if suitable, in combination.

(a) The provision of at least one thrust chamber with a thrust body therein, related to the inner face of a rotor-hub and a control body, whereby the mentioned thrust body is provided with a face of part-cylindrical configuration of complementary size relative to a portion of the rotor-hub or the outer face of the control body, while the thrust chamber is communicated to a respective space which contains fluid under pressure;

(b) the provision of a thrust chamber in a control body; the loading of this thrust chamber by pressure of fluid in a diameterically opposite located control port or working by communication to the respective diametrically located control port or working chamber and the insertion of a thrust body into the thrust chamber, whereby the pressure in the thrust chamber presses the thrust body against the rotor or against the control body in order to narrow the clearance between rotor and control body on the diametrical opposite portion of the control body;

(c) the provision of slots as thrust chambers in a control body with respectively formed thrust members therein;

(d) the provision of thrust chamber slots in a bush in a rotor in a fluid machine and the provision of radially inwardly directed thrust members therein;

(e) the provision of seal means on thrust members in thrust chambers in a control body, rotor bush or in a rotor;

(f) the provision of passages between thrust chamber pairs;

(g) the provision of thrust inserts in a bush or in a bottom portion of a chamber or cylinder in a rotor;

(h) the provision of communication passages from respective control ports through a control body into a respective thrust chamber on the diameterical opposite portion of the control body;

(i) the provision of communication passages through a rotary member half-way around (k) the control body to a diameterically opposite place of the control body;

(l) the provision of communication passages between a rotor and a bush in the rotor half-way around the bush to a diametrically opposite location of the bush in combination with a radial recess or bore through the bush at the mentioned diametrically opposite location and in combination with an extension of these communication passages into a working chamber in the rotor or to a control port in the control body;

(m) the provision of recesses in the control body for temporary periodic communication with such radial recesses or bores of the mentioned bush for the formation of periodic build up of fluid pressure fields in and around one or more such recesses in the control body;

(n) the provision of unloading recesses around thrust chambers and thrust members or thurst inserts in a control body;

(o) the provision of diametrically opposite located pairs of thrust chambers and thrust members therein, which are associated to a control port of a control body and whereof each one of the pair is located laterally on another side of the associated control port;

(p) the provision of cylindrical thrust chambers or thrust chamber pairs and the provision of cylindrical thrust members therein in a control body or in a rotor;

(q) the provision of recesses or of unloading recesses within the control body or rotor-hub in specific relation, location and function relative to a thrust chamber, thurst body and the control body and rotor-hub, (r) the provision of outcuts and thrust bodies of non-cylindrical cross-sectional configuration especially in the control body; and;

(s) the provision of thrust-chambers, thrust bodies in thrust chambers and of unloading recesses in specific relationships relative to each other and in specific relation to the creation of hydrodynamic pressure fields at relative movement between the inner face of the rotor-hub and the outer face of the control body in the rotor-hub with the aim and result of stabilization of the location of the mentioned inner and outer face(s) relative to each other and thereby to obtain and maintain a stability of said location with a minimum of friction and of leakage between the faces of the rotor-hub and of the control body.

SPECIFIC DETAILS OF THE SUMMARY OF THE INVENTION

In the foregoing portion of the "summary of the invention", the aims and objects have been described in generally understandable language.

What underlies the present invention, is however, not the aim to make provisions or realize objects within the scope of common technology. But instead the invention arrives from very detailed considerations, studies and experiments of highly sophisticated and not generally known technology.

These considerations, studies and experiments have brought to light the discovery, that the common technology, which is described in the "discussion of the former art" has basically erred in several respects.

One of the basic errors of the discussed former art is, that a control body would float centrically relative to the inner face of the rotor-hub, when it is perfectly fluid pressure balanced by respective fluid pressure pockets and recesses for limiting the respective areas.

A further error of the "former art" is, that a leakage between a control body and a rotor-hub face would be 2.5 times, when the clearance is fully eccentric, compared to the centric floating.

This first basic error is now discovered by this present invention. The fact, in accordance with this invention is, that the perfect radial pressure balance of a control body in a rotor hub is a matter of lability, but not of permanent stability. Because, the radial pressure balance is just balancing the radial forces, but it does not include an stabilizing means to make sure, that the control body actually floats centrically relative to the inner face of the rotor-hub.

Therefrom follows, that the mentioned former art has attempted to make the control body float centrically relative to the inner face of the rotor and that the former art has assumed and declared, that the centric floating of the control body was actually materialized by the mentioned former art. The truth however is, according to this present invention, that the former art has not fully obtained what is declared as having been obtained. For example, a perfectly radially balanced control body may temporarily float centrically in the rotor hub, but at other times it might float eccentric in the rotor-hub. The thousands of test-records and measurements which I have done, show, that a certain percentage of test data indicate a centric floating with relatively small leakage, while other test-data of the same devices show up to almost ten times higher leakages at same devices, same conditions and sizes as well as configurations. These test results show, that the devices of the former art are "unstable". Sometimes the leakage is small, but other times, without changing the exterior conditions, the leakage becomes actually very great.

Understandably, the reasons for these facts, have not been discovered for now almost two decades. The test data were contrary to all known theories. They could not be understood. As a result thereof they were assumed to be errors of measurement or just temporary "out runners".

The fact is, in accordance with this invention, that the test data are not measurement mistakes, nor are they temporary outrunners. The fact is, that the perfect radial pressure balance has not assured the centric floating of the control body relative to the innner face of the rotor hub. But it was actually unstable. Sometimes the control body actually floated centrically and sometimes it floated eccentrically. With the result, that at times of centric floating the leakage was small, and at times of eccentric floating the leakage became very great.

However, even with the assumption of this invention, that the temporarily large leakage would come from temporary eccentric location of the outer face of the control body relative to the inner face of the rotor-hub, the test results remained partially unexplainable. Because, according to the theory of Walter Ernst, "oil hydraulic power and its industrial applications", Mc. Grae Hill Book Co. of New York, edition 1960, which is also published in German and in Russian and has thereby educated almost the entire world of today, the leakage between two relative to each other eccentric faces is 2.5 times of the leakage of concentric faces. See pages 46 and 47 of the mentioned book of Walter Ernst.

The thereafer followed studies of this present invention, led to the discovery of the second basic error of the former art. This second error of the former art is, that the theory of Walter Ernst was applied to the eccentric annular clearances between the control body and the rotor hub. There was no mentioning of the limitations of the Ernst-Calculations in the book of Ernst. This fact has led the artisans to the application of the Ernst considerations to control clearances between rotor-hub and control body.

The now deeper and more sophisticated studies of this invention have now discovered, that the Ernst calculation is basically correct, but it can not be applied to the centric or eccentric annular clearances between the outer face of a cylindrical control body and the inner face of the rotor-hub, wherein the control body is located. The discovery of this invention brings to light and explains later at hand of the respective explanatory Figures, that the actual leakage is not 2.5 times that of a concentrically located control body at full eccentricity between the cylindrical faces of rotor hub and control body, but can become about $4.0 \times 5.10 = 20.4$ times of the leakage of a concentric floating control body, when a pressure fluid port of a cylindrical control body is radially balanced by two diametrically located fluid pressure balancing pockets, as done in the mentioned former art. This 20.4 times leakage relative to the leakage of a concentrically floating control body applies to the mentioned balancing pocket area of the device.

With these discoveries, the invention now provides the means and objects of the invention in such a way, that th main leakage flows are reduced to two leakage flows, namely those out of the pressure control port. At the same time the location of the control body relative to the inner face of the rotor-hub becomes stabilized to a specific and predetermined eccentricity between the cylidrical faces of the control arrangement, whereby the leakage becomes reduced from the maximum of 510 percent down to between 100 percent and 28 percent of the leakage, which would appear, when the control body would float concentrically relative to the inner face of the rotor-hub.

The invention thereby provides, where dozens of patents of the former art stived for, but due to their errors never obtained. Namely a control body arrangement in a cylindrical rotor-hub of guaranteed small leakage at all times of operation without instability of the size of leakage flows.

The invention thereby provides a device with greatly improved stability of performance, efficiency and power, which will be more in details shown at the description of the preferred embodiment(s).

To obtain the full benefit of the invention in practical application in technologies and industries, it is however not enough to think in earlier values, such as setting recesses, thrust chambers or thrust members of former art, but to obey the more sophisticated principles which underly the present invention and led to its discovery. The main invention consists in the discovery of the technologies involved, while the solutions of the invention follow of the discoveries of the heretofore neglected or unrecognized details of technologies, which influence the problems and solutions involved.

BRIEF DESCRIPTION OF THE DRAWINGS

FIG. 1 is a longitudinal sectional view through the medial portion of a fluid machine which employs one embodiment of the invention.

FIG. 2 is a cross-sectional view through FIG. 1 along II—II.

FIG. 3 is a longitudinal sectional view through a portion of fluid machine which contains another embodiment of the invention.

FIG. 4 is a longitudinal sectional view through FIG. 3 along IV—IV.

FIG. 5 is an explanatory schematic in relation to FIGS. 3 and 4.

FIG. 6 is another schematic in relation to the said figures.

FIG. 21 is still another longitudinal sectional view through a portion of still a further fluid machine which applies still another embodiment of the invention.

FIG. 22 is a schematic for explanations in relation to FIG. 21.

FIG. 23-A is an enlargement of a portion of FIG. 23.

FIG. 24-A is an enlargement of a portion of FIG. 24.

FIG. 25 is a longitudinal partial sectional view through another embodiment of a portion of a rotor with a portion of a control body therein which explains further details of the technology involved in the invention.

FIG. 26 is a cross-sectional view through FIG. 25 along XXVI—XXVI.

FIG. 27 is an explanatory schematic to explain an underlying technology of the invention.

FIG. 28 is a table, giving calculations and data resulting from considerations to FIG. 27 an which have a considerable influence on the technology of the invention.

FIG. 29 shows a projection of a portion of FIG. 25 and is provided to explain details of calculations.

DESCRIPTION OF THE PREFERRED EMBODIMENTS

At this description of the preferred embodiments a number of Figures are discussed, which are provided to give a better understanding of the technology involved or related to the invention.

By discovering the technologies involved in this present invention, it was, however, also found, that there are a plurality of possible solutions to solve the aims of the invention.

Not all of the solutions however are utilizing the same or equal elements of industrial machinery building.

Consequently, not all of the Figures of the several possible solutions are included in the claims of the same patent application. Those figures of this application, which are utilizing other elements, than those which are claimed in this present patent application, are therefore also provided in co-pending patent applications, wherein the respective claims are set forth.

The descriptions starts with the solutions which appear in FIGS. 1 to 6, whereof FIGS. 1 to 6 show related solutions. FIGS. 7 to 13, 18, 19, 20 and 31 to 37 bring the solutions, which will be claimed in this application or probable later divisionals thereof.

Figure 23:
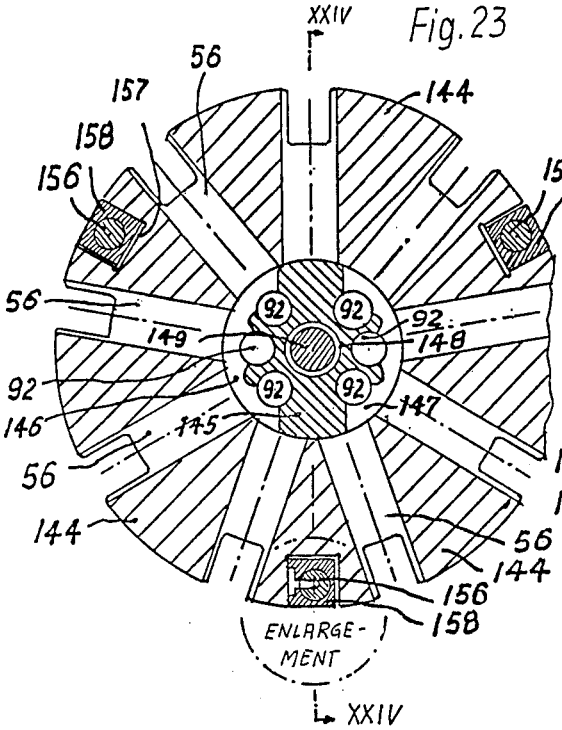
FIG. 23 is a cross-sectional view through still another portion of still another fluid machine wherein another embodiment of the invention is applied and FIG. 23 is thereby also a cross-sectional view through FIG. 24 along the line XXIII—XXIII.
Figure 24:
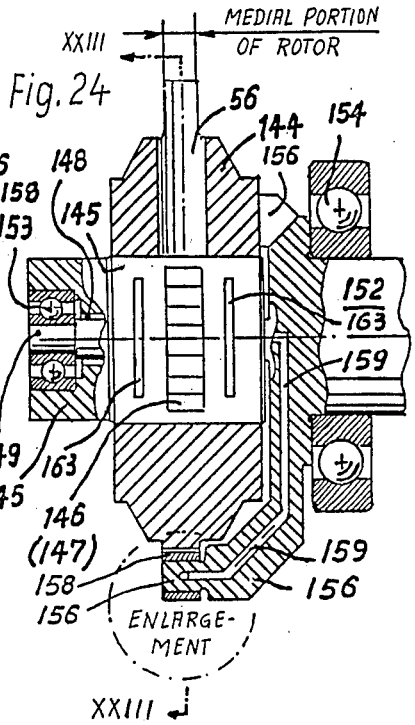
FIG. 24 is a longitudinal sectional view through the portion of FIG. 23 and thereby a cross-sectional view through FIG. 23 along the line XXIV—XXIV.

FIGS. 23 and 24 define, that there must be an ability to move radially relative between each other for the rotor and the control body of the invention. FIGS. 23 and 24 show one of several applicable arrangements therefore.

FIGS. 25 to 29 and 30 are very important for the explanation of the technologies involved in the invention, which the invention has discovered. The solutions for the aims of the invention given in the other Figures, can not satisfactorily work, when the technologies which are explained in FIGS. 25 to 30 are not fully obeyed.

FIGS. 1 and 2 are somewhat related to my earlier patents, for example to my U.S. Pat. No. 3,304,883. In said patent two cylinder groups, each consisting of a plurality of cylinders are arranged closely together in a fluid machine.

The term "fluid machine" defines a machine which has chambers, which periodically take in and expel a fluid, such as hydraulic or pneumatic engines, compressors, pumps, motors or transmissions. From my U.S. Pat. No. 3,304,883 it is also already known, that the cylinders are arranged substantially radially and that pistons move radially therein to take the fluid in and to let it move out of the cylinders through a substantially cylindrical control-body which is closely fits in the hub of the rotor of the machine. The flow of fluid to and from the cylinders occurs through passages in the control body. The mentioned U.S. Pat. No. 3,304,883 also shows that the cylinders form ports, which are of narrower diameters than the cylinders.

Such arrangement is partially shown in FIGS. 1 and 2, wherein only the medial portion of the fluid machine is shown, because the invention concerns only the improvement of this medial portion, while the housing, the actuator means for actuating the piston strokes, the pistons and the ports are of conventional design and do not receive improvements by this invention. Consequently in all other Figures, except FIGS. 25 and 26, also only the medial portions are shown, whereon or whereto improvements are done by this invention.

FIG. 1 demonstrates, that the cylinders 6 and 7 of the adjacent cylinder groups 6 and 7 have ports 16 and 17 respectively and that said ports have a smaller diameter than the respective cylinders. Pistons 8 are reciprocable in the cylinders 6 and 7, as known in the art. Due to the fact, that the cylinders 6, 7 have wider diameters than the related ports 16,17 they have also larger cross-sectional areas than the respective ports 16 and 17.

The consequence thereof is, that, when fluid-pressure builds up in the cylinders 6 and 7 it forces the rotor 9 down towards the control body 5 by a force p=pressure multiplied by the cross-sectional area through the cylinders minus the cross-sectional area through the ports. Thus, the difference of the cross-sectional areas through cylinders 6,7 and through the ports 16,17 defines at a given pressure in the cylinders the force with which the rotor 9 is forced against the wall of control body 5. Control body 5 is a stationary fixed control body, borne in housing or cover 91. Thereby it is defined, that the control body 5 is not a floating control body, but a stationary fixed control body.

It defines also, that the rotor is borne on the control body and not the control body borne in the rotor as it would be, when the control body would be a floating control body. The control body 5 has control ports 13,14 for the control of flow of fluid into and out of ports 16 and 17 of the cylinders 6 and 7. Out from these control ports 13 and 14 a force acts also onto the rotor 9 in a direction contrary to that which acts out of the cylinders against the cylinder bottoms between cylinders 6,7 and cylinder ports 16,17. However, in case of the embodiments of the invention the force acting out of control ports is smaller than the force acting out of the cylinders, so, that the rotor 9 is in the cases of the invention forced against the wall of control body 5 and borne thereby. More particularly, the rotor 9 is borne on the high-pressure half of the outer face of the control body of the respective Figure of the specification.

It could also be otherwise. Namely so, that the force out of the control ports 13,14 would be bigger than the foce out of the respective cylinders. That is however not the case in the embodiment of FIGS. 1 to 6.

In the case of the embodiments of FIGS. 1 to 6 the rotor 9 is forced onto the control body 5 and that is desired in these embodiments.

The heretofore described actions of forces of fluid are, however, not the only actions of forces in fluid, but they act in combination with forces in fluid in the narrow clearance between the outer face of control body 5 and the inner face of rotor 9.

From ports 16 and 17 fluid under pressure enters the space between control body 5 and rotor 9. This force is over the entire axial extension from port 16 to port 17 equal to the pressure of the fluid in the cylinders 6 and 7. This pressure in fluid in the clearance between rotor 9 and control body 5 and between control ports 13 and 14 acts on such large area between control ports 13 and 14, that the force of it is higher than the force onto the cylinder bottoms of cylinder-ports 6,16-7,17. Thus, the rotor is in this case not any more forced against the wall or outer face of control body 5 but away from it. Consequently the clearance widens between rotor 9 and control body 5 in the upper portion of FIG. 1 and leakage escapes from the cylinders 6 and 7 through the said widened clearance between rotor 9 and control body 5 in the upper portion of FIG. 1.

Thus, by this invention it is discovered, that in a fluid machine with more than one cylinder group arranged around a substantial cylindrical control body, the rotor is not pressed against the outer face of the control body in the high pressure zone as desired, but just on the contrary it is pressed away from it.

After this discovery of the invention it will now be described how in accordance with this invention, the described effect is reversed by one embodiment of the invention.

To reverse the described undesired and leakage-providing effect, the recess(es) 1 is (are) provided in control body 5 between the control ports 13 and 15, in accordance with this invention. Also in accordance with this invention, the recess(es) 1 is (are) communicated to a space under low pressure or under no pressure. This may, for example, be done by the provision of bores 2 and 3 through control body 5 to communicate recess 1 with the free space on an end of control body 5. Depressurization bores or channels 2,3 may also be communicated to recesses or ring grooves 4 which may be provided in control body 5 or rotor 9 endwards and slightly distanced from control ports 13,14 and ports 16,17.

The provision of the unloading recess 1 prevents the high-pressure fluid area in the clearance between rotor 9 and control body 5 and between control ports 13 and 14. Instead it provides a low pressure or no-pressure area between the ports Thereby it is assured, that the desired effect of pressing the rotor 9 against the outer face of control body 5 in the high-pressure half of the machine is obtained.

The location and extension of recess(es) 1 if desired in combination with recess(es) 4 defines the forces-play between the fluid in the cylinders 6,7 and the clearance between rotor 9 and control body 5. Between control ports 13 and 14 and recesses 4 a pressure gradient appears in the clearance from high pressure in control ports 13 and 14 to low or no pressure in recesses 4. A similar pressure gradient appears between control ports 13 and 14 and the recess(es) 1. For calculation it is possible to consider a medial pressure of 0.4 to 0.5 of the high pressure in the cylinders. It is now possible to do an exact calculation for a desired thrust force to press the rotor 9 against the outer face of control body 5 by a respective location and dimensioning of recess 1 or of recesses 1 and recesses 4.

In the bottom of FIG. 1, which shows a portion of the control body in a longitudinal sectional view, it is illustrated, how passages 2 and 3 may be located in the control body 5. The same communication, as shown in the sectional view on the bottom of FIG. 1, is also provided in the top portion of FIG. 1. However, it is not actually visible there in the Figure, because the top portion of FIG. 1 is a view onto the control body, at which the interior communications inside of the control body are not visible. FIG. 2 illustrates the same and in addition a sample for the peripherial extension of recesses 1. Fluid passages 92 of the known art appear in FIG. 2 in order to have FIG. 2 illustrate a true section through the control body 5 of FIG. 1.

In FIG. 3 it is shown, that in accordance with this invention the recess 1 may be replaced by a couple of recesses 11. A further medial recess 12 may be added, if so desired. Thus, control body 15 may have either one or more recesses 11 and/or 4. It may also have an additional recess 12. The recesses 4,11,12 may extend either only partially in peripherial direction or completely around control body 15. These details depend on the desired design. A bush 16 may be inserted into rotor 9 to surround and seal relative to control body 5. This arrangement makes it possible to manufacture the rotor 9 with cylinders of equal diameter and straight radial walls. The rotor parts 16,17 of smaller diameter are then provided preferably in the bush 16 only for simplicity of manufacturing.

FIG. 4 shows as a schematic a section through FIG. 3 along the line IV—IV in order to show the cross-sectional areas of the cylinder 6 and of the cylinder port 16.

The area whereupon the pressure in the cylinder acts to force the rotor 9 towards the outer face of control body 5 is now area 6 minus area 16. If the diameter of the cylinder 6 is D and the diameter of the cylinder port 16 is d, then the area whereon the pressure "p" acts would be $(D^2-d^2)$ pi/4 and the force acting thereon would be:

$$Pin = HP(D^2-d^2)\pi/4 \quad (1)$$

The axial distance from the respective recess 4 to the respective recess 1 or 11 would be 19 and the peripheral distance from the middle between two ports 16 to the middle between the next ports 16 of the same cylinder group would be 18 in FIG. 4. High pressure HP would be present in cylinder port 19. The pressure in the area 18–19 would be about 0.4 to 0.5 HP. Thus the pressure acting in the clearance between rotor 9 and control body 5 towards the rotor 9 is:

$$P_{out} = 0.4 \approx 0.5HP(18\times 19) - HPd^2\pi 4 \quad (2)$$

and the forces play of forces between pressure in the cylinder(s) and the clearance between rotor 9 and control body 5 is then:

$$\Delta p = HP(D^2-d^2)(\pi/4) - [0.4 \sim 0.5HP(18\times 19) - HP\text{-}d^2(\pi/4)] \quad (3).$$

According to the invention, the dimensions of ports 16,17 in relation to cylinders 6,7 and the location and dimensions of recesses 1,11,4 are so arranged, that the force "F" of equation 3 gives such force, which is desired to exert the action of pressing the rotor 9 in the pressure area so against the outer face of control body 5, that the clearance narrows there in such an extent, that a best possible seal against leakage will be obtained at the possible smallest friction between bush 16 and control body 5.

From comparison of FIGS. 5 and 6, wherein FIG. 5 shows the area of equation (1) and FIG. 6 shows the area of equation (2) it can be seen, that any desired difference-area for the desired thrust of the rotor 9 against the outer face of control body 5 may be obtained by the respective location and dimensioning as discussed above. The same will also appear from FIG. 4, wherein the respective areas are seem drawn above each other for best possibility of comparison.

The clearance areas endwards of recesses 4 in FIGS. 1 and 3, which may extend either peripherally partially or entirely around the control body 5 or rotor 9 as well as the areas of the clearance axially between recesses 11 and 12 of FIG. 3 may serve for bearing the rotor for stable running around the control body. They may also serve to provide hydrodynamic action and bearing between control body 5 and rotor 9. Their dimensioning and extension as well as their location will influence such desired bearing- or hydrodynamic-action.

Regarding FIGS. 1 and 3 it may also be noted, that in FIG. 1 the cylinders 6 and 7 may act in relation to a common flow of fluid and thereby have equal pressures in fluid. In such case a single recess 1 for both control ports 13 and 14 is suitable between those control ports in the control body 5. On the contrary thereto FIG. 3 illustrates cylinders 6 and 7 which may have different pressures in fluid and which may act in relation to different flows of fluid. Therefore, in the system of FIG. 3 two recesses 11 are provided. One for co-operation with the flow of cylinder 6 and the other for co-operation with the flow of cylinder 7. Recess 12 between them may be provided or be eliminated according to the actual requirement.

As it is known from the former art, a control body or control pintle has one high pressure half and one low pressure half. When the flow of fluid through the device becomes reversed, the former high pressure half becomes the low pressure half and vice-versa. In reversible flow devices the control pintles or control bodies are therefore symmetric, showing upper portions and bottom portions in the figures, which may selectively act either as high pressure halves or as low pressure halves. When the plane wherein the centric and eccentric axes of the rotor and of the piston-stroke actuator are located, is vertically in the device, the mentioned upper control body half may become the front half and the mentioned bottom half may become the rear half. However, since front- and rear-halves are difficult to be demonstrated in the plane of a sheet of paper, it is often customary in the Figures to show the control body or control pintle at 90 degrees turned in the respective Figure. This custom has become known to the artisans and is therefore often not specifically mentioned any more in the respective drawings or Figures.

Figure 7:
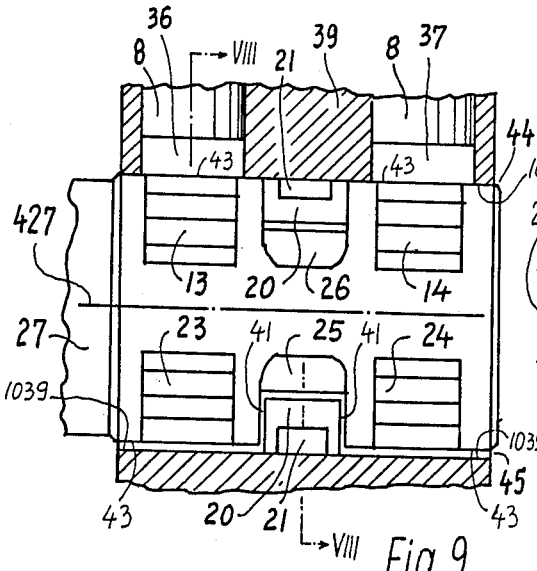
FIG. 7 is a longituinal sectional view through a portion of still another fluid machine with another embodiment of the invention applied therein.
Figure 8:
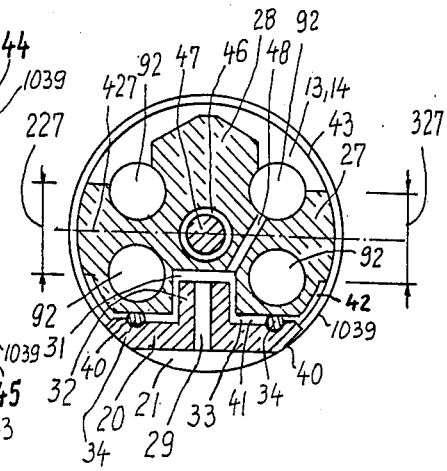
FIG. 8 is a cross-sectional view through FIG. 7 along VIII—VIII.

FIG. 8 also shows the control arc areas 227 and 327 of the control body. These areas appear on each individual control body of every of the Figures, but they are defined by referential numbers only in FIG. 8 and some other Figures. It is essential that these control arcs do not have gaps. Because the fluid of the working chambers would escape as leakage through such gaps. The portions of the control body above the control arcs and below the control arcs 227 and 327 are the respective pressure zones of the device. One the high pressure and the other the low pressure zone. Temporarily those pressure zones extend over portions of the closing arcs when the cylinders or their ports run over the respective portions of one or both closing arcs 227 or 327. The bottoms 571 of FIGS. 7 to 13 should be parallel to the medial plane 427 throug the archs 227 and 327 of the control body, f.e.: 27. Those recesses in the Figures, for example, in FIGS. 1, 3, 20, 21, which are communicated to a space or chamber under substantially low pressure, namely recesses 4,11,12,143,136,133, are substantially of the same low, or no, pressure as the space is, whereto they are located. When fluid flows from a respective clearance into the respectively communicated recess, the fluid which entered the recess immediately is subjected to the respective low pressure. This means, that the respective recess is unloaded from higher pressure and the respective recesses are therefore also called "unloading recesses".

In FIGS. 7 to 13 some samples are illustrated how a similar action of pressing the rotor 39 with its innerface 1039 against the outerface 43 of control body 27 in the pressure action half of it can be obtained in accordance with this invention also at rotors 39 which have cylinders of the "straight through-type" with equal diameters and radially straightly extending cylinder walls.

At such cylinders there are no cylinder bottoms above the cylinder ports 16,17 of the former Figures, whereon a pressure fluid force could act to press the respective rotor against the outer face 43 of the control body 27.

To accomplish the desired effect of sealing by pressing the inner face 1039 of the rotor 39 against the outer face 43 of control body 27 or vice versa, according to the invention a thrust member 20 or a plurality of thrust members 20 is (are) provided on the control body 27 at a location substantially diametrically opposite relative to the high pressure area of control body 27. Thrust member 20 is on its back end provided with or set into a thrust chamber or thrust space 33 whereinto pressurized fluid is led from the opposite diametrically acting cylinders 36, 37. FIG. 8 shows by way of example, that passage 48 may extend from thrust space 33 through a portion of control body 27 into one of the fluid passages 92. Said passage 92 cummunicates with control port 13 or 14 which contains the same fluid pressure as the respective cylinders of the cylinder group 36 or 37 associated to the respective control port 13 and 14 or both of them. In the sample of FIG. 7 both cylinder groups 36 and 37 deliver into the same fluid passages 92 and they are thereby acting together to supply or to exhaust a common flow of fluid. By the communication through passage 48 or any other suitable communication the pressure of fluid acting in the respective cylinder(s) 36,37 acts also in the thrust space 33. FIG. 8 also shows a holding chamber 31 for the reception of a holding portion 32 of thrust member 20. By the reception of holding portion 32 in holding chamber 31 any dislocation of thrust member 20 can be prevented. Thrust member 20 is further inserted into the recess 41. Seal means 34 seal between the bottom of recess 41 in control body 27 and the bottom of thrust member 20. Seal members 34 are so designed, that they permit a very small radial movement towards the rotor without reducing the ability to seal between the bottom of recess 41 and the bottom of thrust member 20. For example, they may be of flexible material, like teflon; hard rubber or the like. A further passage 29 extends through thrust member 20 for extension to and communication to the fluid pressure pocket 21 in thrust member 20. Fluid pressure pocket 21 is a recess in thrust member 20 and open radially outwardly to be sealed by the inner face 1039 of the rotor 39. The purpose of the provision of the fluid pressure pocket 21 is to lubricate the outer well face 40, which forms the sealing land 40 of the thrust member 20 together with the inner Face 1039 of the rotor 39 and also to prevent high friction between these faces during rotation of the rotor 39 or of the control body 27 respectively. A substantial radial play acts between the pressure in fluid in thrust chamber 33 and in fluid pressure balancing pocket 21. The difference of cross-sectional areas through them defines to a large extent with which final force the thrust member 20 is pressed against the inner face 1039 of the rotor 39. The thrust force acting out of the thrust chamber 33 against the bottom of thrust member 20 defines the force with which the thrust member 20 including its fluid pressure pocket 21 is pressed against the inner wall of the rotor 39 and thereby the final force with which the rotor 39 is pressed against the other half side of control body 27 which has the that time acting control ports 13 and 14. The seal faces 40 seal the fluid pressure pocket 21 in peripherial direction. The gradually decreasing fluid pressure along them is to be considered together with the pressure in pocket 21. Respective consideration is to be given to the seal faces of the respective other Figures.

Control body 27 may have respective control ports 23 and 24 on the other half of the control body so that they are diametrically located relative to control ports 13 and 14. In such case between control ports 13 and 14 another, but oppositionally acting thrust member 20 may be provided and associated to a respective thrust chamber 33 and the other elements described herebefore in connection with those on the bottom of the control body 27. By such double and diametric arrangement the control body may act for both directions of flow and for selective use of high pressure either in control ports 13 and 14 or in control ports 23 and 24. The control body 27 or the rotor 39 is then pressed either upward or downward in the Figure for seal along the respective outer face portion of control body 27 and inner face portion or inner face of rotor 39.

Portion 28 of the control body 27 in control ports 13 and 14 is important for the stability of control body 27 to prevent any deflection of the axis of the control body. This is generally known from my earlier patents and also known in the art but it is so important, that portion 28 is of rigid design, because otherwise the control body can not bear the rotor 39 and welding between control body 27 and rotor 39 can not be prevented, if the portion 28 does not provide enough rigidity to control body 27 or to any other control body of the specification.

A bore 46 may extend longitudinally through control body 27 to facilitate the possibility of extension of a shaft 47 longitudinally through the control body to the end of the fluid machine.

From recess 41 the recess portions 42 may extend peripherally either in a limited extent in order to form recesses 25 and 26 as limitation recesses 25 or 26, respectively, or between control ports 13 and 14 or 23 and 24 in order to restrict the distance of the seal portions between ports 13,14,23,24 in axial direction and to contain thrust members 20 in said restriction- or limitation recesses 25 or 26 respectively. Such restriction or limitation of the axial extension of the seal portions of the outer faces of the control body 27 is of value in order to clearly calculate and define the sealing area with the fluid pressure of 0.4 to 0.5 of high pressure "HP" in the fluid. The mentioned sealing areas and their calculations are defined in FIGS. 4 to 6 and in their descriptions. The recesses 25 and 26 unload through the clearance area 45 between the outer face of the control body and the inner face of the roto at least partially.

Communication passage 29 communicates recess 21 with recess or chamber or space 31. For a complete understanding of FIG. 8 it should be noted, that this section is partially laid through the thrust space 33 and partially through a control port as will be understood from the line VIII—VIII in FIG. 7.

Figure 9:
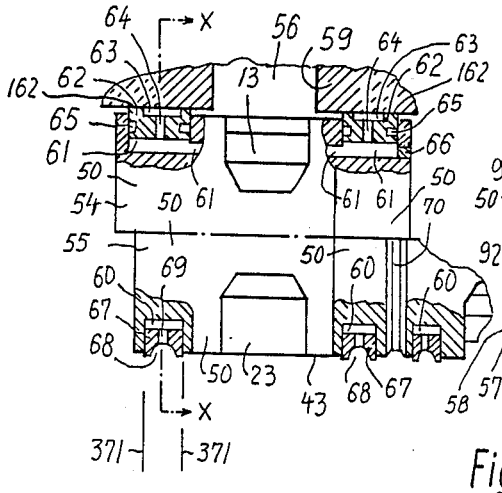
FIG. 9 is a longitudinal sectional view through portions of still further samples of fluid machines with other embodiments of the invention assembled therein.
Figure 10:
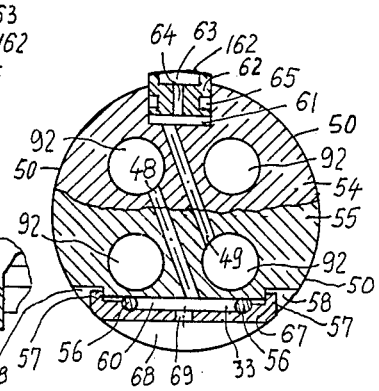
FIG. 10 is a cross-sectional view through FIG. 9 along X—X.

FIG. 9 and the thereto belonging cross-sectional FIG. 10 demonstrates how the thrust members are to be applied in a machine with only one cylinder group or in a machine wherein different flows flow through different cylinder groups. While in FIGS. 7 and 8 the both cylinder groups acted on a common flow of fluid and thereby had equal pressures in the fluid in them and it was therefore enough to associate a single thrust member 20 diametrically between them on the respective control body, it is not so easy to operate with a single thrust member in a fluid machine with only a single cylinder group.

FIG. 9 therefore demonstrates, that in a fluid machine with a single cylinder group 56 a pair of thrust members 67 is associated to each respective control port 13 and 23 or a pair of thrust members 67 to one of the control ports 13 or 23. The thrust members 67 of the pair of the thrust members associated to the respective control port are again substantially diametrically opposite located in the control body 54 or 55 and they are laterally equally distanced from the medial face through the respective control port. The respective thrust members are again provided in respective recesses 60 or 61 and said recesses are forming again thrust pressure spaces on the bottoms of the respective thrust members 67 or 62.

In FIGS. 9 and 10 two differently formed types of thrust spaces and of thrust members are demonstrated which may be applied selectively.

The thrust members 67 of the bottom portion 55 of the control body are associated to the control port 13 in the upper portion 54 of the control body and are communicated to the fluid and fluid pressure in control port 13. The thrust members in the upper portion 54 of the control body are associated to the control port 23 in the bottom portion 55 of the control body and communicated to its fluid and to its pressure in its fluid. These communications are demonstrated by passages 48 nd 49 in FIG. 10 respectively. Since the respective fluid passages 92 communicate with the respective control ports 13 or 23 the passage 48 communicates the control port 13 with the pressure thrust chambers 60 and the passage 49 communicates the control port 23 with the thrust pressure chambers 61.

In the upper portion of FIG. 9 it is further shown by way of example, that each of the thrust chambers of the respective pair of thrust chambers can be communicated with the other of the thrust chambers of the same pair of thrust chambers. That may be done for example by passage 61 which extends from the left chamber 61 to the right chamber 61 substantially parallel to the axis of the control body 54-55. Connection passage 61 of thrust chambers 61 may be closed by closure 66.

The upper thrust chambers 61 as seen in FIGS. 9 and 10 may be of substantially cylindrical configuration like sack-bores or dead bores in order to receive cylindrical thrust members 62 therein. Thrust chambers 61 are again provided in control body 54,55. THrust members 62 have a fluid pressure recess 63 for the same purpose as the members 20 have fluid pressure pockets 21 in FIGS. 7 and 8. Commumication passages 64 provide the communication between chambers 61 and pockets 63. Seal grooves 65 may be provided in thrust members 62 for the reception of seal rings like piston rings or o-rings. The outer faces 162 of the thrust members 62 are and must be formed to correspond to the configuration and radius of the inner face 1039 of the rotor 59 in order to be able to seal therealong. While high pressure acts in the pockets 63 the medial pressure of 0.4–0.5 HP acts as mean pressure along the outer faces 162, so, that the difference of force in the thrust chambers 61 and of the pockets 63 plus the medial pressure gradient along the outer seal faces 162 presses the thrust members 62 against the inner face of the rotor 59 and thereby the rotor 59 against the other half of the control body 55 for sealing its control port 23. The cross-sectional area through chambers 61 and through members 62 define the force with which the inner face of the rotor and of the outer face of control body 55 are pressed together for their seal relative to each other.

The pair of thrust chambers 60 in the bottom portion of control body half 55 is associated and communicated to the control port 13 of the upper control body half 54 as already described before. In the sample of the Figures the thrust chambers 60 are slots through a portion of control body portion 55. The therein provided thrust members 67 are again in a limited extent radially moveable in slots 60.

Figure 11:
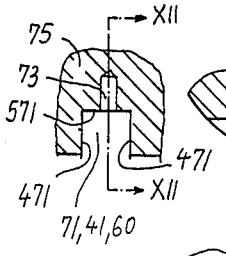
FIG. 11 is a longitudinal section of a portion as in FIG. 9.
Figure 12:
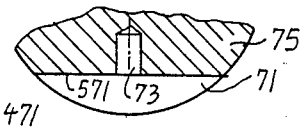
FIG. 12 is a cross-sectional view through FIG. 11 along XII—XII.
Figure 38:
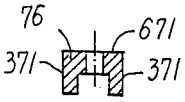
FIG. 38 is a cross sectional view through the arrowed line of FIG. 13.
Figure 13:
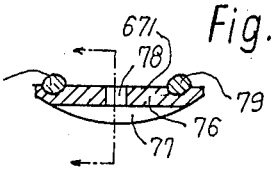
FIG. 13 shows a sectional view through an insert to be inserted into FIGS. 11 and 12.

Slot 21 or 60 with bottom 571 and parallel end faces 471 to fit and seal therein and there along the end faces 371 of member(s) 67,76 are separately shown in FIGS. 11 to 13, and 12. By looking at these Figures the substantiality of configuration and of direction of slots 60 is easy to be understood. Thrust members 67 have again fluid pressure pockets. They are shown as 68 in the Figures. Communication passages 69 extend through thrust members 67 for communication of thrust chambers 60 with pressure pockets 68. Their actions and relations are similar as the respective means in the other Figures.

FIG. 9 shows in addition a suitable design of the arrangement, again by way of example. On the ends of the slots 60 recesses 58 may be provided to extend beyond the bottoms of recesses or slots 60 into the control body portion 55. Thrust members 67 may have on their ends extensions 57 which embrace the endfaces or bottom faces of the recesses 58. That prevents any dislocation of the thrust members 67 relative to the slots 60 and also relative to the control body portion 55. Seal inserts 53 may contain seals 56 and be inserted into thrust members 67 at the ends of thrust chambers 33 in slots 60 for defining the ends of thrust chambers 33 and also for sealing between the bottom of slot 60 and thrust member 67, in the respective slot or thrust chamber 60 or 33. The seal inserts 52 with their seals 56 are so configurated and built, that they permit a limited radial movement of the thrust member 67 in slot 60 without reducing the effectivity of the seal between the respective bottom or wall of the respective slot 60 and the respectively inserted thrust member 67 in order to prevent escape of leakage out of the respective thrust chamber 33.

Instead of providing the recesses 58 and the end extensions 57 it is also possible to secure the holding of the thrust member 76 in position in slot 71 by a simple cylindrical pin which may be inserted into a bore 73 in the control body portion 75 and which may extend through the bore 78 in thrust member 76 with fluid pressure pocket 77. This possibility is demonstrated in FIGS. 11 to 13. The side walls of slot 71 in FIG. 11 may be accurately ground and so may be the lateral end faces of thrust members 76 or 67 of FIGS. 13 or 9, 10 in order that they seal themselves on the walls of the slots 71 or 60. A radially deflection seal or seals 79 may be provided on thrust member 76 or on respective other thrust members.

In relation to FIG. 9 it was heretofore assumed, that the rotor 59 of the Figure contained only a single working chamber- or cylinder-group 56. Contrary thereto the rotor may however also contain a plurality of working chamber groups or cylinder groups. If that is the case and if it is possible, that different flows of different pressures flow through the different working chamber groups or cylinders, then it is suitable to extend the control body 54 and 55 in one axial direction. This is shown in the bottom portion of FIG. 9. The control body extension may then have the other set of control ports, namely control ports 14 and 24. Each of these control ports may then be associated to a diametrically located pair of thrust chambers and of thrust members therein similarily as in FIG. 9 respectively to the therein shown control ports 13 and 23. The left side and the right side portion of the control body may then be separated by a medial recess 70 as shown in FIG. 9 at the bottom portion of said Figure. Since the right side of the control body and of the rotor would then be substantially similar to the left portion, the bottom portion of FIG. 9 shows only a small portion of the right end portion and shall thereby indicate that there may be a right portion substantially similar to the left portion, which is shown in FIG. 9.

The arrangement in the upper portion of FIG. 9 is that arrangement which is easy machined, because everything is clearly round. The upper portion requires however a longer axial extension of the control body than the bottom portion-sample of FIG. 9. Such longer axial extension is not in all the cases desired. Especially not in cases, where a plurality of cylinder groups or working chamber groups is provided in a rotor and associated to a control body. Further, the design of the bottom portion of FIG. 9 is also not difficult in machining. It requires just another kind of machining and in addition specific seals, while the design in the upper portion requires only simple o-rings or piston rings for sealing.

Peripherially of the thrust chambers and thrust members respective bearing faces 50 may remain for the stable rotation of the rotor relative to the control body and hydrodynamic fluid pressure fields may occur along those face portions 50 and add to the stability and accuracy of the rotation or movement of the rotor relative to the control body.

The embodiment of FIG. 21 with the thereto belonging schematic of FIG. 22 illustrates, that it has been found in accordance with this invention, that it is not in all cases suitable to simply arrange a diametrically located and axially spaced pair of fluid pressure pockets respective to a control port of the control body.

The invention recognizes, that, when the cylinder 56 is a straight through bore in rotor 134 there remains almost no action from the control port 13 against the rotor 134 or such thrust action by fluid is relatively small. This force is illustrated by 138 in schematic 22. There is no radially inwards directed force out of chambers 6 onto rotor 134 in case of such straight radially through cylinders 56 in a rotor like 134. From port 13 the pressure gradients 139 appear on both axial ends of the port 13 in the clearance between rotor 134 and control body 135. Thus, the total pressure forces on the upper half of control body 135 if high pressure "P" acts in control port 13 is "P=139+138+139 of FIG. 22. Since the same high pressure P is led commonly into the oppositely diametrically located and axially spaced fluid pressure balancing recesses 133 on the bottom portion of the control body 135 at the same time act the pressure fields 142+140+141+141+140+142. The sum, which is the total force of fluid pressure on the bottom of the control body 135 is higher, than the sum of the respective fluid pressure forces on the upper portion of control body 135. Therefore the control bodies of the former art do not float relative to the rotor or vice-versa as the former art for example of my earlier U.S. Pat. No. 3,062,151 teaches, but they are displaced eccentrically relative to each other and thereby provide high leakage and high friction which reduce the efficiency of the fluid machine. This is the case, when the cylinder 56 is a straight through cylinder. But it is not necessarily so, when the rotor port has a smaller diameter than the cylinder whereto it belongs.

It has now been found in accordance with this invention, that the eccentric displacement of the rotor relative to the control body can simply be prevented and the said rotor and control body can be made to float again centrically relative to each other by the provision of a widened control recess 137 around the respective control port 13 or 23. Thereby the forces upwards in FIG. 22 are becoming equal to the downward forces of FIG. 22 and the control body 135 floats centrically again relatively to the rotor 134. The increased leakage and friction is prevented and the device effective again. For loading port 23 the bottom recess 137 acts with recesses 136.

In FIGS. 14 to 17 means are shown which are related to fluid flow facilitating machines which have radially expanding working chambers and a cylindrical rotor bore, which may also be called a rotor-hub.

A cylindrical control body was proved in said rotor hub and controlled the flow of fluid to and from the working chambers in the machine. An arrow clearance was provided between the outer face of the control body 1 and the inner face 28 of the rotor 10 to seal against leakage losses between said faces.

When the radially acting working chambers 5 with displacement members 6 associated thereto have entrance-exit passages 4 of a smaller cross-sectional area than the chambers 5 have, a pressure of the fluid acts against the bottom of the chamber 5. For example, if the chambers are cylinders 5 which have a diameter 8 and the passages 4 to the respective cylinders 5 have a diameter 7, then the pressure acts onto the bottom of diameters 7–8 of the cylinder with a force "Fr"$=(8\phi^2-7\phi^2)(pi/4)\times p$ with p=pressure in the fluid in the cylinder. This force "Fr" can be utilized to press the rotor 10 with its inner face against the outer face of the control body 1 at one half of the control body. In order to obtain this pressing action for narrowing the said clearance on the pressure-half of the machine, it is necessary to eliminate the contrary acting pressure in fluid in the said clearance by the provision of unloading recesses 9 which are communicated to a space of no or of low pressure. The location and dimensioning of the said recesses 9 in combination with the said diameters 8 and 7 define the force with which the said clerance between body 1 and rotor 10 is narrowed on the pressure half of the machine.

Such arrangements have worked quite satisfactorily, but they have not obtained the optimum of efficiency, because there remains a certain leakage due to a widening of the clearance on both peripherial ends of the high pressure zone. This fact was found by this invention and the invention now provides means to improve the volumetric efficiency of the machine and also the total efficiency of the machine by reducing the leackage through the clearance of the high-pressure half of the machine.

Figure 15:
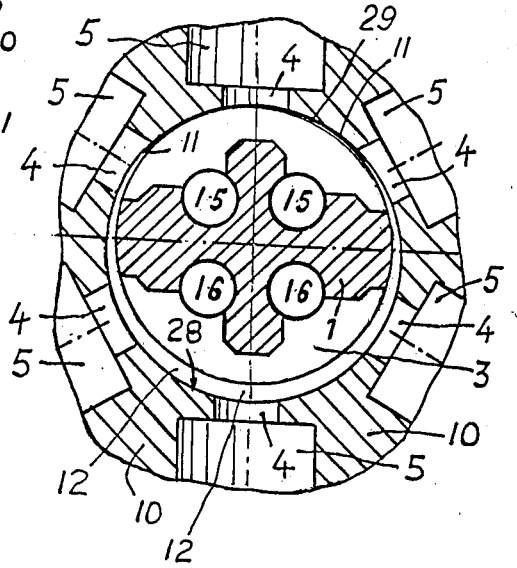
FIG. 15 is a cross-sectional view through FIG. 14 along line XII—XII.
Figure 16:
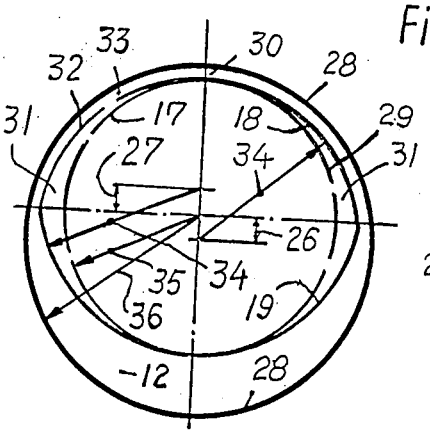
FIG. 16 is a schematic explanation.
Figure 17:
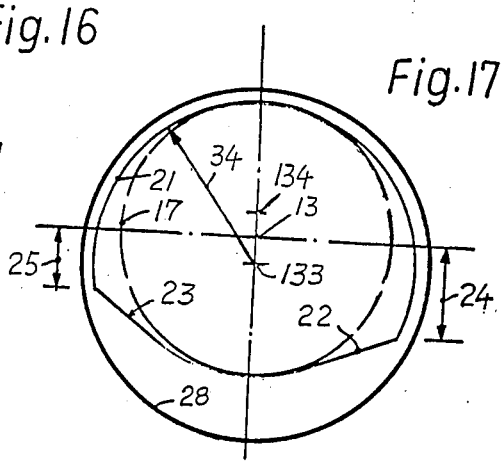
FIG. 17 is an other schematic explanation.

The clearance 11-12 is also shown in FIG. 15 and FIGS. 16–17; however in a drastically enlarged scale. Actually the clearance between inner face 28 of rotor 10 and outer face 29 of control body 1 is only around a hundredth or a few hundredth of a millimeter.

When no pressure acts in the machine, then the rotor 10 may float substantially centrically around the axis of control body 1, whereby the clerance would be substantially equal all around the control body. When however a pressure builds up in one half of the machine, the rotor is pressed under the described force "Fr" towards the control body within the pressure half of the machine. The rotor does then not revolve any more around the control body axis 32, but around an eccentrically displaced axis 33. Thereby the area around 30 of the clearance 11-12 becomes narrow and prevents or reduced leakage. There remain however areas about 90 degrees remote, which have the numeral 31 and which are not considerably narrowed and which reduce leakage only slightly. From location 30, the narrowest area, the clearance widens gradually until areas 31 on both sides. The system can therefore not close the clearance area 11, but reduce the clearance area 11—the high pressure area—just about to a half of the former circular cross-sectional area. Such reduction to only one half of cross-sectional clearance area can not obtain an optimum in reduction of leakage.

Figure 14:
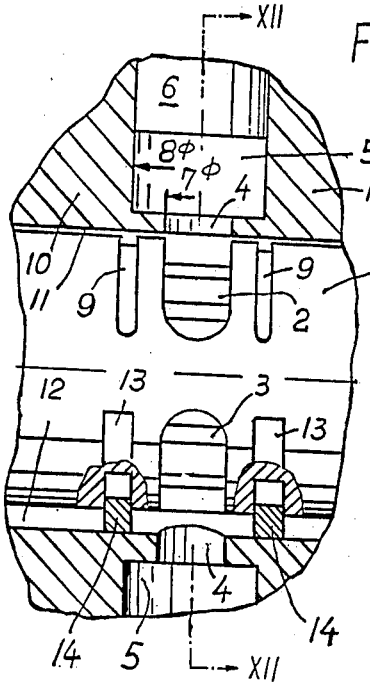
FIG. 14 is a partial view through a radial piston device.

Consequently, according to the invention, the diameter 29 of the control body becomes made about equal to the inner diameter 28 of rotor 10 on the high pressure zone of the machine, but with a radius 34 of (½) 28 around the eccentric center 133 instead of around the centre 132. This new radius of one half of the outer face 29 is shown in FIG. 14 schematically by 32. The clearance 33 between 28 and 32 has now, according to the invention, the same radial size all over the high pressure half of the machine and consequently the reduction of leakage therethrough is now according to the invention, an optimum.

The bottom half of the control body, which now is the low pressure half, gets an equal radius 34, as the pressure half has got and forms the outer face portion 19 around the eccentre line 134. The dotted line 17 with radius 35 is the former cylindrical control body.

By this arrangement the clearance in the low pressure half widens to the wide portion 12. This would generally be acceptable on the low pressure zone. However, the danger might arise, that the pump sucks air through the widened clearance portion 12. Therefore, according to the invention, seal members 14 may be inserted into seal beds 13 to close the clearances 11 or 12 in axial direction.

It is apparent from FIG. 16, that, when the fluid flow direction becomes reversed, so, that the bottom portion will become the high pressure half, the rotor will move upwards to revolve around the upper eccentre line 34. The actions are then replaced diametrically.

In order to compress or pre-compress the fluid in the working chamber 5 when it revolves over the control arc between the low pressure and high-pressure half, it may be good to extend the face portion with radius 34 over more than 180 degrees, for example, by extension 24 in FIG. 17 for move of chamber 5 from low- to high-pressure half and by extension 25 for movement of chamber 5 from high- to low-pressure half. The chamber 5 is then ideally closed not only in the high pressure zone, but also in the control arcs between the high- and low-pressure zones. The inclinations or recesses 22 and 23 may then be formed on the outer face of the control body in order to obtain an ideal silencing by gradually opening and closing the chambers 5 to the low-pressure control port of the machine.

By the above arrangement the leakage in fluid flow handling machines with cylindrical rotor hubs can be drastically reduced and the efficiency and power of the machine can be increased. The machine may now be economical also for a higher pressure range of pressure in fluid.

Control body 1 has fluid passages 15 for one flow direction and fluid passages 18 for other direction of flow of fluid as well as the control ports 2 and 3.

The arrangement may be done for one-directional flow machines as well as for two-directional flow machines and it may be applied to single chamber group machines as well as to multi chamber-group machines.

In the embodiment of FIG. 18 again chamber groups 36 and 37 are acting on a common flow of fluid, whereby they have again equal pressures. It is therefore enough, so, as in FIG. 16, to provide counteracting pressure means axially seen only between the control port areas 13-23 and 14-24. Rotor 100 has again a bush 101. The control ports 13, 14, 23, 24 are provided in control body 105. Instead of providing fluid pressure balancing pockets in the outer face of the control body 105 the embodiment of this Figure has the advantage that the pressure balancing and seal-means is provided in the bush 101. Recesses 102 and 106 are provided in bush 101 and extend radially therethrough for the reception of pressure loaded thrust members 103 and 104.

Figure 18:
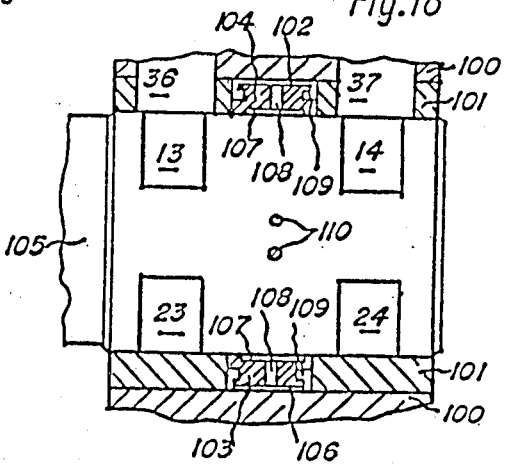
FIG. 18 is a longitudinal sectional view through another modification of the machine with still another embodiment of the invention applied therein.

In the embodiment of FIG. 18 the thrust members 103 and 104 are radially moveable in the respective radial recesses 102 or 106 wherein they are located. Fluid under pressure is led into the radially outer portions of the respective recesses 102 or 106 from the diametrically opposite located individual working chambers or cylinders 36 and/or 37. That may be done by communication passages, such as demonstrated by numbers 82 in FIG. 16. Or it may be bone by communication passages, such as for example 48 or 49 through the control body 105. In the latter case the passages 48,49 would end in respective openings or ports 110 diametrically relative to the associated and communicated chamber 36 or 37 in the outer face of the control body 105. The communications here described are not shown in FIG. 18, because their different probabilities or possibilities are already demonstrated in the mentioned other figures. Each thrust member 103 and 104 is preferred to have on its radial inner end a fluid pressure pocket 107 which is by a respective bore 108 through thrust member 103 or 104 communicated to the outer portion of the respective recess 102 or 106. The respective outer portion of the respective recess 102 or 106 forms thereby a thrust chamber, filled periodically with pressure of fluid which presses the respective therein located thrust member 103 or 104 radially inwardly towards and against the outer face of the control body 105. The portions surrounding the pockets 107 are sealing the pocket 107 along the outer face of the control body 105. The respective dimensioning of the thrust chambers 102–106 and of the therein radially moveable thrust bodies 103–104 are defining the force with which the thrust bodies 103 or 104 are pressed against the outer face of control body 105. If the communication through the ports 110 is provided, then the thrust chamber portions in 102 or 106 are filled with pressure and fluid through the bores 108 at those times, when the pockets 107 run over the respective ports 110.

The feature of the embodiment of FIG. 18 compared to the embodiment of FIGS. 14 to 17 is, that the outer portions 121 which surround the pockets 107 are sealing the pockets 107, so, that almost no leakage escapes from the pockets 108. On the contrary thereto in FIGS. 14 to 17 some leakage flows out of pockets 86–87 through the clearance between rotor bush 81 and control body 85. Thus, the arrangement of FIG. 18 brings a higher volumetric efficiency than those of FIGS. 14 to 17.

The embodiment of the invention of FIG. 18 may serve two different purposes. One thereof is to prevent leakage at the opposite diametric fluid pressure balancing pocket, when rotor 100 and control body 105 float concentrically relative to each other and the other is or can be to press the rotor 100 and the outer face of the control body together onto each other at the high-pressure control port half of the control body 105.

In the first application case the cross-sectional areas through recesses 102,106 and through thrust members 103,104 are so dimensioned, that the force through them just equals the forces of fluid which act diametrically out of the respective control ports and the clearance between rotor-bush and control body in the neighborhood of the control ports.

In case of the second application the cross-sectional areas through the said recesses 102,106 and through the said thrust members 103,104 are a little bit bigger and actually they are big enough, in detail so bit, that the forces acting from them exceed the diametrical fluid pressure forces by for example 1 to 6 percent. Thereby the inner face of the rotor 100 or of the rotor bush 101 is pressed close to the respective control ports 13–14 or 23–24 in order to reduce axial flow of leakage out of them and at the other hand maintain still a relatively small friction between the outer face of control body 105 and said inner face of the rotor or brush. The overthrust of 2 to 6 percent is a value obtained from empirical testing. The above described first application possibility gives the smallest friction and the best device for low and medial pressure. The second application possibility is better for high pressure, because it reduces leakage but it can not maintain the same small friction as in the case of the first application. The second application possibility further has the disadvantage, that the rotor and control body then float about different axes which are distanced from each other a few hundredth of a millimeter or less.

Chambers and thrust members 102,104 are co-operating with control ports 23 and 24, while the opposite chambers and thrust member 106,103 are co-operating with the control-ports 13 and 14. The co-operation of control ports with diametrically opposite located chambers and thrust members is a requirement to obtain the aim of the embodiment.

Figure 19:
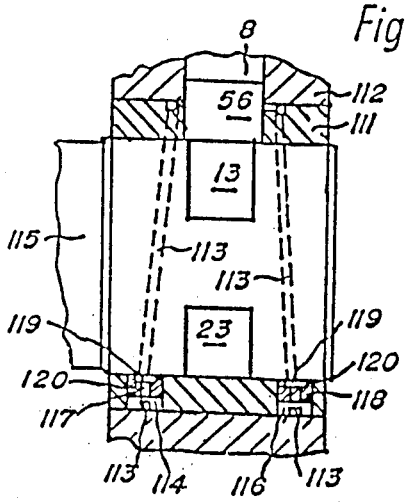
FIG. 19 is a longitudinal sectional view through still another fluid machine which employs embodiments of the invention.

The embodiment of the invention shown in FIG. 19 is a one working chamber group device which has a single working chamber group or cylinder group 56 in rotor 112. Again it has a bush in the rotor which is shown by 111. From each individual chamber 56 at least one communication passage or a pair of communication passages 113 extends to the diametrically opposite located half of the control body 115 or of the bush 111. There it ends into a pair of thrust chambers 114,116 which extend radially through the bush 11 and open towards the outer face of the control-body 115. Each pair of thrust chambers has two thrust chambers 114,116 which are axially with respect to the working chambers 56 and to the control ports 13,23 distanced from them and whereof one is located endwards of them in a different axial direction. The control body 115 has control ports 13 and 23. Each thrust chamber 114,115 contains a thrust member 117 or 118 radially moveable in the respective thrust chamber. Each thrust body has a passage 120 to communicate the outer portion, which is the thrust chamber portion of the respective chamber 114,116 through the respective thrust member 117,118 to the respective fluid pressure pocket 119 in the inner end of the respective thrust member 117 or 118. The fluid pressure pockets 119 are sealed along the outer face of the control body 115 by the remaining radial inner end portions of the thrust members 117 or 118.

This arrangement of FIG. 19 can again fulfill one of two possible desired purposes. Either to let the rotor and control body float centrically to each other; or, to press them together at the half which contains the control ports under the higher pressure.

It is possible to extend the control body 115 and the rotor 112 with bush 111 in an axial direction in order to apply a second or more working chamber groups or cylinder groups 56 with thereto associated additional arrangements of thrust chambers and thrust members as well as the respective fluid pressure pockets and communication means.

The thrust members in FIGS. 18 and 19 may either be seal fitted in the respective thrust chambers or recesses or they may be provided with grooves or means 109 for the reception of respective seal means.

Figure 20:
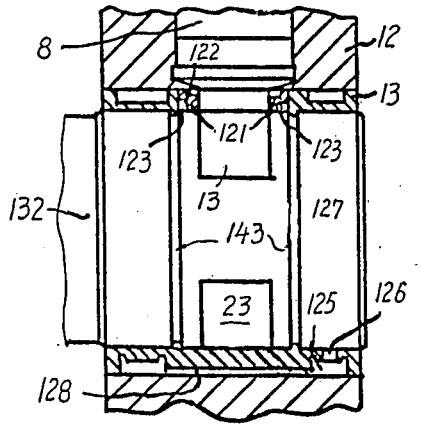
FIG. 20 is a longitudinal sectional view through a portion of still a further fluid machine with another embodiment of the invention utilized therein.
Figure 20:
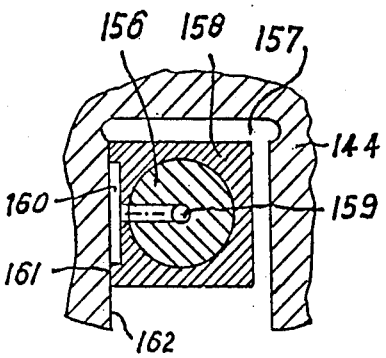
Figure 20:
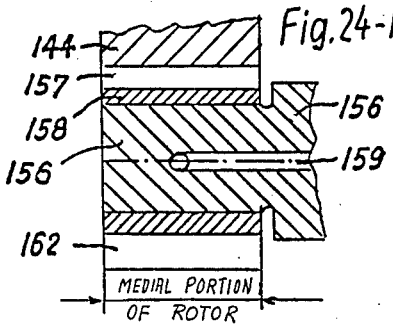

In the embodiment of the invention of FIG. 20 two additional possibilities to seal against leakage between rotor 129 or rotor bush 130 and the outer face of control body 132 are shown. The first possibility is, to provide a radial recess, no reference number, below the respective cylinder or working chamber 6 through the bush 130. Bush 130 may be for that purpose inserted into rotor 129. Into the said radial recess or bore a thrust member 121 may be inserted with radial move-ability therein. Thrust member 121 may get the rotor passage 16 therethrough for the co-operation with the control port pair 13,12 of control body 132. The inner face of thrust body 121 has such configuration that it slides along and seals partially along the outer face of control body 132. In order to provide a radially inwardly directed fluid pressure thrust on thrust member 121 the unloading recess 123 may be provided on the inner portion of thrust member 121 surrounding the seal face portion between passage 16 and said unloading recess 123. The thrust collection chamber 122 may be provided in the radial outer end of the thrust member 121 in order to make sure that the radial outer end of the thrust body 121 gets more fluid pressure thrust than the radial inner end. Thereby the thrust of the thrust member 121 against the outer face of the control body 132 is obtained and maintained. That provides the partial seal especially in axial direction parallel to the axis of control body 132. Each cylinder or chamber 6 may get such a thrust chamber and such thrust member 121. To held the area of the control body 132 which is under pressure to a minimum, the unloading grooves 143 may be provided in the outer portion of control body 132 and to communicated to a space under no- or under low-pressure.

The other possibility of a sealing arrangement of the invention is, to provide deep recesses 124 and 125 from outwards radially deep into the bush 130. Each one thereof axially spaced a little away from the respective control ports 13,23. Instead of providing each such recess 124,125 there may also be a plurality of such individual recesses be provided. They have to be filled with fluid under the respective high pressure. Either from an adjacent working chamber 6 or control port 13,23 or through communications 127 through the control body 132 and communications 126 through the bush 130. Recesses 124 and 125 are axially wide enough and their bottoms are radially thin enough to allow a limited radial deflection under the pressure in them. The inner faces of the bottoms of the recesses 124 and 125 are then pressed against the outer face of control body 132 and seal there along. Passage(s) 128 may communicate recesses 124 and 126 if so desired.

The embodiment of FIG. 21 with the thereto belonging schematic of FIG. 22 illustrates, that it has been found in accordance with this invention, that is not in all cases suitable to simply arrange a diametrically located and axially spaced pair of fluid pressure pockets respective to a control port of the control body.

The invention recognizes, that, when the cylinder 56 is a straight through bore in rotor 134 there remains almost no action from the control port 13 against the rotor 134 or such thrust action by fluid is relatively small. This force is demonstrated by 138 in schematic 22. There is no radially inwards directed force out of chambers 6 onto rotor 134 in case of such straight radially through cylinders 56 in a rotor like 134. From port 13 the pressure gradients 139 appear on both axial ends of the port 13 in the clearance between rotor 134 and control body 135. Thus, the total pressure forces on the upper half of control body 135 if high pressure "P" acts in control port 13 is "P"=139+138+139 of FIG. 22. Since the same high pressure P is led commonly into the oppositely diametrically located and axially spaced fluid pressure balancing recesses 133 on the bottom portion of the control body 135 at the same time act the pressure fields 142+140+141+141+140+142. The sum, which is the total force of fluid pressure on the bottom of the control body 135 is higher, than the sum of the respective fluid pressure forces on the upper portion of control body 135. Therefore the control bodies of the former art do not float relatively to the rotor or vice-versa as the former art for example of my earlier U.S. Pat. No. 3,062,151 teaches, but they are displaced eccentrically relative to each other and thereby provide high leakage and high friction which reduce the efficiency of the fluid machine. This is the case, when the cylinder 56 is a straight through cylinder. But it is not necessarily so, when the rotor port has a smaller diameter than the cylinder whereto it belongs.

It has now been found in accordance with this invention, that the eccentric displacement of the rotor relative to the control body can simply be prevented and the said rotor and control body can be made float again centrically relative to each other by the provision of a widened control recess 137 around the respective control port 13 or 23. Thereby the forces upwards in FIG. 22 are becoming equal to the downward forces of FIG. 22 and the control body 135 floats centricaly again relative to the rotor 134. The increased leakage and friction is prevented and the device effective again. For loading port 23 the bottom recess 137 acts with recesses 136.

At the description of the earlier embodiments it has become apparent that there are two possibilities of location of the rotor relative to the control body. The one is, that they are floating relative to each other to a common axis. The other is, that they are relative to each other radially displaced so, that they are eccentric relative to each other that their axes are distanced from each other. Such distance is in practice less than a few hundredth of a millimeter and often only a few thousands of a millimeter. The said other possibility of eccentricity between rotor and control body is scientifically, technically and geometrically considered, an undesired and imperfect case. The ever increasing pressure in fluid machines however demands sometimes a compromise in favor of a tighter seal. It can therefore presently no more be entirely prevented to utilize even the imperfect appearing possibility of intentionally providing an eccentric running of the rotor relatively to the control body or of the control body relative to the rotor in order to obtain a smaller clearance on the respective high pressure control port half of the control body and thereby to obtain a tighter seal and less leakage at the high pressure side of the clearance between rotor and control body. The market demands this application because the fluid machine shall be inexpensive and of little weight.

Such eccentricity between rotor and control body demands, that the rotor be radially moveable relative to the control body. Because during revolution of the rotor the rotor floats with its inner face one degree after the other a little bit towards the outer face of the control-body at one half and away from it on the other half of a revolution. The flexibility or radial moveability of the rotor relative to the control body is already obtained in the former art by the insertion of a crosswise slotted disc between the shaft and the rotor of the fluid machine where fingers or extensions of the rotor and shaft enter crosswise the slots of the crosswise slotted disc. This is also done in order to prevent offcentered running of the shaft to the rotor, because such unround running of the rough machined and borne shaft would stick and weld the more accurately machined inner face of the rotor on the outer face of the control body, because the clearance between them may be smaller than the accuracy of the bearings, which bear the shaft of the fluid machine.

The embodiment of the invention of FIGS. 23 and 24 demonstrates effective flexible clutch arrangements to permit and assure the required radial move-ability between the outer face of the control body 145 and the inner face of the rotor 144. For said purpose the arrangement includes the provision of radial recesses 157 in the rotor 144 or in a cross-slotted disc before the rotor 144 and the provision of extensions or fingers 156 of a cross-disc or of shaft 152 for the engagement onto at least one wall of said slot or slots 157. Shaft 152 may be centrically borne in bearings 152 in the housing or cover of the machine and/or in the control body 145 by bearings 154 or 154 and 153. The control body 145 may be centric relative to said shaft 152, so that both have the same axis. The rotor 144 revolves a little bit eccentrically relative to said axis of said shaft and of said rotor, as known from earlier FIGS. of this specification. The engagement portions, extensions or fingers 156 of shaft 152 engage into respective slots 157 in rotor 144 for driving the same or to be driven by the same. The slots 157 are wider in radial direction than the fingers 156 or the fingers 156 are, and are able to move radially in or partially out of said slots 157. Thus, the fingers 156 are to a limited extent able to move radially in the slots 157 whereby the radial dislocation of the rotor relative to the shaft is permitted during operation and driving of one by the other.

For easy movement of the fingers 156 along the respective wall of the respective slot it is preferred to set slide shoes 158 around the fingers for engagement on a respective wall of the respective slot 157.

For a still better operation of the device and for easier radial movement of the rotor 144 it is possible to provide fluid pressure pockets between the fingers and shoes 156–158 or between the slot walls 162 and the thrust faces 161 of the slide shoes 158. These fluid pressure pockets lubricate the mentioned faces 161 and 162 or the faces between fingers 156 and shoes 158 relative to each other at their relative movement and they are reducing the friction between said faces. The fluid pressure pockets are shown by numbers 160 and they are filled with fluid under pressure through the passages(s) 159 which extend(s) through the fingers(s) 146 and through shaft 152 into a space with fluid under pressure. For example to a respective high pressure port in the control body 145. Passage(s) 159 may for that purpose extend from shaft 152 into control body 145 and a sealing means—not shown in the Figure—may seal the extension of the respective passage 159 from the shaft 152 into the control body 145.

A stable bearing of the revolvable shaft 152 can be obtained, for example, by extending a portion 149 of shaft 152 through a bore 148 through the control body 145 for bearing the shaft 152 at both ends of the fluid machine.

For the precision of the driving of shaft 152 or of rotor 144 by the other of these two elements it is suitable to provide the slots 157 in the medial portion of the rotor 144 or on medial means in the middle between both axial ends of the rotor 144. In practice however it is often preferred to engage the rotor by the shaft or vice versa on one end of the rotor because the machining is then easier and the costs of the fluid machine is thereby reduced. For high quality operation the engagement of shaft and rotor on one end of the rotor is not so good technologically because it might result in an inclination of the rotor relative to the outer face of the control body. That might result in increased friction and leakage between them.

It is desired to make the fingers or arms 156 strong enough in design to prevent deformation.

The main care however is to be taken to the necessity, that the friction of relative radial movement between rotor 144 and shaft 152 remains less than the forces exerted by the several embodiments of the invention or by one of them for pressing the rotor and the control-body together or for narrowing the clearance between them at the high pressure control port half of the control body.

Control body 145 may have control ports 146 and 147 and passages 92 as well as restriction recesses or balancing recesses 163 for the purposes as in other embodiments of the invention.

DESCRIPTION OF THE TECHNOLOGY INVOLVED

In the patents, which were mentioned in the first two groups of patents in the description of the prior art, it was attempted to let the rotor-hub's inner face the outer face of the control body float concentrically relative to each other. All these patents of the former art demanded a concentric floating of the mentioned faces relative to each other. And all these patents provided or attempted to provide by one or the other solution, a radial fluid pressure balance between the mentioned faces of the control body and of the rotor. In those of the aforementioned patents, which are mentioned as my own patents in the first group of the mentioned patents, such radial fluid pressure balance was also partially perfectly obtained. Relative to ports, which contained pressure in fluid there were diametrically, relative to the axes of the rotor and of the control body counter acting and oppositionally directed fluid pressure balancing pockets provided.

Great efforts have been made to apply these principles in practical application. Several thousand orders for supply of machines in accordance with the mentioned patents have been built and supplied to the industries. The delivered products were found very reliable and of little friction.

However, at the extensive testings of the devices in my laboratory and in laboratories of the companies which built the devices under my licenses, as well as in government institutions and in laboratories of technical universities and high schools in ASIA, AMERICA and EUROPE, occasionally some test data appeared, where suddenly an unusual high leakage occured. It was then generally assumed, that the data were either errors of measurement or "outrunners". They were considered to appear very rare and of no considerable influence to the application of the devices in industries and technologies.

However, I inquired deeper into the described experience of occasionally higher leakages. I considered that in the latter times the pressure in the devices should be increased to still higher values. That was especially desirable in some of the industrial applications. At these attempts and inquiries I noticed as follows:

The radial fluid pressure balance between the respective rotor and control body was perfectly obtained in design as well as in the actually built products. Thereby the rotors and control bodies had obtained the ability to float perfectly centrically relative to each other between fluid pressure areas and fluid films.

The reasons for the occasionally higher leakages could therefore not be considered to occur from imperfect radial pressure balance.

By such considerations I found, that a radial pressure balance, even if absolutely perfectly obtained, makes it possible, that the rotor and control body actually float relative to each other, but it does not make sure, that they float relative concentrically to each other.

Because the radial pressure balance is in itself, even when it is perfectly obtained, not stable, but unstable regarding the concentric floating of the rotor and control body relative to each other. But, on the contrary, the rotor and control body can even at the most perfect radial pressure balance move locally relative towards each other, whereby they obtain an eccentricity between their axes. At such eccentric location relative to each other, the radial fluid pressure balance between the rotor and the control body must not in all cases be necessarily disturbed, but can be upheld or even may upheld itself.

In short, the control body may within the radial pressure balance within the hub of the rotor move in all radial directions at free will and obtain any eccentric location relative to the rotor-hub as it pleases the control body. I call this instability of concentric location "lability" and say, that the control body is labile when it is provided between fluid pressures of perfect radial balance in the respective rotor hub.

A not labile, the stabile, location of the control body in the rotor-hub may be better obtained, when the radial pressure balance is not absolutely perfectly provided. Because then the control body would be caused to float in a certain eccentric position in a defined radial direction of the eccentricity.

Thus, my new discoveries are reversing my earlier mentioned patents of the former art and consider an intentionally at least partially eccentric location of the control body within the rotor-hub instead of the concentric location, which was taught in my earlier patents and the Bosch corporation assigned patents of the discussion of the prior art.

Quite understandably I have for a long time hesitated to let the control bodies float at least partially eccentrically in the respective rotor-hub. Because I had twenty years ago intensively studied the Book of Walter Ernst: "Oilhydraulic power and its industrial applications" which was published 1960 at McGraw Hill Book Co. of New York and which is today one of the leading standard books for Oil Hydraulics all over the world and which is also published in the Russian and German languages. In this book it was proven on pages 46 and 47, that the leakage flow through eccentric annular spaces would be 2.5 times higher than through concentric spaces of equal sizes. In more detail the leakage flow would increase parallel to:

$$1+1.5e^2 \tag{4}$$

with e=eccentricity between the respective cylindrical faces. For example of the rotor-hub and of the control body.

From this disclosure of the Ernst book I assumed, that the leakage of the devices with a control body in a rotor's hub would similarily increase, about in the relationship of equation—portion (1) of the book Ernst, when the control body would not float concentricallly to the rotor's hub. Therefore, I prevented or tried to prevent an eccentric location of the control body relative to the rotor-hub. I aimed to obtain the smallest leakage by letting the control body float concentrically within the rotor's hub in order to obtain e=0 and thereby the smallest leakage in accordance with the disclosure of Ernst.

For almost two decades it was unthinkable for me to obtain a decrease of leakage by an eccentric location of the control body. On the contrary I expected an increase in leakage, when the control body would become placed eccentrically within the rotor-hub. The many patents of the former art are showing how intensively I worked to obtain a perfect concentric floating of the control body. The later granted patents of the former art which were assigned to the Bosch company and which are also discussed in the discussion of the former art, seem to indicate, that even those inventors, which later after my inventions, tried to improve my inventions further or to go their own ways to obtain the perfect radial pressure balance, followed by earlier considerations of my earlier patents and followed the rules of Ernst in their attempts to obtain the minimum of leakage by making the control body centrically located in the rotor's hub by an attempted perfect radial pressure balance.

After my discovery, that the perfect radial pressure balance makes the floating and location of the control body in the rotor-hub in accordance with this invention labile and prevents the stability of location, I started to inquire more deeply. For that purpose I divided the annular spaces in the cross-sectional plane thereof into individual smaller spaces of boarderlines starting at the center of the control body, namely in the axis of the control body and departing therefrom radial under equal intervals of angels. Thereby I obtained FIG. 27 of this specification.

Therein I intend to find the radial distance between the outer face 66 of the respective control body and of the respective inner face 67 of the rotor-hub. This distance is "f" in FIG. 27. Distance "f" can however not immediately become calculated. Therefore I wrote FIG. 30—a wherein "O" is the axis of the control body; "P" is the axis of the inner face of the rotor-hub and "e" is the eccentricity therebetween. The radius of the outer face of the control body around "O" is "r" and the radius of the inner face of the rotor's hub around "P" is: "R". Then the distance from the axis of the control body "O" to the inner face of the rotor-hub at the respective angular location of angle "alpha" is: "a"; wherefrom follows, that the desired distance "f" is:

$$F=a-r. \tag{5}$$

Figure 30A:
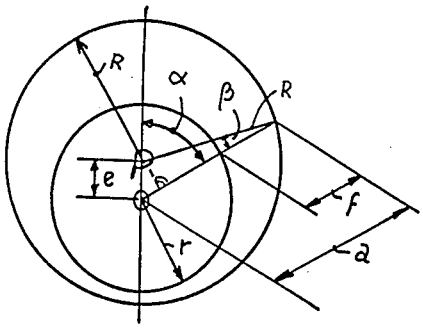
FIG. 30 shows in portions of the Figure schematics of comparisons of portions of the former art with the respective portions of the present invention.

By writing a rectangular line onto "a" in FIG. 30*a* and let it go through "P" in said figure, the angles "alpha" and "beta" are calculable in the triangle with "a", "e"; "R"; "alpha" and "beta". One obtains thereby:

$$a=e\cos\alpha+R\cos\beta \tag{6}$$

wherefrom over a somewhat longer procedure the following equations for "a" can be obtained under the basis of the desired angle "alpha":

$$a=e\cos\alpha+R-(e^4/4R)\cos 2\alpha \tag{7}$$

or:

$$a=e\cos\alpha+R-(e^2/2R)\sin^2\alpha \tag{8}$$

Since "a" is now calcuable, the desired distance "f" will be found by equation (5). The distance "f" is then obtained by equation (9). Equation (9) gives a value "f" equal to the stroke of the vane in my vane-machinery patents, when used between two different rotary angles "alpha". With the mathematics now established, the FIGS. 27 and 28 can be discussed.

Attention is now requested to FIGS. 27 and 28. In these Figures the rotor floats eccentrically relative to the control body. The inner face, rotor face, inner face of the bush or the rotary control face is shown by 66 while 67 presents the outer face or control face of the non-rotary control body for example 5 or 15. The rotor may be 9. Shown the maximum of eccentric position, where on top the clearance "c" is zero and on the bottom equal to 2c. The clearance "c" is commonly also mentioned as "δ".

The right side of FIG. 27 is divided by angles of ten degrees whereby the radial measures "f" of the local dimension of the clearance "c" in radial direction appears. "f" can become calculated by the equation my U.S. Pat. No. 3,320,897. Therefrom "f"=vane stroke in U.S. Pat. No. 3,320,897, is:

$$F=e\cos\alpha-(e^2/2r)\sin^2\alpha \tag{9}$$

with alpha=angle from the zero line through the center. (center and eccenter). And with "e"=eccentricity between the axes of the rotor and of the control body.

It is of some interest here that earlier in this specification it was mentioned that an eccentric clearance has 2.5 times the leakage of the centric clearance. This was taken from "Ernts, Oilhydraulic power and its industrical applications, McGraw-Hill, New York", edition 1960, pages 45–46. Ernst's solution is however not entirely correct, because Ernst neglected the value $(e^2/2R)\sin^2$alpha. R is the diameter of 67.

And, further, the calculation of ERNST does not make sense to the present application. Because in the present application of the invention, the leakage does not flow through the entire clearance, but only through the narrowest clearance, namely through the upper half of FIG. 27. Consequently, the equation to be used for an estimation of the leakage is my equation (9). Then it is to be recognized that the leakage flows with the third power of the radial size "f" of the clearance.

It has, therefore, become established in the table of FIG. 28, what the third powers of "f" are and they are summarized over the upper, the close half, and the bottom half, the wide half of the clearance.

When assuming the centric clearance value to be "1" for comparison, the table of FIG. 12 teaches that the leakage through the wider clearance half is about 5.10 times of that of centric clearance half, while the leakage through the closer half, the top half is about 0.28 of the centric clearance half. Or, in other words, the leakage through the wider clearance half is about 18 times larger than the leakage through the narrower, closer clearance half, when the full maximum of eccentricity is applied.

It will now be easy to understand, that the devices of the former art, for example, my own and those of Bosch, Nonnenmacher, Aldinger, etc., which tended to float the rotor centric to the control body, would have a very disastrous leakage, when the centric floating would become eccentric, because they would have recesses in the wider half of the clearance which are filled with pressure or half pressure of the HP pressure.

In this regard it should also be recognized, as will become apparent later or as already explained, that the centric floating between a radial pressure balance is in itself labile namely unstable.

This shows clearly how important it is that the recesses of the invention must be unloading recesses.

I call them intentionally "unloading recesses, 1,4,11,12, to make it more clear that they are not half pressure or full pressure balancing recesses of the former art. The term "unloading recess" is justified thereby, that the recess ends the loading of the sealing lands with pressure and unloads the ends of the sealing lands "β" etc, endwards of the HP control ports to "zero", or to a pressure of zero, because of the communication of the recesses to the respective space under substantially no pressure or of only very low pressure.

Of further interest for the calculation of the leakage is the value L/B. It is commonly in balanced control bodies of cylindrical configuration about 30 to 200. The flow of leakage is directly proportionate to the value L/B in addition to the viscosity, pressure and the third power of "f".

Using the heretofore used values of the example, we obtain for FIGS. 9 and 10: L=2 times L and B=B, since L appears twice, namely flowing of leakage from H in FIG. 9 to both recesses 11 along the "B"-s in both axial direction. With L=40 and B=4 mm, we obtain:

$$L/B=2L/B=80/4=20$$

which is about two thirds of the lowest respective value of the centric floating radially balanced control bodies of the former art. Thus, the invention has reduced the L/B value roughly to at least the half and the flow through to 28% of the centric floating device, whereby the leakage of the invention is roughly only 19 percent of the centrically floating control bodies or rotors of the former art. When the labile control bodies of the former art with balancing recesses are floating fully eccentrically, their leakage is roughly $0.5\times5.1\times100/14=18$ times higher than in the present invention.

A still more perfect calculation of the relationships is possible by considering portions of FIGS. 25, 26, 29.

"half length of the sealing lands (B) between the high pressure control port and the recesses (11) which must be located partially within the projection of the cylinder walls of the device." (13)

This is thereby an important definition of the invention and mentioned in the claims thereof. When in the above numerical sample, a radial balance shall be present, "B" becomes 8.666 mm and "L" becomes maximally=2R-(pi/2)=40(pi/2)=62.8 mm; wherefrom for ΣL/B follows 125.6/8.66 or L/B=14.5 or roughly the half of the former art L/B values. For eccentric running the length "B" must be somewhat smaller than "$B_{rad.bal.}$".

When the values of measures of the above sample are used, with diamter "D" of referential 51 to be 2 cm or 20 mm; and the axial length of HP control port "H"=13 is 0.8 of the diameter "d"=52 of the rotor passage, the value "B rad.bal." becomes as follows, for different diameters "d":

| diameter "d" = | 0.4 | 0.6 | 0.8 | 1.0 | 1.2 | 1.4 | 1.6 | 1.8 | = cm |
|---|---|---|---|---|---|---|---|---|---|
| B rad. bal. = | 1.35 | 1.19 | 1.03 | 0.87 | 0.71 | 0.59 | 0.39 | 0.23 | = cm |
| L/B = | 9.8 | 11.1 | 12.8 | 15.2 | 18.7 | 22.4 | 34.1 | 58.22 | = factor. |

The measure "Lp" is the projection of the high pressure control port 13 in the Figure. The length of "L", the sealing in axial direction, the arch is according to the Figure:

$$L=2R\pi[90°-\text{jnv.cos.}(0.5\ L/R)]2/360°. \quad (10)$$

In this respect it should be noted, however, that the rotor passages 16,17 may run over the peripherial end of the control port 13. The high pressure may then extend to the maximum of the periphery of the half pressure half of the control body. The projection thereof then is the diameter of the control body, or "2R", in the Figure and shows, that actually the length "L" steadily varies between "Lp" and "2R" at actual running of the device. With temporary a larger length at the right side of the Figure and temporary at the left side of the Figure. The maximum of the projection however is "2R".

Equation (5) may also be written as:

$$A_p=(D^2-d^2)(N/4)=B2R+H2R-d^2(N/4) \quad (11)$$

with 0.4999 simplified to 0.5;
wherefrom the complete radial balance can be obtained by transforming equation (8) to:

$$B_{rad.bal.}=[(D^2-d^2)(N/4)-2RH+d^2(N/4)]/2R \quad (12)$$

Therefrom the above measures sample gives a maximally permissible length of the sealing lands "B" of:

$$B_{rad.-bal.}=[(4-1)(7/4)-2\times2.1\times0.8+1(7/4)]/2\times2.1-=0.866\text{ cm}=8.66\text{ mm}.$$

for 7 cylinders 6.

When this could be written in an actual design, the recesses 1, 11 or like would not enter the radial projection of the cylinder walls, but stay axially of them. It is therefore important in accordance with this present invention, to define the half of the axial length of the sealing lands "B" between the HP control port and the beginning or innermost wall of the respective recess 11 or like. It is this:

wherefrom it is seen that the sealing lands "B" between the respective control port 13 and the recesses 11 are quite exeptionally long, and that the value L/B remains quite small as long as the diameter "d"=52 not becomes too big in relation to the cylinder wall diameter "D"=51.

At the values of the above example, the half length of the sealing lands "B" between the high pressure port 13 and the disloading recesses 11, which is the important characteristic, lies axially of the axis of the respective cylinder at the value 0.835 of the radius of the cylinder wall, which is exactly within the projection of the cyliner wall.

For the radially balanced running the above values apply For the more recommended eccentric running or load in the rotor towards the control body the mentioned half length of the sealing lands "B" will be entered deeper into the projection of the cylinder walls. The half length "B" becomes then closer to the radial axes of the respective cylinders. For a highly applied thrust of the rotor towards the control body, the half length of the sealing lands "B" may become so close to the radial axes of the cylinders, that even the innermost walls of the recesses and thereby portions of the unloading recesses 11, 1, etc., are within the projection of the cylinders or working chambers. From the above sample it is seen, however, that that is not in all cases necessary.

Comparing the above results of the example with the references of centrically floating control bodies with fully or partially pressure loaded recesses in the control body, it is easily seen that the half pressure recesses of the mentioned patents give two leakage flows out of each of the diametrically located recesses. There are at least four additional leakage flows. The flows out of the half pressure control ports can become considered as half flows, because they reduce only to the half pressure. But still then there are remaining two more leakage flows at least than in the present invention. Further, since the control bodies are said to be centric, concentric, the flows are 1/0.28=3.6 times/2=1.8 times bigger than in the present invention. Thereby the high superiority of the invention over the former art is illustrated.

It is remembered now, that, in order to be able to float eccentrically relative to each other, there must be a radially flexible clutch means between the shaft or rotor and control body. Those can be a slotted disc, but the more perfect system is that of FIGS. 23 and 24 of my parental applications or of the Figures of a respective continuation application thereof.

Referring again to FIG. 11, this Figure explains that when the downward trusting force is too high, the rotor face will weld along the line of point "O" on the top of FIG. 11 along the control face or outer face of the control body. In short, faces 66 and 67 will weld at point or line zero in FIG. 11. This shows that good care should be given to dimension the "D" and "d" values and the "B" values in relation to "D" and "d".

To prevent any such welding, FIG. 9, where a single cylinder group 9 is provided with two recesses 11 axially of the port 13, but within the projection of "D", but not within the projection of "d", the bearing lands 57 and 58 are provided axially endwards of the recesses 11. They may be filled with low, medial or higher pressure, for example, by the longitudinal or axial supply recesses 68. These axially extending recesses 68 shall not mainly supply a balancing force, but merely supply fluid into the clearance. The pressure therein can be low. Since the clearance endwards of the recesses 11 is now filled with oil, the running of the inner face of the rotor provides hydrodynamic forces in the clearance which are roughly seen oppositionally directed to the forces acting on the cylinder bottoms. The hydrodynamic forces thereby are assisting the forces out of the HP control port 13 and of the sealing lands "B".

When the rotor revolves slowly, the hydrodynamic forces in the outer sealing lands 57 and 58 are low. Control body and rotor are floating in the most eccentric position, similar almost as in FIG. 11. With increasing rotary speed of the rotor, the hydrodynamic forces in the outer sealing and bearing lands 57 and 58 increase. Thereby the respective balance of forces increases in the direction of letting the rotor depart from the eccentric into a more centric position relative to the control body.

With a proper utilization of this effect by the proper location and dimensioning of the described recesses and diameters, the invention obtains an almost eccentric floating between rotor and control body at the desired speed and the floating becomes stable, without welding of faces 66 and 67 in the top "zero" line of FIG. 11.

The former lability and unstability of the radially balanced devices is thereby prevented, because a bigger eccentricity supplies bigger hydrodynamic forces. The device of the invention thereby acts "selfstabilizing" with regard to the size of the eccentricity. At the same time the leakage is considerably reduced, compared to the devices of the former art.

From the previous discussion of the technology involved it has become apparent that the size of the value "B/L" and the eccentricity "e" are of extremely high influence to the leakage of the machine.

Disregarded in this discussion are the values of those also very important influences which are not depending on the design and principle of the device, as for example, the influence of viscosity, fluid and difference between the diameters of the inner face of the rotor-hub and of the outer face of the control body. It is assumed that the user of the device applies the best suitable fluid and the designer applies the smallest possible clearance or diameter difference between the outer face of the control body and the inner face of the rotor's hub in order to obtain the most efficient device.

The consequences of the considerations of the lability and unstability of the floating of the control body under full radial fluid pressure balance should be overcome by this invention in such a way that a stabilizing mechanism becomes established. This stabilizing mechanism shall be used by this invention to set or locate the control body into a predeterminded position relative to the rotor, and to use the stabilizing mechanism to maintain the location of the the control body relative to the rotor in the set position during the operation of the device. One of such mechanism is already partially discussed, namely the appearance of hydrodynamic fluid pressure actions.

According to this invention there are the following three stabilizing mechanisms possible and applicable:

Stabilizer "a":

A radial thrust field is built up in the respective cylinder (see FIGS. 1 to 6, 25, 26 and 29) and acts in contrary direction against the respective ports or pockets which contain fluid, of the control body. To obtain the desired stability, one of the forces in the sum of the fields, ports, or pockets, must be smaller than the sum of the opposing forces. Care must be taken that this does not lead to welding between faces under too strong a difference between the opposing forces.

Stabilizer "b":

A substantially radially directed thrust chamber is associated with the control body or provided in the control body or rotor while a therein radially moveable thrust member is pressed against a respective face and as a result thereof and of the reaction forces the inner face of the rotor's hub and the outer face of the control body are pressed towards each other for a closer engagement. Care must be taken that the thrust forces not become too high because too strong thrust forces might result in wearing, friction and welding of the mentioned faces on each other.

Stabilizer "c":

Arrangements become provided to create hydrodynamic fluid pressure action at desired places between the inner face of the rotor's hub and the outer face of the control body for the purpose to oppose the forces of stabilizer "a" or of stabilizer "b", whereby a respective relative speed between the mentioned faces will result in a specific rate of eccentricity between the rotor and the control body at each respective speed and pressure. The mentioned rate of eccentricity will be maintained as long as the same speeds and pressures are present. It will return to the same rate, when the speeds and pressures appear again and it will automatically adapt to the respective different rate of eccentricity for other pressures and speeds.

Stabilizer "d":

Arrangements become provided to create "secure areas of faces-portions" between the inner face of the rotor-hub and the outer face of the control body. These are added to the stabilizers "a" or "b". The respective force areas and sizes of the stabilizers "a" or "b" must be suitably dimensioned to correspond to the bearing capability of the applied secure areas of face-portions. This stabilizer will also, as stabilizer "c" does, locate the control body respectively partially eccentrically relative to the rotor depending on the respective pressures. It will regain the respective rate of eccentricity when the same forces and pressures appear again.

In the cases of application of the stabilizers "c" or "d" to stabilizers "a" or "b", no welding will appear between the faces and the friction and wear can remain small and will remain small, when the opposing forces and actions are accordingly dimensioned.

The "secure areas of face-portions" are the contrary of unsafe zones or of unsecure face areas. Such insecure or unsafe areas appear when no hydrodynamic forces act and adjacent faces are too close together. A theory of the secure zones and of the unsafe or insecure zones or areas is given in my U.S. Pat. Nos. 3,951,047; 4,212,230 and in my West German Pat. No. 2,500,779. In these patents the "insecure" zones" are discussed at hand of the outer slide faces of piston shoes of radial piston devices.

Insecure zones are relatively large dimensioned areas or portions of faces. They have the tendency to weld to each other when no hydrodynamic pressure field between them is provided. It is, therefore, required to replace them by "secure face-portions". These are short face portions of mostly 2 to 6 mm width normal to their length and commonly applied as sealing lands around pressure ports, recesses or hydrostatic bearings as sealing lands therearound. They must become restricted in their width to the mentioned average of 2 to 6 mm by respective face-restriction recesses. Otherwise they will be of too large an area, which might lead to welding under lack of fluid at local places.

The difference between hydrodynamically acting faces and secure face portions as well as unsafe portions is not widely known today. For example, in the patent publication DE-OS 2,307,997 of West Germany, corresponding to U.S. Pat. No. 3,948,149; there appear many Figures for all of which hydrodynamic pressure action is claimed. However, the direction of extensions of the faces of the Figures are contradicting each other respective to the direction of movement relative to the complementary faces, where they are sliding along. The consequence thereof is, that the hydrodynamic forces claimed for all of the Figures actually appear only on some of them. On others there appear "unsafe areas" or "insecure zones". At others again there appear areas of "secure zones".

The detailed calculations or empricial data of forces in hydrodynamic action and of forces and appearances in secure zones are extensive technologies, wherefore to give details would exceed this present specification. As far as knowledge about them is desired, the inventor may be accordingly contacted.

In FIG. 30 is also explained what differences in principle and structure are underlying the thrust arrangements of axial piston devices and of the thrust arrangements of the present invenion.

Figure 30B:
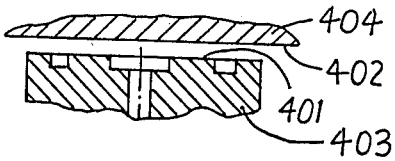
Figure 30C:
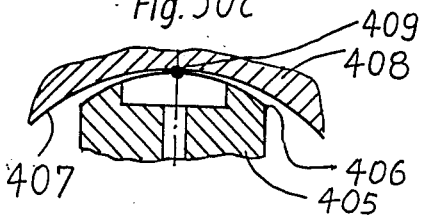
Figure 30D:
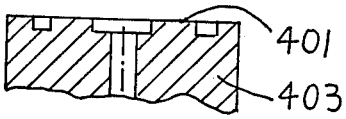

FIG. 30*d* shows a common thrust piston or thrust body of an axial flow device of the former art which was described. Thrust body 403 is characterized by the plane slide face 401.

In FIG. 30*b* is demonstrated that the plane face 401 slides along a plane face 402 of a complementary body 404. It is apparent from it that there are complementary plane faces provided. These are including sealing lands around the fluid pressure pocket(s). The area of contact and sealing is an area of face portions. The size of the face portions defines the bearing capacity of the respective faces 401 and 402.

FIG. 30 shows the part-cylindrical face 406 of a thrust body or control body 405.

In FIG. 30*c* the outer face 406 of control body 405 is shown in a portion of the rotor 408 with rotor-hub inner face 407. Faces 406 and 407 have slightly different diameters, which are shown largely exaggerated in the Figure. When the control body 405 would become thrust against the inner face 407 of the rotor 408 by the means of a thrust body for example 403 of the known axial flow devices, the face 406 would touch the face 407 in line 409. This would lead to welding between the faces in line 409. Especially since those experienced in axial piston devices are accustomed to a rather great bearing capacity due to the face contact or sliding of faces as in FIG. 30*b*. But since in the arrangement of FIG. 30*c* which is related to the invention, a line contact appears instead of a faces sliding, the high thrust of the axial piston device thrust body would immediately lead to friction, wear and an early welding between faces 406 and 407 in line 409 of FIG. 30*c*. The thrust bodies of the axial piston devices can therefore not become applied in the present invention. Another reason, easily understandable, for this is, that the configuration and structure of the thrust bodies of the axial piston devices is unsuitable for application in the invention. FIG. 30*f* shows that the gap 410 would appear, where the pressure fluid would escape and in addition the scratching edges 411 would appear and disturb the inner face 407 of the rotor 408.

The welding of faces 406 and of 407 in line 409 would also appear, when the structure of the invention would become applied, but the technology involved and discussed in this chapter, would be disregarded or not fully obeyed. Especially when the care required to the thrust forces of the stabilizer "b" would not be taken or when none of the stabilizers "c" or "d" would become suitably applied.

Figure 30G:
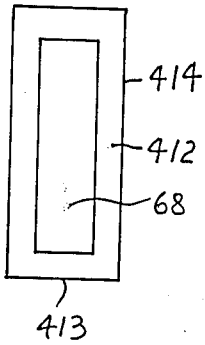
Figure 30E:
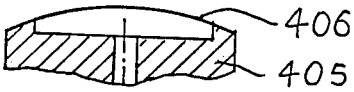
Figure 30F:
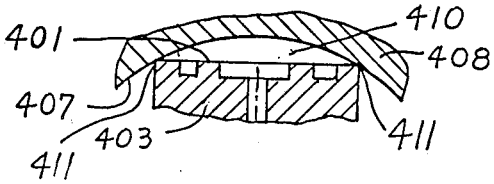

FIG. 30*g* explains that the fluid pressure pocket 68 of the thrust body of the invention, should be sealed by sealing lands, which are forming "secure areas" 412. Because there is commonly no space available to apply hydrodynamic pressure actions. And further, hydrodynamic actions would overlay the sealing land actions and thereby become difficult in calculation and definition. The sealing lands must be short as defined in the theory of the secure areas normally to the ends of the pocket 68. It is further preferred to make the thrust bodies of the invention long in the direction of relative movement of the inner faces and outer faces of rotors and of control bodies relative to each other. That prevents angular dislocation of the thrust bodies. The longer side in the direction of said movement is shown by 414. The shorter side normal thereto is demonstrated by 413. The sealing lands 412 should never become wider than the 2 to 6 mm of the theory of the secure zones in usual application. Otherwise they might tend to wear and weld.

DESCRIPTION OF THE FURTHER PREFERRED EMBODIMENTS

FIGS. 25 to 26 with the explanatory FIG. 29 are describing an embodiment related to and somewhat similar to FIGS. 1 to 6. However, in FIGS. 25 and 26 there is a single cylinder group machine discussed instead of the multiple cylinder group device of FIGS. 1 to 6. Further, in FIGS. 25 and 26 there are outer hydrodynamic bearing areas provided, shown by 57 and 58, in order to explain how the mentioned stabilizer(s) "c" may be added to the stabilizer(s) "a".

FIGS. 25 to 26 and 29 are not taken from the parental application, but added in this continuation in part application for the specific explanation of the combination of stabilizers "a" and "c". The detailed discussion of leakages in the device of these Figures by the employment of plural stabilizers "c" is also provided to make it possible to add the stabilizer "c" to other embodiments or Figures of the invention, if so desired. The stabilizers "c" in these Figures are the hydrodynamic bearing area portions 57 and 58, whereto the fluid supply recesses 68 may be added.

Viewing FIGS. 25 and 29 it will be found, that, when the wall 51 and the wall of the rotor passage 52 are radially inwardly extended by imagination, they would form the radial projection of these walls onto the outer face of the control body. The circles 51 and 52 are thereby the projections of the walls 51 and 52 of the respective cylinder 6 and passage 16 onto the outer face of the control body. The area between the circles 51 and 52 is the bottom of the respective cylinder, or cylinder bottom, as occasionally cited in the application or in the specification.

When a single cylinder is considered, upwards of the controlbody center-line, the entire cylinder bottom is loaded with pressure, which tends to press the rotor 9 down to the control body. With $P=\text{force}=(D^2-d^2)\text{-}(pi/4)\times p$ with p=pressure per area, for example, lbs or $Kg/cm^2$. "D" is the diameter of wall or projection 51, while "d" is the diameter of the wall or projection 52. The area within 52 is not acting on the rotor, because it is a bore, filled with fluid.

Contrary directed is the force of fluid onto the rotor out of control port 13 in FIGS. 25, 26, 29 and the force of fluid in the clearance along the sealing lands between port 13 and recesses 11. Thereby the upwards directed area of fluid force in FIG. 29 is length 61 of port 13×breath H of port 13 minus the area of bore 16. Thereby the upwards contrary against the rotor directed force-area of high pressure is $Ahp=\mathbf{61}\times H-d^2\text{-}(pi/4)$ with d=diameter of 52. The area of the sealing lands is length 61 (because smaller diameter), see FIG. 10, and thereby shorter than 60 with radius 62 in FIG. 10)×2B. Since the pressure along the sealing lands B in FIG. 9 drops gradually from the maximum of pressure at port 13 to zero pressure in the disloading recesses 11, the medial pressure in the sealing lands would roughly be the half of the high pressure in port 13. Roughly shall mean here, that the actual pressure will not at all times exactly be the half of the pressure in high pressure port 13. Because the pressure gradient is also influenced by heating up of fluid in the clearance. For a simplified calculation, however, the pressure in the sealing lands B will be assumed to be the half of the high pressure in port 13. Then the sealing lands are becoming the high-pressure equivalent area $Ahpcl=B\times\mathbf{61}$. The sum of the upwards against the rotor directed force has now the total area of Ahp plus $Ahpcl=\mathbf{61}\times H-d^2\text{-}(pi/4)+B\times\mathbf{61}$.

For example, let D=diameter of 51 be 20 mm and d=diameter of 52 be 10 mm; H be 8 mm and B be 4 mm, we are getting, when the HP pressure is 100 Kg per cm sqaure, when 61 is M=16 mm:

$$F=(D^2-d^2)(\pi/4)P-[M\times H-d^2(\pi/4)+B\times M]P=\text{-Kg; when measures are in cm.} \quad (14)$$

or; with the values of the above example:

$$F=(2^2-1^2)0.7854\cdot 100-[1.6\times 0.8-1^2\times 0.7854+0.4\text{-}\times 1.6]100=106{,}16\ \text{KG.}$$

With F=Kg=the sum of the forces or the resultant of the components of forces. The downwardly towards the control body directed forces are positive and the contrary directed, upwards against the rotor, directed forces are negative in the equation. The downward acting area is in the example=2.3562 $cm^2$ and the contrary directed, upwards acting area is 1.2946 $cm^2$ or the downwardly acting resultant area is: 1.0616 $cm^2$ in the example of the calculation.

Heretofore a single cylinder was discussed. Now is will become explained at hand of the explanatory FIGS. 25 and 26, that the actual actions are the control body 5 or 15 has the outer periphery of diameter×pi. In the high pressure half of the control body and rotor the high pressure is however acting only on the half of the periphery, namely along 64 of FIG. 26. This length of the high pressure arch is obviously not diamter×pi, but just approximately the half of it, namely diamter×0.5 pi. On the other hand, the number of cylinders 6,7 in the half pressure half of the rotor may be N.

The action of the control clearance and of the cylinders is now not any more a single action, but only the upward and downward directed components of the forces are action. The high pressure control port 13 has now, see FIG. 26, the length "L"is the upwards projection. And the downward projection of the cylinders is now (1/0.5 pi)×N. With (1/0.5 pi)=0.6366.

Since for the pressing of the rotor towards the control body or vice versa only the upward or downward projections are the acting areas, the downward directed force out of the cylinders is now $Fdownwards=(D^2-d^2)(pi/4)\times p\times 0.6366\times N$. With (pi/4)=0.7854. The upwards directed force is, when the closing arc areas around the inner and outer dead points are neglected, $Fupwards=L\times(H+B)-d^2\text{-}(pi/4)\times 0.6366\times p$. The total acting projected areas and forces are now:

$$Ap=N(D^2-d^2)(\pi/4)0.6366-L(H+B)-d^2(\pi/4)0.6\text{-}366=cm^2\ \text{with measures in cm;}$$

or;

$$Ap=N(D^2-d^2)0.4999-L(H+B)0.4999=cm^2\ \text{with}\ (1/\tfrac{1}{2}\pi)\pi/4=0.4999; \quad (15)$$

and $$Fp=[N(D^2-d^2)-L(H+B)]0.4999p=\text{KG with cm and Kg/cm}^2. \quad (16)$$

Using L=32 mm=3.2 cm from FIG. 26 and the measures of the earlier calculated sample of a single cylinder, we obtain the following sample:

$$Fp=[3(4-1)-3.2(0.8+0.4)]49.99=[9-3.84]49.99\text{-}=258\ \text{KG.}$$

with which the rotor is pressed at these measures and pressure towards the control body.

It should be recognized here, that the invention works only when the unloading recesses can be set into the D-d projection. Otherwise, when the d-diameters of 52 are becoming too big in relation to the D-51 diameters, the invention fails and the thrust bodies of my parental application or of this present application must be set.

While the combination of stabilizer "a" with stabilizer "c", which was extensively explained in FIGS. 25, 26 and 29 is not claimed in this present patent application, but in my mentioned co-pending patent application Ser. No. 228,484, the description thereof has shown which very important and considerable influences are appearing from the rate of eccentricity between the faces of the rotor and of the control port as well as of the lengthes "B" of the sealing lands and also of the lengthes 57,58 of the hydrodynamic bearing portions of the stabilizer "c".

It is also apparent from the discussion of the stabilizer a, that there are limitations in dimensions to its application. For example, for high pressure pumps with small rpm the difference between the diameters d and D, shown as 51 and 52 in FIGS. 2 25, 26, 29 may be relatively large. The effect of the stabilizer a can then be great. If however low pressure devices with high rpm would be considered, no such big difference between d and D, 51 and 52, can be allowed, because too small a diameter of d=52 would cause too big an acceleration of flow in this flow restriction and thereby cause too great a friction loss in fluid, whereby the efficiency of such device would become reduced.

In the cases of cylinders with equal diameters to the cylinder entrances and exits, as for example in FIGS. 7 to 10 and 14 to 18, an application of the stabilizer "a" is not possible at all, if no means are added to the cylinders, rotors or control bodies.

The mentioned limitations of the application of the stabilizer "a" demonstrates how important the application of the stabilizer "b" of the present invention actually is. Especially, since application of stabilizer "b" of this invention permits any desired axial length of the rotor and of the control body. The application of stabilizer "b" of the present invention also permits the application of long hydraodynamic stabilizers "c" in combination with stabilizer "b". The invention thereby permits, when it combines stabilizer "b" of the invention with stabilizer "c" of the invention very highly effective devices with very small leakage even at very high pressures. For very high pressures in the devices the FIGS. 7 to 18 may therefore add long hydrodynamic stabilizers "c", as such of FIGS. 25, 26, portions 57,58 in suitable matter and location to the disclosure in FIGS. 7 to 18. The same may be done in FIGS. 31 to 37.

The discussion of stabilizer "c" explanes now in retrospect, why my elder patents had mostly almost centric floating, but rarely the disastrous effects of excessive leakages from supposed eccentric floating of the control body in the rotor's hub. It was because my elder patents employed rather long sealing lands "B" as those in FIGS. 25 and 26, but longer sealing lands "B" than shown in FIG. 25. Thereby these sealing lands in my earlier patents are actually of ten excercised an effect of stabilizer "c" in addition to their sealing purposes. In the patents, discussed in the discussion of the former art, which were assigned to Bosch, such long sealing lands "B" are missed.

Figure 31:
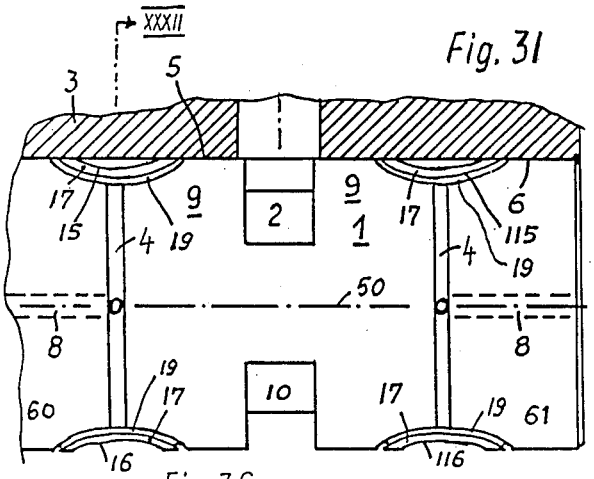
FIG. 31 shows partially in longitudinal sectional view and partially in a view onto the control body of a portion of a rotor and of a control body of a still further embodiment of the invention.
Figure 32:
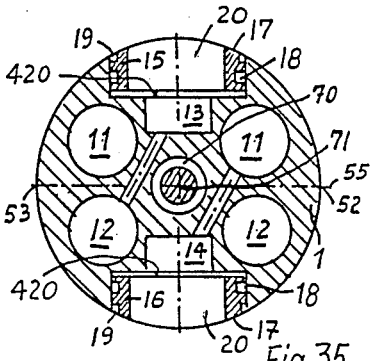
FIG. 32 is a cross-sectional view through FIG. 31 along the line XXXII—XXXII.
Figure 36:
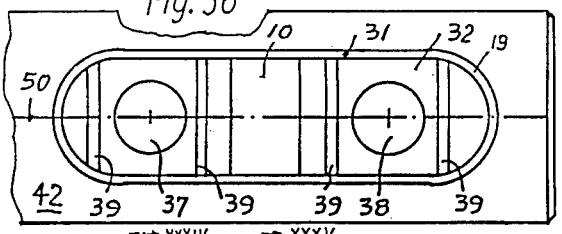
FIG. 36 is a view onto FIG. 33 from bottom along arrow XXXVI.
Figure 35:
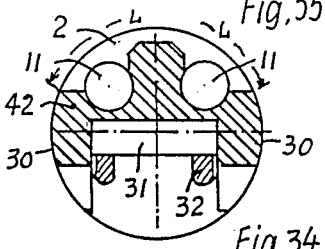
FIG. 35 is a cross-sectional view through FIG. 33 along the line XXXV—XXXV.
Figure 33:
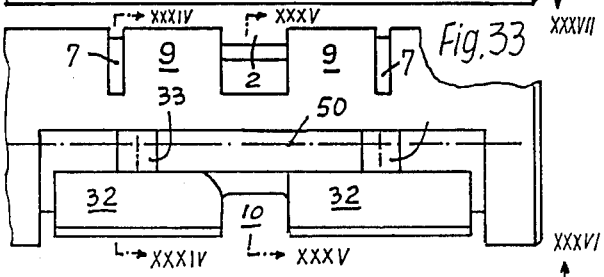
FIG. 33 is a view onto a portion of an other embodiment of a control body of the invention.

In the further embodiment of the invention, shown in FIGS. 31 and 32, cylindrical thrust chambers 420 with substantially radial axes are provided in control body 1. Radially moveable therein along the mentioned axes of the thrust chambers 420 are the thrust bodies 16 applied. It is preferred, that they have fluid pressure recesses 20 for lubrication of the sealing lands 17. The sealing lands 17 are forming the outer seal faces and they are formed with a radius corresponding to the radius of the inner diameter of the rotor-hub's inner face. Seal seats with seals, 18, may be provided in the thrust bodies or in the control body to seal between thrust bodies 15 or 16 and the control body 1 to prevent escape of leakage out of the respective thrust chamber 420. Each one thrust chamber is laterally spaced from the respective control port 2 or 10 of the control body, whereby a pair of thrust chambers is acting together with a respective control port. The thrust chambers which contain thrust bodies 15 are associated to control port 10 and they are communicated by respective passages to fluid lines 12 in control body 1. The thrust chambers, which contain the thrust bodies 16 are associated to the control port 2 and they are communicated by respective passages to the fluid lines 11 of control body 1.

In order to obtain the radial thrust desired, the thrust bodies 15 and 16 have outer outcuts 19, which restrict the diameters of the sealing lands 17 of the thrust bodies to a diameter smaller than the diameter of the respective thrust chamber 420. This assures a thrust in radial direction onto the thrust bodies out of the respective thrust chamber. In several actual applications however, the outcuts 19 could be left away, because there should commonly be a pressure gradient along the sealing lands 17, which gives a medial pressure along them, which would be smaller than the pressure in the thrust chamber 420 so that a radially outwardly directed thrust would anyhow appear on the respective trust bodies 15 or 16.

Still is is preferred to set the outcuts 19, because they have the additional purpose or may have the additional purpose of acting as unloading recess(es). For that purpose they will be communicated to the unloading recesses 4 which in turn will be communicated to spaces under no or low pressure, for example to the interior of the housing of the device by respective passages 8. Long sealing lands are thereby possible between the recesses 4 for sealing the control ports 2 and 10. The diameters of the thrust chambers are made accordingly bigger or smaller depending on the sizes of the control ports and of their sealing lands on control body 1. Axially for example exterior of the recesses 4 can then hydrodynamic bearing portions become provided as stabilizers c. For their lengths which in combination with the viscosity in fluid and the relative velocity of movement between the faces of the control body and of the rotor define the bearing capacity of the bearing lands of stabilizer c.

Thrust body 15 is laterally in one axial direction of control body 2 provided and thrust body 115 in the opposite axial direction thereof. Similarily thrust body 16 is located in one axial direction laterally of control port 10 and thrust body 116 in the other axial direction ther A specific feature of the arrangement of FIGS. 31 and 32 is that the cylindrical thrust chambers and thrust bodies can be easily and precisely machined. Further, all leakages out of thrust chambers except those along the sealing lands 17 can become prevented fully. Outcuts 19 define clear unloading situations and make clear calculations and definite actions of the sealing lands and of the stabilizers "c" possible.

Shown is also that the control body 1 may have an axially extending bore 70 for the extension of a shaft 71 therethrough. Both may extend through the entire length of control body 1 and also through the entire length of the pump or motor if so desired.

The still further embodiment of the invention, which is demonstrated in FIGS. 33 to 37 is preferred for pumps or motors or motors with a single rotary direction. This permits simplifications in manufacturing and even if may spare a low pressure fluid passage in the control body.

Control body 42 has the cylindrical outer face 30 around its axis 50 and control port 2, wherein the delivery fluid lines or high pressure fluid lines 11 port. Laterally of control port 2 are the disloading recesses 4 provided which communicate through passages 8 with a space under low or under no pressure. Between the recesses 4 and the control port 2 are the sealing lands 9 provided to seal the control port 2. These sealing lands 9 are rather axially long in these Figures to provide an effective seal with a very low "L/B" value. It is only "6" at the relation of the Figures. The length "L" is shown by "L" in FIG. 35, while the width "B" corresponds to the axial measure 9 in FIGS. 33 and 37.

Axially exterior to the unloading recesses 4 are the hydrodynamic stabilizers "c" provided and shown by 99. Occasionally the exterior or outer stabilizers "c" or "c"-stabilizers 99 are spared and not provided because the long axial length or width "B" of sealing lands 9 are also providing a "c"-stabilizer in addition to their sealing action. Both effects are overlaying there, the sealing and the "c"-stabilizing.

For simplicity of manufacturing, the bottom portion of the control body 42 of the Figures shows the large the large outcut 31. This is acting at the same time in these Figures as the low pressure passage or fluid line to the low pressure port 10. Low pressure port may however even be eliminated, because the entire outcut 10 may act as a free room to lead the low pressure fluid into or out of the respective working chamber group(s) of the rotor. The trust body 32, which may also be a single one or a plurality of thrust bodies, but is a single one in the Figures, is substantially radially movably provided in the outcut 31. It is not in all cases required, to fit closely in outcut 31. In the Figures space is shown between the walls of output 31 and thrust body 3. This is preferred for simplicity of machining and for low cost of the product. The thrust body 3 may even be roughly casted. Thrust body 32 has an outer slide and seal face 17 which forms sealing lands 17 around fluid pocket(s) 37 and is of complementary configuration relative to the inner face of the respective hub of the rotor, whereby it has a respective constant radius around the control body axis 50. The outcuts or unloading recesses 19 may be provided for similar action as in FIGS. 31 and 32 if so desired. They may however also be obtained by a respective clearance between the thrust body and the wall(s) of the outcut 31 as demonstrated in FIGS. 33 and 36.

Figure 34:
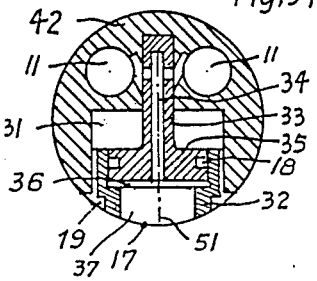
FIG. 34 is a cross-sectional view through FIG. 33 along the line XXXIV—XXXIV.
Figure 37:
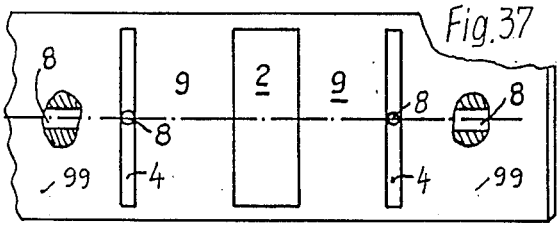
FIG. 37 is a view onto FIG. 33 from top along the arrow XXXVII.

A respective thrust chamber, two of it in the Figures, is (are) shown by 36 and visible in FIG. 34. The respective thrust chamber(s) 36 is (are) formed between the thrust body 32 and the insert(s) 35. The insert 35 extends from thrust body 32, whereon or wherein it seals, for example by seal space 18 with radial movability between thrust body 32 and insert 35, through outcut 31 with extension 33 into control-body 42, wherein it is communicated by passage(s) 34 to the fluid lines 11 of control body 42. fluid and the pressure therein is thereby led from pressure fluid lines 11 through passage(s) 34 into the thrust chamber(s) 36 and may further enter the pocket(s) 37. The pressure in the thrust chamber(s) 36 tends to press the insert 35 and the thrust body 32 away from each other, whereby the thrust body 32 is substantially radially directed pressed against the respective portion of the inner face of the respective rotor-hub and the reaction force thereof is thereby pressing the high pressure half with control port 2 and sealing lands 9 as well as disloading recesses 4 against the respective diametric portion of the inner face of the rotor's hub to effectively seal therealong. The cross-sectional areas of the means provided must be suitably dimensioned in accordance with the technologies of this invention involved, in order to obtain the maxim of efficiency and reliability of the device.

To use the invention care should be taken not to mix the embodiments of the invention up with the former art or with errors of the former art. Specifically, it is important, that all gaps at places which would provide leakage are properly closed by the design. The embodiments of the former art whiche make unstability possible are to be prevented. The details of the embodiments of the invention must be obeyed. For example, the thrust chamber and thrust body of FIGS. 7 to 13 and 38 must have the plane parallel end faces 471 on the slots or thrust chambers and the thrust bodies also must have the therein fitting and sealing end faces 371. The thrust chamber must in some of these Figures form a cylindrical portion and a slot with the walls or end faces of the slot normal to the axis of the control body and parallel to each other. The bottom of the slot and the bottom of the thrust member should be substantially parallel. The thrust member 20 of FIGS. 7 and 8 must have a portion of substantially cylindrical cross sectional configuration and a portion of substantially rectangular cross sectional configuration to fit in the respective thrust chamber and to seal therein. All gaps should be set at places where they can not cause leckage flows out of the device and also not out of the cylinders or workingc chambers of the device.

If the rules of the technology involved are obeyed, one or more of the embodiments described may be combined with more or others of this specification or with embodiments of my co-pending applications or with respective devices of the former art.

The rotor and the control body of the respective embodiments are bodies. For them the superior term "bodies" may be used at their description or definition to include them both.

FURTHER SCHEMATIC DETAILED DESCRIPTION OF THE TECHNOLOGIES WHICH ARE INVOLVED IN THIS INVENTION

In the explanatory FIGS. 39 to 43 it is still more in detail explained what effects appear in the clearance between the rotor 39 and the control body 27 if the control body is eccentrically displaced respective to the rotor 39. Each of these Figures is divided by the point—dotted lines into four sections. These sections are the right upper section, the right bottom section, the left bottom section and the left upper section. In these Figures only the right side sections thereof will be discussed regarding the leakage through the clearance. The right upper and bottom sections correspond in principle either to the right upper portion of FIG. 27 or to the right bottom portion of FIG. 27 and thereby either to the right half of the calculation FIG. 28 or to the left half of calculation FIG. 28.

Figure 39:
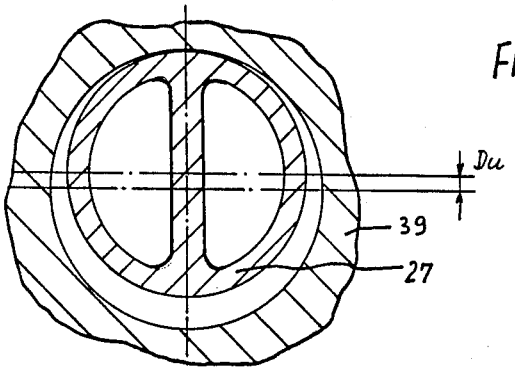
FIGS. 39 to 43 are cross sectional views through control bodies and portions of rotors to explain the actions of concentric and eccentric locations and their results.

In FIG. 39 the control body 27 has no control port and is eccentrically located upwards respective to the rotor by which it is upwardly displaced by the distance "Du" upwards respective to the concentric axis of the rotor 39. In each of FIGS. 39 to 43 except in FIG. 41, the control body is displaced into the maximally possible eccentric position relative to the axis of the rotor 39. This maximally possible eccentric position is obtained when a line of the outer face of the control body meets a line of the inner face of the rotor when the inner face of the rotor is the border face of the rotor's concentric hub.

The right upper portion of FIG. 39 now corresponds regarding the comparison factor "$F^3$" to the left side of FIG. 28 and the right bottom portion of FIG. 39 corresponds to the right side of FIG. 28 regarding the mentioned comparison factor of the third power of the radial distance "f" between the control body and the rotor. The in FIG. 28 obtained medial factors 0.28 and 5.10 are now to be added and then the sum is to be divided by 2 because 2 sections were considered. One obtains: $(0.28+5.10)/2=2.69$. This value is very close to the 2.5 value for flow through eccentric clearances which is given in the mentioned book of Ernst. In calculation FIG. 28 only 10 intervals were considered. If a great number of intervals would become considered very accurately, the result would become exactly 2.5, as in the mentioned book of Walter Ernst. Thus, the obove explanation confirms at hand of applicant's equation for the calculation of the radial distance "f" that Ernst's calculation is correct for FIG. 39. This is so, because in FIG. 39 the control body has no control port. The flow through the eccentric clearance would now just be as the flow along an eccentric piston in a cylinder.

Figure 40:
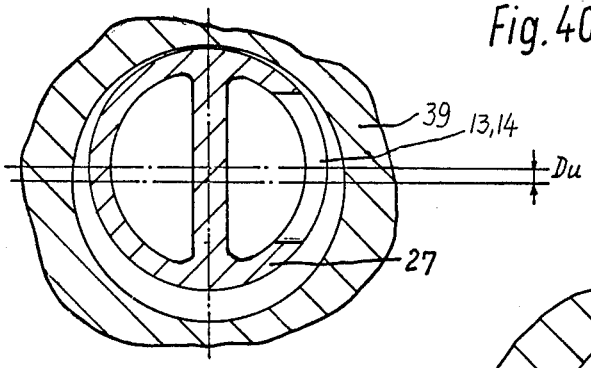

In FIG. 40 the control body 27 is moved upwards by the distance "Du" as in FIG. 39. However, in FIG. 40 the control body 27 has a control port 13 or 14. It is to be noted that in FIG. 40 the control body is not moved to the right or left but only straight upwards. The leakage out of the control port 13,14 will now have the leakage comparison factor third power of "f"=2.5 (or 2.69) as in FIG. 39 because the control body 27 is not moved to the right or left.

Figure 41:
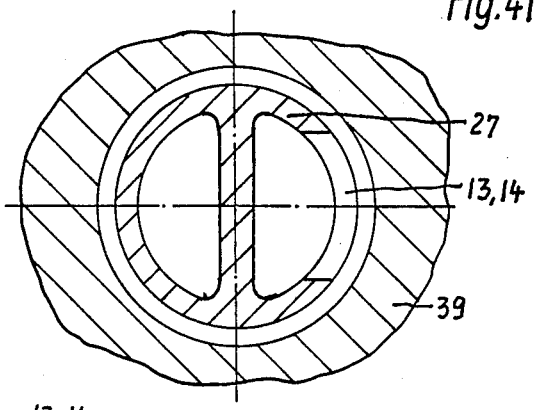

FIG. 41 shows the control body in the concentric location respective to the rotor 39. The axes of the rotor and of the control body now coincide. The leakage comparison factor of the third power of "f" must be and is now "1" because no eccentricity is present between the control body and the rotor. The forces in the clearance between the control body and the rotor would, however, force the control body leftwards respective to the rotor. To prevent such leftward movement of the control body in the rotor's hub, the patents of the former art, including those of the sixties of the inventor of the present invention, therefore, applied axially offset respective to the control port 13,14 the fluid pressure balancing recesses in the diametrically opposite half, the left half, of the control body 27. That counter balanced the forces of pressure in the clearance on the right portion of FIG. 41. At low RPM or at constant speed of the rotor with constant RPM the concentric location of the control body in the rotor was maintained as shown in FIG. 41. At variable speeds, however, the "out runners" appeared at the testings of 1966 and 1967 and in later years the leakage increased drastically over the value 2.5 of the comparison factor with higher speeds of the rotor relative to the control body. The present invention now supplies and theory that at the location of the control body relative to the rotor, the mentioned "outrunners" are not exactly out runners but have a definite reason therein that the balancing of the control body by fluid pressure fields in the rotor is not stable but labile. Slight changes of speeds or other influences can change the temperatures in the fluid in the clearance and disturb slightly the pressure balance in the clearance's diametrically opposed halves. If that appears then the control body would create such an "out runner" of the testing data and obtain (in extreme case) the location of FIG. 42.

Figure 42:
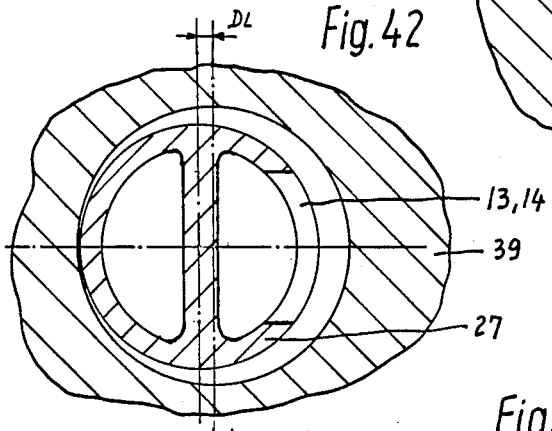

In FIG. 42 the control body is moved leftward by the distance "D1" respective to the concentric axis of the rotor. The upper right half of the Figure now has the comparison factor of the right side of FIG. 28, namely: 5.10. The right bottom portion is symmetric to the right upper portion and has, consequently, in FIG. 42 also the leakage comparison factor 5.10 of FIG. 28. The sum of both right side portions now amount to comparison factor 5.10 plus $5.10=10.20$ which is for the entirety to be divided by 2 and gives then again 5.10 for the entirety of the right side clearance in FIG. 42.

Figure 43:
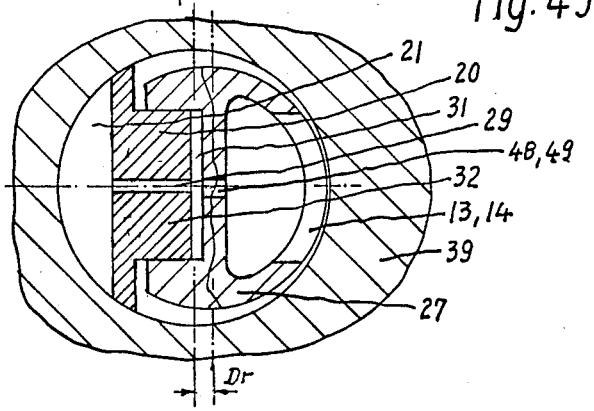

In FIG. 43 now the thrust chamber and the thrust body of FIGS. 7 and 8 is applied. The non-straight cutting line in FIG. 43 indicates and defines that the axially offset thrust arrangement in the left portion of the Figure is written axially not offset in this Figure in order to show the interaction between the control port 13,14 and the thrust arrangement 20,21,31,32,29,48,49 in the plane of the sheet of paper whereon the Figure is written. The cross sectional area of the clearance on the left side of the thrust member (body) 20 is here written slightly larger than the clearance around the control port 13,14. That results therein, that the pressure in the fluid in the control port 13,14 moves through passage 48,49 into the thrust chamber 31 to press the thrust body 20 leftward. The pressure moves from thrust chamber 31 through the further passage 29 through the thrust body into the fluid pressure pocket 21 of the thrust body. This is, as explained also in the mentioned other respective Figures of this patent application. The dimensioning of the thrust body, the thrust chamber, the pocket 21 and the sealing land thereof is now so defined that by the cross sectional areas through the respective pressures in the neighborhoods of port 13,14, compared to the thrust chamber 31 and the pocket 21 with its sealing land, appears a slightly higher force of fluid on the left side of the control body 27 relative to the right side of it. As a result, the control body is moved by the distance "Dr" to the right in FIG. 43 relative to the concentric axis of the rotor 39. The upper right portion of the clearance between the control body 27 and the rotor 39 now corresponds to the left half of FIG. 28 with the comparison factor of the third power of the radial distance "f" between the control body and the rotor of the value 0.28. The bottom right portion of this Figure is symmetric to the upper right portion by which the comparison factor is also 0.28 at the bottom right portion of this Figure. That amounts to 0.28 plus $0.28=0.56$ divided by two for the entirety of the right side portion of this Figure to bring for it the comparison factor: "0.28". The location of the control body is now not labile or unstable any more because the force on the left side is not in oppositional balance to the right side of the Figure, but is stronger on the left side. The stability of this arrangement can not become disturbed by "out runners" because the oppositional diametrical balance of fluid pressures is prevented and replaced by a higher force on the left side compared to that on the right side.

With this discovery by the present invention, it is given into the hands of the engineer who follows the fules which are given by this present invention, to define at his predetermined will to either have a leakage factor 1, 2.5, 5.10, 0.28 or any value therebetween. The invention makes it thereby possible to influence the leakage in a ratio from 5.10 down to 0.28, or in other words, by 5.10/0.28=18.21 times.

DESCRIPTION OF THE PREFERRED EMBODIMENT AND ITS ACTUAL DESIGN

Figure 44:
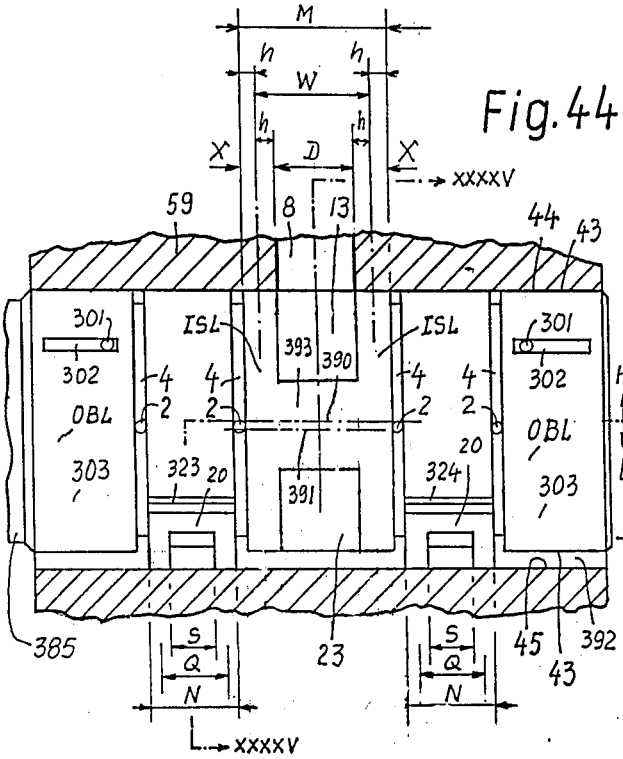
FIG. 44 is a longitudinal sectional view through a rotor with a therein provided control body arrangement of the invention, showing the control body in a view from the outside.
Figure 45:
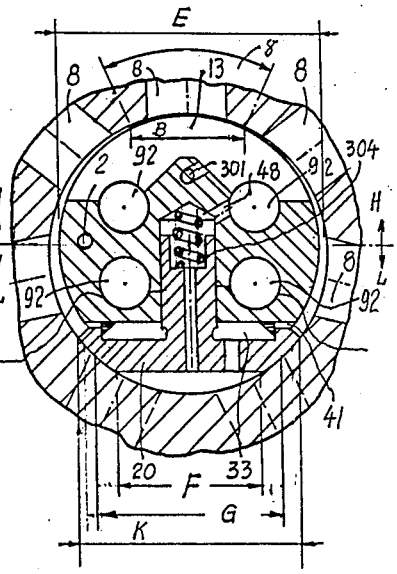
FIG. 45 is a cross sectional view through FIG. 44 along the arrowed line XXXXV—XXXXV through FIG. 44.
Figure 46:
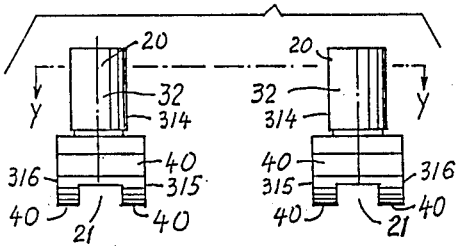
FIG. 46 shows the thrust bodies of FIG. 44 seen separatedly from outside.
Figure 47:
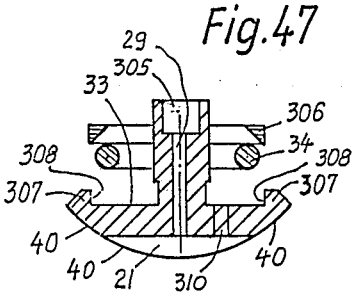
FIG. 47 shows the thrust member of FIG. 45 separately in sectional view.
Figure 48:
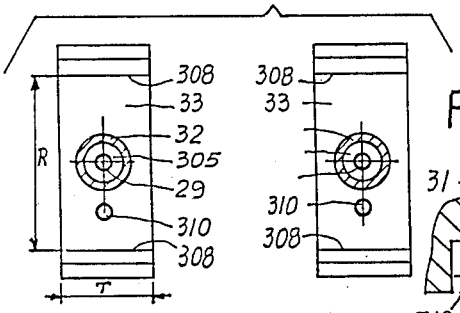
FIG. 48 is a sectional view through FIG. 46 along the arrowed line Y—Y.
Figure 50:
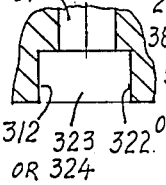
FIG. 50 is a longitudinal sectional view through a portion of the control body of FIG. 44.
Figure 49:
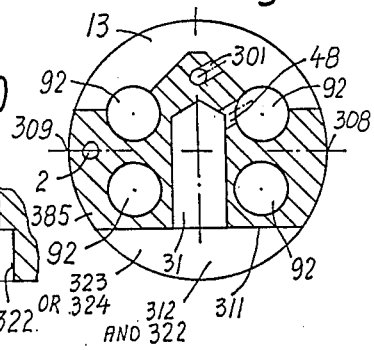
FIG. 49 shows the cross section of the control body of FIG. 45 separately shown.

To make it possible for the person skilled in the art to actually design the embodiments of the invention, the basic FIG. 7 is repeated partially in FIG. 44. Since for the actual design a good detailed knowledge of a single cylinder group is required. FIG. 44 shows only one single cylinder group whereof one cylinder 8 is visible in the Figure. FIG. 45 is the cross sectional view through FIG. 44, namely in the upper portion through the control port and in the bottom portion through the sealing body arrangement. Thereby FIG. 45 is the cross sectional view through FIG. 44 along the point-dotted and arrowed line XXXXV—XXXXV. In these Figures the rotor 59 is shown running eccentrically relative to the control body or control pintle 385. Thereby the axis 391 of the rotor 59 is eccentrically distanced from the axis 391 of the control body 385. Consequently, since the rotor is shown running fully eccentrically, the inner face 45 of the rotor (diameter of the inner face of the rotor's hub) meets the cylindrical outer face 43 of the control body 385 in line 44 in the upper portion of the Figures, while a wide clearance 392 between the mentioned faces 43 and 45 appears on the bottom portion of the Figure and is shown in drastically enlarged scale in order to make the actually very small clearance visible in the Figures. The control body is provided with two spaces 323,324 for the insertion of the thrust members of FIGS. 7 and 8. The spaces and thrust members differ from those of FIGS. 7, 8 only in their dimensions. One of the chambers with a thrust member therein is located leftward of the control port area and the other rightward, while both are equally distanced from the center face through the control port area. The details of the thrust chambers and of the thrust body will become discussed at hand of FIGS. 46 to 50 which show details thereof, while FIG. 45 belongs to the present discussion of FIG. 44. These Figures apply for a one rotary directional device in these Figures with no thrust arrangements for the other rotary direction in the opposite half of the control body. Further, FIG. 44 illustrates that the control body in it has three different action portions. The medial portion is the control port portion with the control arc(s) 393 and the inner sealing lands "ISL". The inner sealing lands seal the control ports in axial direction. The control arcs separate the high pressure control port 13 from the low pressure control port 23 on the opposite half of the control body and seal between the control ports in peripherial direction. The term "sealing" means, that they seal as far as possible but that they do not prevent unavoidable leakage through narrow clearances. The term "arc" means the bend portions of the cylindrical faces, which do the separation between the control ports. "Arc" comes from latin and is internationally used. Partially, and also in other applications, the term "arch" instead of "arc" is used, because it was temporarly so demanded in the past. This medial or control portion is in axial direction ended by the unloading recesses 4 axially endwards of the sealing lands. Axially of the medial control portion are the sealing arrangement portions provided and they contain the thrust arrangement of the invention which secure the eccentric running of the rotor relative to the control body. The inner axial ends of the sealing arrangement portions are thereby given by the axially inner unloading recesses 4. The axial outer ends of the sealing arrangement portions are given by the axial outer unloading recesses 4 axially endwards of the sealing arrangement portions. The sealing arrangement portions have no referential numbers because they can be determined by the therein visible thrust chambers 323 and 324 with the therein provided thrust members 20. The mentioned inner and outer unloading recesses 4 are communicated by an unloading passage 2 to a space of substantial no or low pressure in the device, for example, to the interior of the housing of the respective pump or motor. Axially endwards of the axially outer unloading recesses 4 are in the Figure the bearing lands "OBL" provided. They can be spared or left away if the medial portion and the seal arrangement portions provide enough secure bearing of the rotor for uninclined running of the rotor relative to the control body or control pintle. Accurate and secure running means, that the axes 390 and 391 of the control body and of the rotor shall at all times remain parallel relative to each other. This is naturally more secured if the outer bearing lands are provided. The inner sealing lands and the outer bearing lands have no referential numbers because of their very different functions and purposes they are defined by the abbreviation letters to show the different purposes and functions more visible in the Figure. If the outer bearing portions are provided they require a supply of fluid into them because otherwise they would run dry and weld because the unloading recesses prevent a forced fluid supply. The actual lubrication fluid supply is thereby done by passages 301 from a space under pressure in the fluid into axially extending slots 302. The unloading recesses 4 are provided in order to prevent that fluid or other actions from one of the portions disturbs the functions of the other portions of the arrangement, because the invention is a delicate arrangement which can properly function only if all details are obeyed and if disturbing influences from neighboring portions are prevented. The basics of these technologies are already described at hand of the other Figures but the presently discussed Figures give all the important geometric and mathematical details. For this purpose FIG. 45 defines an angle "gamma" which goes from the respective axis through the medials between adjacent rotor passages (cylinders) of the respective face portion of the inner face of the rotor (rotor's hub). The meetings of the faces (shanks) of angle "gamma" with the inner face of the rotor then define a length "B" which is calculable by "R 2sin gamma" if "R" is the half of the diameter of the inner face 45 of the rotor. This length "B" would be important if actions of single cylinders would count in the present technology. In the present invention, however, the single cylinders may be neglected and the overall appearances on the arrangements become considered. Therefor, in FIG. 45 the letter "E" shows the "high pressure equivalent length" of the radial projection of the periphery of the high pressure control port zone. It ends about in the middle between the peripherial ends of the control port and the medial lines of the closing arcs. This is so because of the pressure drop from high pressure port to low pressure port over the closing arcs. Similarly the length "G" in FIG. 45 defines the "high pressure equivalent length" of the radial projection of the periphery of the sealing lands peripherially of the fluid pressure pocket 21 in the respective thrust body. The length "K" is the peripherial outer end (projection) and the length "F" is the inner end of the sealing lands of the thrust menber 20 around the fluid pressure pocket 21. Due to pressure drop in the respective clearances the high pressure equivalent area has the length "G". Thereby it is assumed that "G" is about the half of the sum of "F"+"K", meaning linear pressure drop. If the actually not exactly linear pressure drop shall be considered, the lengths "E", "G" and the later to be discussed half lengthes "h" of the inner sealing lands have to be adjusted accordingly. Unlinearity of pressure drop appears due to heating in fluid at flow through clearances and due to inexact configurations of surfaces by machining of the surfaces.

Under similar considerations, the axial length of the control ports in FIG. 44 is "D", the axial lengths of the inner sealing lands are each "X", the half lengths of them are "h" and the axial distance between the axial inner ends of the inner unloading recesses is "M". Similarly, the axial lengths of the fluid pressure pockets in the thrust bodies are "S", the axial outer lengths of the thrust bodies are "N" and the sum of both sealing lands of them would then be "N" minus "S", while the "high pressure equivalent axial lengths" of the thrust body arrangements would be "Q", again half of "N+S" if the pressure drop is linear, and adjusted, if nonlinear pressure drop would be considered.

It is now obvious from FIGS. 44 and 45, that the rotor would, or might, run concentrically relative to the control body if the sum of the opposing fluid pressure forces in the high pressure zone (top half of the Figures) and in the low pressure zone (bottom half in the Figures) would be equal in strength, but oppositionally directed. They are in fact oppositionally directed in the Figures and in actuality. (Influence of singular cylinders at revolution neglected.)

It is now easy co-calculate the force in the high pressure area as being:

$$Fh=P\times E\times W \tag{17}$$

with "Fh"=force in the high pressure zone, P=pressure and "E" and "W" the respective measures of the Figures, whereby "W" is the high pressure equivalent axial length between "M" and "D", commonly the half of their sum (linear pressure drop).

The opposing forces are than provided by the thrust arrangement of the invention. In the case of these Figures by the mentioned two sealing arrangements of the invention. That means that each individual sealing arrangement 323-20 and 324-20 has to provide the half of the just now before calculated force "Fh".

The force "Fc"=counteracting force of the respective sealing arrangement is now accordingly:

$$Fc=P\times G\times Q \tag{18}$$

with the same values as in equation (17) with the measures "G" and "Q" taken from the Figures and with "x" meaning multiplied. Thus for equal forces on top and bottom, theoretically concentric running of the rotor relative to the control body, one obtains that the following condition has to be obeyed by the actual design:

$$Fh=2Fc \tag{19}$$

From this equation every "unknown" value can be calculated by transforming the equation accordingly. Since commonly the design of the control port is given and not considered variable and since the lengths "F,G,K" commonly are also given by the design, the unknown measure commonly is "Q" namely the axial lengths of the thrust body arrangement. It is obtained by the following transformation of equation (19) with (17) and (18) inserted in (19), "P" eliminating;

$$Q=EW-2G \tag{20}$$

The invention, however, started off therewith, that:

(a) the concentric running is unstable, and (b) the concentric running has a high leakage.

These were the two basic discoveries of the invention and these discoveries lead to the solution of the invention, to run the rotor eccentrically relative to the control body. Consequently, in order to obtain such eccentric running, the herebefore equalness of the sizes of the forces on top and bottom of the Figurs must become intentionally disturbed in favor of a stronger force in the sealing arrangement of the invention. To define this matter, the radial balancing factor "fb" is now introduced and it would be "fb=1.00" if the above equalness of forces for concentric running would exist. First, the mathematical expression is to be defined and it becomes:

$$Fc=fbFh\ i \text{ or: } fbPEW=2PGQ \tag{21}$$

and thereafter the value of the factor "fb" is to be considered. In practice mostly 1.04 is used and it should be between 1.02 and 1.12 depending on rotary angular speed of the rotor, desire of full or part eccentric running and like considerations or appearances. If the outer bearing lands "OBL" are provided, hydrodynamic pressure fields will develop over them and provide a force to let the rotor run more concentrically. Accordingly, the "fb" factor would then have to be higher and may exceed Fb=1.12 or oven "fb=higher than 1.20". Since the hydrodynamic forces are calculable from the respective handbooks of the hydrodynamic bearing theories, it is now possible to let the rotor run with every desired rate of eccentricity between eccentricity zero and maximum by the dimensioning of factor "fb".

Now, if other influences are not known, the designer may use the factor "fb=1.04" and adjust it after actual testing of the devices. If, however, the outer bearing lands "OBL" are applied, it is possible with reasonable security to design the size of the factor "fb" in advance and to obtain the desired rate of eccentricity at actual running of the rotor relative to the control body. For the event that concentric floating is desired, the matter is delicate because the "fb" factor would then have to be exactly: "fb=1.00", but this exactly would then mean, that all disturbing influences would have to be considered, like, for example, heating up of fluid in the clearances with thereby changing viscosities, hydrodynamic influences due to relative speeds between neighboring faces, unevennesses or inaccurateness of surfaces and the presently still partially unknown reasons for the unstability of the concentric running, which the invention discovered.

With this information the delicate matter can be overcome by using the disclosures of the present invention. A very reliable stability of the machine and a very considerable reduction of leakage (often and of friction) can be obtained by the adding of the outer bearing lands "OBL". How drastic and effective the reduction of leakage will be, is shown in FIGS. 27 and 28. Because now only the leakage in the left part of FIG. 28 remains, namely the leakage by comparison factor 0.28, while the leakage of the past devices with temporary leakage comparison factor 5.10 of the right part of FIG. 28 is prevented. It should be noted, that if the configuration of FIGS. 16, 17 would be applied, the leakage factor for the high pressure area would reduce to less than 0.01 in accordance with FIGS. 27 and 28.

Important is also that the outer face 40 with sealing lands 40 of the thrust body of the invention has the radius equal to the radius of the half of the diameter of the inner face 45 of the rotor, but not equal to the half of the diameter of the outer face 43 of the control pintle. Consequently, the configuration of the thrust body of the invention corresponds in principle to solutions if FIGS. 16 and 17, whereby the leakage comparison factor for outflow out of pockets 21 of the sealing arrangement of the invention reduces also to less than 0.01 in accordance with the discoveries and solutions of FIGS. 27 and 28.

In the details in separated illustration showing FIGS. 46 to 50, the following portions or parts are shown: The thrust body 20 has a cylindrical portion 32 with outer face 314 for centered insertion and keeping in cylindrical bore 31 of the control body. The thrust body further has a, seen from above or from bottom, rectangular portion with axial end faces 315,316 to be therewith sealingly fitted inserted between the wall faces 312,322 of the slot 323 or 324 of the control body. The fluid pressure pocket 21 is located in the rectangular portion and is supplied with high pressure fluid from the high pressure control port 13 through passages 48 and 29. Passage 310 leads fluid from pocket 21 into the thrust chamber space 33. Passage 301 supplies the fluid into the slots 30 of the outer bearing lands. Thrust chamber 33 is sealed by the holding portions 307 of the thrust body and by the seal members 34 thereon. Back up members 306, which are tapered on one end, may be provided to support the plastic seal members 34 and to make a radial movement of the thrust body relative to the control body possible without loosing the effect of proper and effective sealing of the thrust chambers 33 and the interior of bore 31. The pressure pockets 21 are sealed by the sealing lands 40 in peripherial and axial direction because these faces 40 form sealing lands under the influence of being pressed by the force which is defined by the balancing factor "fb" against the inner face 45 of the rotor for sealing engagement thereon. A support spring 304 may be inserted into the bore 31 and into the spring pocket 305 of the respective thrust body 20 for the time of starting of the device. As soon as the respective rotor runs and pressure is built up in the high pressure control port 13, this spring is not required any more because the fluid pressure takes over its function.

Important is further, that the thrust chamber which is combined by the passages 48,29 and 310 to the chamber 31 (the bore) and 33 (the outcut in the rectangular portion of the thrust member 20) must have a cross sectional area corresponding to that of the high pressure equivalent area of the outer face 40 of the thrust body. Because otherwise the thrust body would not be pressed radially outwards in the chamber(s) in or on the control body. That means, that the cross sectional area of the product 2 times "R" multiplied by "T" of FIG. 48 should be substantially equal to the product on the right side of equation (21) divided by the pressure "P". Thus, one obtains the final equation:

$$FbFh = fbPEW = 2PGQ = 2PRT \quad (22);$$

wherein, since the high pressure which is used is substantially equal at all discussed locations, the pressure "P" can be eliminated in order to obtain the final equation for the exclusively geometrical measures of the design, and which is:

$$fbEW = 2GQ \geqq 2RT \quad (23)$$

or:

$$fbE\left(\frac{M+D}{2}\right) = 2\left(\frac{F+K}{2}\right)\left(\frac{N+S}{2}\right) \geqq 2RT. \quad (24)$$

For very low pressures and when lubrication is secured, the fluid pressure pocket 21 is occasionally left away and only the pressure chamber with cross section "R×T" is applied. Note from FIGS. 44 and 48, that "T" is wider than "Q", while "R" is shorter than "G" in many practical applications. Note also that instead of providing the sealing arrangement only in one half of the control body it can also be provided in both halves of it and it can also be used to act as a control port with its members, as will be shown, by way of example, in the following FIGS. 51 to 54.

Figure 51:
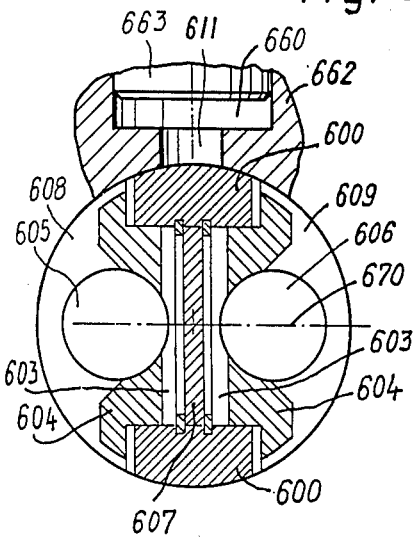
FIG. 51 is a cross sectional view through FIG. 52 along the arrowed line XVII of FIG. 52.
Figure 52:
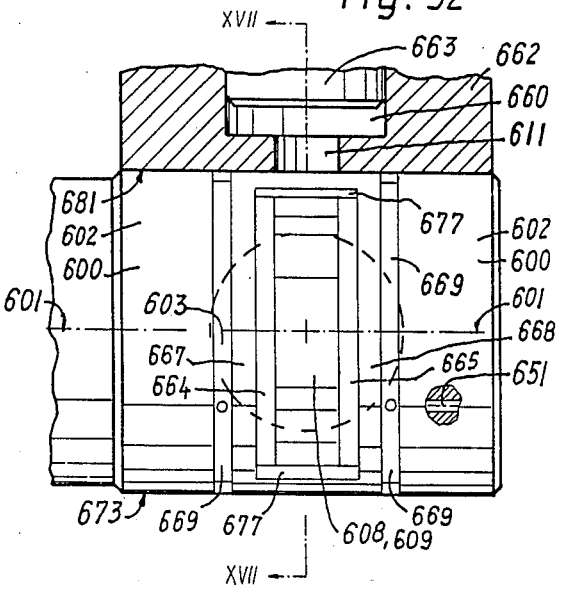
FIG. 52 is a view onto a control pintle in a rotor.

In the embodiment of FIGS. 51 and 52, the rotor has radially directed cylinders or working chambers 660 with for example pistons 663 therein. The specifity of the rotor 662 is, that each cylinder 660 has a rotor passage 611, which extends from the bottom of the cylinder radially inwards to and through the inner face of the rotor 662. The mentioned passage 611 is of a rather small diameter or cross-sectional area relative to the diameter of the cylinder 660 or relative to the cross-sectional area of the working chamber 660. In other words, the cross-sectional area of the rotor passages is only a fraction of the cross-sectional area of the associated cylinders or working chambers.

Thereby a force is formed on the bottom of the working chambers, which forces the rotor in the size of the cylinder bottom down towards the control body 601. On the other hand, the control port 609 or 808 of the control body together with the surrounding sealing land 667,668 is so dimensioned, that the force in opposite direction out of the control ports and their sealing lands are in counter directed balance with the forces onto the cylinder bottoms. The rotor 662 and control body 601 are thereby radially substantially in a balance of counter directed forces of fluid. That permits a rather centric and rather friction-less operation of the control body 601 in rotor 662.

The embodiment of FIGS. 51 and 52 is now arranged to such kind of rotor and control body, where the mentioned substantial radial balance of forces of fluid in the described locations is existing.

Figure 53:
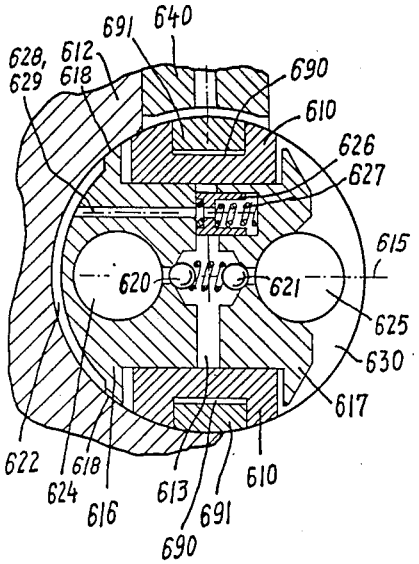
FIG. 53 is a cross sectional view through FIG. 54 along the arrowed line IXX of FIG. 54.
Figure 54:
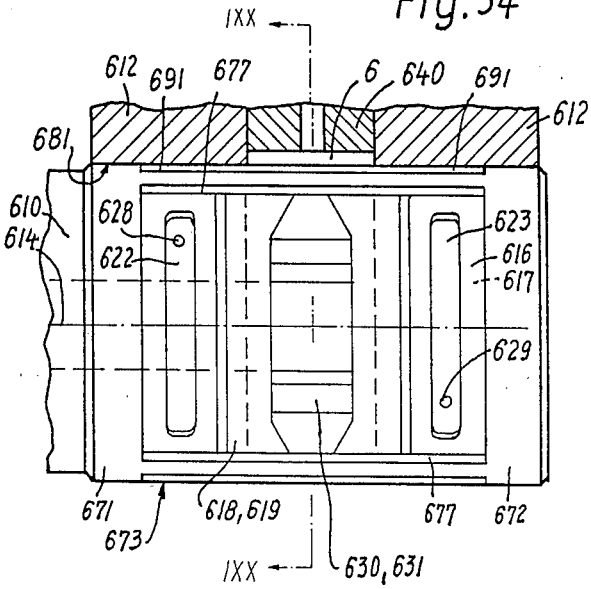
FIG. 54 is a view onto still a further control pintle in a rotor.

On contrary thereto, the embodiment of FIGS. 53 and 54 is applied in such kind of rotor and control body, where the described substantial radial balance of forces in the mentioned area of location is not existing.

The invention of the embodiment of FIGS. 51 and 52, which overcomes the high leakage at high pressure or rpm and reduces the said leakage considerably, consists in the provision of at least one hollow space 603 with a therein moveable thrust body 604 which includes a control part 608 or 609 and a sealing land 664 or 665 therearound and which is pressed by pressure in fluid on its bottom in the mentioned space into sealing engagement with the respective portion of the mentioned inner face of the rotor 662. For simplicity of manufacturing the hollow space may be a simple cylindrical bore with an axis 670 normal to the longitudinal axis 601 of control body 600. The mentioned hollow space is provided in the control body 600. It may also be a bore extending completely through control body 600 along and around the normal axis 670. Thereby it may form two hollow spaces 603 and it may then contain two oppositionally directed thrust members 604. A separation—and sealing—wall 607 may be provided in such space to separate one space 603 from the other, or there may be two separated spaces or bores 603 separated from each other by an integral portion 607 of control body 600.

It is in this embodiment required, that the sizes of control port 608 or 609 with the sorrounding sealing lands 664,665 are located within outer face sealing land portions 667, 668 and that the size of the control part and the mentioned sealing lands are properly dimensioned to upheld the before described substantial radial balance of fluid forces in the location and area here discussed. That results in axially rather narrow control parts and sealing lands, as shown in FIG. 51. It may be noted, that the ends of the thrust member(s) 604 are closely fitting between walls of respective outcuts in control body 600 to seal there along, or, that seals are inserted on the axial ends of the thrust bodies 604 to accomplish the mentioned seal. In the drawing those seals, which may be plastic seals, like rubber, teflon or the like, are not shown in order not to complicate the system which is explained in the Figure.

Endwards of the sealing land portions 667,668 of the outer face of the control body, which embrace the sealing lands of the respective thrust body 604, there should be unloading recesses 669. They are serving to prevent extensions of pressure zones and thereby to definitely restrict the mentioned location and area of substantial radial balance. Unloading recesses 669 may either be communicated together by passages 651 or how they may be communicated by passage(s) 651 with the interior of the housing of the device or with any desired or suitable space of no or of only low pressure. The unloading recesses 669 may also be incorporated into the fluid supply into the clearance between the mentioned faces over face portions 602 in order to build up there hydrodynamic pressure fields, which assist the centration of the rotor and the control body relatively to each other when the rotor revolves around the control body and the fluid flow facilitating device thereby operates.

In the later years of the last decade a leading European corporation has attempted to use two separated control body portions and to press them by pressure between them into sealing engagement on the inner face of the rotor. The corporation even obtained a patent thereon. The fact however is, that even when the patent makes an impression of geniality and good effect, it actually can not work. Because, when two halves of control bodies are pressed against the inner wall of the rotor, a gap appears between the two control bodies. The mentioned corporation proposed to insert seal packages into this gap to build pressure chambers to press the control bodies away from each other and against the mentioned inner face of the rotor. The space beyond the seals however, remained open. The result of the errenous solution of the famous corporation is, that, when the respective passage 611 of the chamber 660 revolves over the mentioned gap between the two control bodies, the pressure in the chambers or cylinders suddenly disappears, because the cylinders are suddenly open to the space under no pressure in the housing of the device. This occurrence appears at least two times at a single revolution of the rotor. The result thereof is a terrible noise and vibration and in addition, that a very large percentage of the piston stroke or of the working chamber action is open to the gap and thereby lost from the action of pumping or from the driving of the motor. When the cylinders or chambers 660 finally close the pistons or displacement member are already under a very stiff contraction- or expansion-action with a already high radial velocity. The then sudden closing results in absolutely unacceptable high vibrations and noises, and very sudden, very big load impulses, which in addition to noise quickly disturb the device.

The embodiment of the invention overcomes the problem not absolutely perfectly but with a very high degree of efficiency.

Also in the invention of FIGS. 51 to 54 such a gap remains and is demonstrated by referential numbers 677. The mentioned gap 677 of the invention is however not open to the interior of the housing or to another low-pressure space, but a portion of the control port 608,609 in FIGS. 51, 53 or of control ports 630,631 in FIGS. 53 and 54. The gap 677 is sealed against major losses of leakage by the fit of the outer face of the respective control body 601 or 610 on the inner face of the rotor 662 or 612.

Since the inner and outer faces of rotor and control body do, according to the above disclosure, not weld, when the clearance between said faces is diametrically about a thousandth of the diameter of the faces or radially about 0.0005 of the said diameter of the faces (inner face of rotor and outer face of control body) the sealing between these faces is still as perfect as in applicants mentioned elder patents. Thus, only a very small leackage can escape from the gaps 677 through the clearance between the mentioned faces. In actual devices it is about a twentienth to a fortieth of the leakage of the devices of inventor's elder patents. Thereby it is not absolutely perfect, but certainly the reduction of leakage to a twentieth over the elder patents is a very effective and valuable solution.

For details it should be noted, that an escape in radial direction between the ends of sealing lands 664 and 665 and the neighboring walls of control body sealing lands 667 and 668 in FIGS. 51 and 52 and of the ends of thrust bodies 6616,617 of FIGS. 53 and 54 and the neighboring walls of control body sealing lands 671, 672 should be prevented either by a close fit of the respective thrust body between the walls of the respective recess wherebetween the respective portion of the respective thrust member is located, or by seals between the endwalls of the thrust members and the walls of the respective slot portions. The slots may also be called: "outcuts".

The here often mentioned inner face of the respective rotor is shown by the arrow 681 in FIGS. 53 and 54, the respective outer face of the control body by arrow 673 in FIG. 54.

The embodiment of FIGS. 53 and 54 is especially suited for such a device, where the working chambers 6 do not have narrowed passages 611 of FIG. 52 and where thereby the mentioned radial balance of forces is not existing. The arrangement of FIGS. 53 and 54 therefore employs an axially much wider thrust member 616,617, at least one of them, and the respective thrust member includes fluid pressure balancing recesses 622, 623 axially of the control port 630 or 630. In case of application of two such thrust members, the fluid pressure from the opposite side of the control passage 628,629 into the respective fluid pressure balancing recess 622 or 623, whereof one is located axially of the respective port 630, 631 and the other in the opposite axial direction thereof. The axial direction is seen here along the central axis 614.

The fluid pressure balancing ports or pockets 622,623 are serving together to balance the radial force of the opposite diametrically located respective control port 630 or 631 at least partially, but in actual application almost totally. The almost centrical floating of the control body in the rotor's central bore or rotor's hub is thereby assisted and in practical application in an effective extent also obtained. An absolute perfection of centric floating is however seldom obtained, but attained only with an accuracy in the efficiency range of above ninety percent.

FIG. 54 also shows, that one-way check valves 621,622 should be provided to prevent back-flow from a high pressure space into a low-pressure passage 624 or 625. Respective moveable sealing arrangements 626,627, which may include a loading spring, should be provided to pass the flow into passage 628 and prevent an escape from said passage into the space 613 between the thrust members 616 and 617.

Naturally the thrust members 604,616,617 must be in communication with the main passages 605,606,624 or 625 of the control body in order to pass the flow of said passages to or from the respective control port 63, 631,608 or 609 and thereby to or from the respective working chambers 660,6 of the fluid flow facilitating device.

FIGS. 53 and 54 also show, that it is suitable and preferred, when space is available, to insert seals into respective axially extending outcuts 690 to prevent flow of leakage over the respective closing arc or control arc of the control body between high- and low-pressure ports on opposite sides of the control body. These seals 691 may therefore be called "Control-arc-seals". They may be pressed by fluidpressure in pockets or recesses 690 into sealing engagement with the respective portion of the respective rotor's inner face 681.

More details of the invention and of its preferred embodiments are described and defined in the appended claims. The mentioned claims form thereby a portion of the description of the preferred embodiments of the invention.

What is claimed is:

1. An assembly of two bodies, comprising, in combination, a first body, forming a rotor, provided with a bore whereby said body forms a cylindrical inner face around the axis of said bore with said inner face bordering said bore and forming a cylindrical face of a radius around said axis while said second body forms a control pintle which is located in said bore of said first body;

wherein said second body is provided with a thrust chamber which extends perpendicular to said axis into a portion of said second body and has a passage means communicated to a source of fluid under high pressure, wherein said thrust chamber has a cylindrical configuration and on one of its axial ends a slot which extends perpendicular to the axis of said cylindrical configuration of said thrust chamber whereby it extends perpendicular to said axis of said bore in said first body, and, wherein a thrust member is provided in said thrust chamber and in said slot with an inner portion of said thrust body closely fitting in and inserted into said cylindrical configuration of said thrust chamber while the outer portion of said thrust member is inserted into said slot and forms on its outer end a seal face portion of a radius equal to said radius around said axis of said bore and said seal face of said thrust member is pressed against a portion of said inner face when fluid under high pressure is led by said source of fluid under high pressure into said thrust chamber, whereby said control pintle is continuously pressed into an eccentric location relative to said rotor.

2. The control pintle of claim 1, wherein said thrust chamber has a cylindrical configuration and on one of its axial ends a slot which extends perpendicular to the axis of said cylindrical configuration of said thrust chamber and perpendicular to the axis of said control pintle in the hub of said rotor which forms said first body, wherein said thrust member is provided in said thrust chamber and in said slot with an inner portion of said thrust body closely fitting in and inserted into said cylindrical configuration of said thrust chamber while the outer portion of said thrust member is inserted into said slot and forms on its outer end a seal face portion of a radius equal to the radius around the axis of said inner face and said seal face of said thrust member is pressed against a portion of said inner face when fluid under pressure is led from said high pressure port into said thrust chamber.

3. The control pintle of claim 2, wherein said rotor is revolvably borne in a housing and a shaft is revolvingly borne in a portion of said housing substantially with an axis which substantially coincides with the axis of said rotor with said shaft revolving parallel to said rotor when said rotor revolves, and, wherein a flexible clutch means is provided to one of said bodies to permit a radial departure of said control pintle in said hub from the axis of said hub to permit said thrust member to press said control pintle in said hub with said high presure zone against the respective portion of said inner face to minimize the leakage flow out of said high pressure port in said high pressure zone by narrowing the clearance between said inner face and said body of cylindrical configuration in the neighborhood of said high pressure zone.

4. A cylindrical control pintle continuously eccentrically located in a hub of a rotor body with said rotor body having a cylindrical inner face which borders said rotor hub and said control pintle having a cylindrical outer face substantially of the diameter of said inner face with a clearance between said faces smaller than a hundredth of the diameter of said inner face, substantially radially directed channels extending from said inner face onto said rotary body, passages to lead fluid through said passages to control ports in said control pintle which port in said outer face at a location which meets said channels, wherein one of said ports is a high pressure port while the other of said ports is a low pressure port located diametrically opposed to said high pressure port respective to the axis of said pintle with closing arches provided on on the radial outer face of said control pintle and between said ports with said closing arches closing the respective passages of said passages when said passages move over said closing arches whereby said closing arches separate a high pressure zone of said control pintle in the neighborhood of said high pressure port from a low pressure zone of said control pintle in the neighborhood of said low pressure port, wherein a thrust chamber is provided in said low pressure zone extending from said outer face into said control pintle with said thrust chamber communicated at least indirectly to said high pressure port, wherein a thrust member is provided in said thrust chamber and subjected to said communication and the fluid therein, wherein said thrust member is provided with a seal face of a configuration which is complementary to a portion of said inner face to slide and seal thereon, and;

wherein said thrust chamber and said thrust member therein are substantially radially directed to oppose forces to fluid which appear on the diametrically opposite half of said control pintle.

5. The control pintle of claim 4, wherein said thrust chamber has an inner portion and an outer portion with said inner portion having a cylindrical cross section configuration while said outer portion has a rectangular cross-section with longitudinal sides which extend normal to the axis of said control pintle and parallel to the medial plane of said control pintle which divides said control pintle into the half which contains said thrust chamber and into the half which is said diametrically opposite half while said thrust chamber forms a slot with innermost end faces parallel to each other, normal to said axis and to said medial plane and a bottom parallel to said medial plane, and, wherein said thrust body has an inner portion which extends into said inner portion of said thrust chamber and that thrust body forms on outer portion of rectangular cross-sectional area with end faces which engage said innermost end faces of said slot to seal thereon while said outer portion of said thrust body forms a bottom face substantially parallel to said bottom of said slot, while seal means are provided between said bottom and said bottom face to seal the space between said bottom and said bottom face in the direction normal to said inner end face, to said end faces of said slot and to said outer portion of said thrust member.

6. A cylindrical control pintle located in a hub of a rotary body, with said rotary body having a cylindrical inner face which borders said rotor hub and said control pintle having a cylindrical outer face substantially of the diameter of said inner face with a clearance between said faces smaller than a hundredth of the diameter of said inner face, radially directed rotor channels extending from said inner face into said rotary body, passages to lead fluid through said passages to control ports in said control pintle which port in said outer face at a location which meets said rotor channels, wherein one of said ports is a high pressure port while the other of said ports is a low pressure port located diametrically opposed to said high pressure port respective to the axis of said pintle with closing arches provided on on the radial outer face of said control pintle and between said ports with said closing arches closing the respective passages of said passages when said passages move over said closing arches whereby said closing arches separate a high pressure zone of said control pintle in the neighborhood of said high pressure port from a low pressure zone of said control body in the neighborhood of said low pressure port, wherein a thrust chamber is provided in said low pressure zone extending from said outer face into said control pintle with said thrust chamber communicated at least indirectly to said high pressure port, wherein a thrust body is provided in said thrust chamber and subjected to said communication and the fluid therein, wherein said thrust body is provided with a seal face of a configuration which is complementary to a portion of said inner face to slide and seal thereon, wherein said thrust chamber and said thrust member therein are substantially radially directed to oppose forces of fluid which appear on the diametrically opposite half of said control pintle and, wherein the cross sectional areas of said thrust chamber and of said thrust member therein multiplied by the high pressure fluid in said control ports exceeds slightly said forces on fluid on said diametrically opposite half to thereby continuously press said control pintle into an eccentric location in said hub of said rotary body towards closer facing of the respective portion of said inner face by a respective portion of said outer face of said control pintle which is located diametrically opposite respective to said control pintle and said thrust chamber with said thrust body therein.

7. An assembly of two bodies with substantially parallel axial axes, wherein one of said bodies is a rotary body, forming a rotor, and the other of said bodies is a nonrotatable body, forming a control pintle, the first of said bodies has a concentric bore around one of said axial axes with an inner face interrupted by a passage extending from said inner face substantially normal to said one of said axial axes into said one of said bodies;

wherein the second body of said bodies has an outer face of substantially cylindrical configuration of a diameter fitting into said inner face;

wherein the second body of said bodies has channels for the supply of fluid into a high pressure control port which interrupts said outer face;

wherein sealing lands are formed axially of said control port by portions of said faces and are axially extending to unloading recesses which are cut into one of said faces parallel to the walls of said port, while said recesses are freed from pressure;

wherein said passage in said first body periodically communicates with said port when one of said bodies revolves relative to the other of said bodies, wherein one of said ports is a high pressure port while the other of said ports is a low pressure port located diametrically opposed to said high pressure port respective to the axis of said body with closing arches provided on on the radial outer face of said control body and between said ports with said closing arches closing the respective passages of said passages when said passages move over said closing arches whereby said closing arches separate a high pressure zone of said control body in the neighborhood of said high pressure port from a low pressure zone of said control body in the neighborhood of said low pressure port, wherein said second body has on its other half which is diametrically oppositionally located respective to the first half which contains said port at least one substantially radially directed and radially outwardly open chamber which is communicated to said high pressure port;

wherein at least one substantially radially moveable thrust member is provided in said chamber and subjected on a radial inner portion to the high pressure in said chamber, while said thrust member forms on its radial outer end a sealing face of part cylindrical configuration formed complementary to a portion of said inner face with said sealing face being pressed by said high pressure in said chamber against said inner face to seal therealong, whereby said control pintle is continuously pressed into an eccentric location, and, wherein said chamber is a thrust chamber of cross-sectionally cylindrical configuration around a substantially radial axis with said thurst member sealed and fitted in said thrust chamber for moveability therein along said radial axis and the center line of said sealing face of said complementary part-cylindrical configuration is parallel to the other axis of said axial axes of said two bodies.

8. In a device for intake and expulsion of fluid, a housing containing a rotor with at least one chamber group of a plurality of individual chambers with means to take in and expel fluid by said chambers and including an axially extending central rotor bore having a substantial cylindrical inner face, a substantially non-rotary control body extending into said bore and having an outer face of substantial fit on said inner face with a narrow clearance remaining between said faces to permit rotation of said rotor relative to said control body, said control body also containing channels ending in control ports and said rotor containing substantial radial passages extending from said chambers to said inner face for alternating communication with a least two of said control ports when said rotor revolves;

wherein one of said ports is a high pressure port while the other of said ports is a low pressure port located diametrically opposed to said high pressure port respective to the axis of said body with closing arches provided on on the radial outer face of said control body and between said ports with said closing arches closing the respective passages of said passages when said passages move over said closing arches whereby said closing arches separate a high pressure zone of said control body in the neighborhood of said high pressure port from a low pressure zone of said control body in the neighborhood of said low pressure port, wherein said control body is provided with at least one thrust chamber extending substantially normal to the longitudinal axis of said control body;

wherein a communication is provided from said high pressure port to said thrust chamber to pass high pressure fluid therein from said high pressure port to said thrust chamber, and;

wherein a thrust member is provided in said thrust chamber, radially moveable therein, subjected to said high pressure, having an outer slide face of a complementary configuration relative to a portion of said inner face while being pressed by said high pressure continuously against a portion of said inner face in an eccentric manner, and;

wherein two of said thrust chambers, two of said thrust members and two of said communications are provided in said control body and wherein said thrust chambers, members and communications are located axially distanced from a respective port, each one of the two in opposite axial direction relative to the axis of said control body.

9. An assembly of two bodies, comprising, in combination, a first body, forming a rotor, provided with a bore whereby said body forms a cylindrical inner face around the axis of said bore with said inner face bordering said bore and forming a cylindrical face of a radius around said axis while said second body forms a control pintle which is located in said bore of said first body;

wherein said second body is provided with a thrust chamber which extends perpendicular to said axis into a portion of said second body and has a passage means communicated to a source of fluid under high pressure, wherein said thrust chamber has a cylindrical configuration and on one of its axial ends a slot which extends perpendicular to the axis of said cylindrical configuration of said thrust chamber whereby it extends perpendicular to said axis of said bore in said first body, and, wherein a thrust member is provided in said thrust chamber and in said slot with an inner portion of said thrust body closely fitting in and inserted into said cylindrical configuration of said thrust chamber while the outer portion of said thrust member is inserted into said slot and forms on its outer end a seal face portion of a radius equal to said radius around said axis of said bore and said seal face of said thrust member is pressed against a portion of said inner face when fluid under high pressure is led by said source of fluid under high pressure into said thrust chamber, wherein said thrust chamber has a cylindrical configuration and on one of its axial ends a slot which extends perpendicular to the axis of said cylindrical configuration of said thrust chamber and perpendicular to the axis of said control pintle in the hub of said rotor which forms said first body, wherein said thrust member is provided in said thrust chamber and in said slot with an inner portion of said thrust body closely fitting in and inserted into said cylindrical configuration of said thrust chamber while the outer portion of said thrust member is inserted into said slot and forms on its outer end a seal face portion of a radius equal to the radius around the axis of said inner face and said seal face of said thrust member is pressed against a portion of said inner face when fluid under pressure is led from said high pressure port into said thrust chamber.

10. An assembly of two bodies, comprising, in combination, a first body, forming a rotor, provided with a bore whereby said body forms a cylindrical inner face around the axis of said bore with said inner face bordering said bore and forming a cylindrical face of a radius around said axis while said second body forms a control pintle which is located in said bore of said first body;

wherein said second body is provided with a thrust chamber which extends perpendicular to said axis into a portion of said second body and has a passage means communicated to a source of fluid under high pressure, wherein said thrust chamber has a cylindrical configuration and on one of its axial ends a slot which extends perpendicular to the axis of said cylindrical configuration of said thrust chamber whereby it extends perpendicular to said axis of said bore in said first body, and, wherein a thrust member is provided in said thrust chamber and in said slot with an inner portion of said thrust body closely fitting in and inserted into said cylindrical configuration of said thrust chamber while the outer portion of said thrust member is inserted into said slot and forms on its outer end a seal face portion of a radius equal to said radius around said axis of said bore and said seal face of said thrust member is pressed against a portion of said inner face when fluid under high pressure is led by said source of fluid under high pressure into said thrust chamber, whereby said control pintle is continuously pressed into an eccentric location relative to said rotor, wherein said thrust chamber has a cylindrical configuration and on one of its axial ends a slot which extends perpendicular to the axis of said cylindrical configuration of said thrust chamber and perpendicular to the axis of said control pintle in the hub of said rotor which forms said first body, wherein said thrust member is provided in said thrust chamber and in said slot with an inner portion of said thrust body closely fitting in and inserted into said cylindrical configuration of said thrust chamber while the outer portion of said thrust member is inserted into said slot and forms on its outer end a seal face portion of a radius equal to the radius around the axis of said inner face and said seal face of said thrust member is pressed against a portion of said inner face when fluid under pressure is led from said high pressure port into said thrust chamber.

11. An assembly of two bodies, comprising, in combination, a first body, forming a rotor, provided with a bore whereby said body forms a cylindrical inner face around the axis of said bore with said inner face bordering said bore and forming a cylindrical face of a radius around said axis while said second body forms a control pintle which is located in said bore of said first body;

wherein said second body is provided with a thrust chamber which extends perpendicular to said axis into a portion of said second body and has a passage means communicated to a source of fluid under high pressure, wherein said thrust chamber has a cylindrical configuration and on one of its axial ends a slot which extends perpendicular to the axis of said cylindrical configuration of said thrust chamber whereby it extends perpendicular to said axis of said bore in said first body, and, wherein a thrust member is provided in said thrust chamber and in said slot with an inner portion of said thrust body closely fitting in and inserted into said cylindrical configuration of said thrust chamber while the outer portion of said thrust member is inserted into said slot and forms on its outer end a seal face portion of a radius equal to said radius around said axis of said bore and said seal face of said thrust member is pressed against a portion of said inner face when fluid under high pressure is led by said source of fluid under high pressure into said thrust chamber, whereby said control pintle is continuously pressed into an eccentric location relative to said rotor, wherein said rotor is revolvably borne in a housing and a shaft is revolvingly borne in a portion of said housing substantially with an axis which substantially coincides with the axis of said rotor with said shaft revolving parallel to said rotor when said rotor revolves, and, wherein a flexible clutch means is provided to one of said bodies to permit a radial departure of said control pintle in said hub from the axis of said hub to permit said thrust member to press said control pintle in said hub with said high presure zone against the respective portion of said inner face to minimize the leakage flow out of said high pressure port in said high pressure zone by narrowing the clearance between said inner face and said body of cylindrical configuration in the neighborhood of said high pressure zone.

12. An assembly of two bodies with substantially parallel axial axes in a radial flow machine, wherein one of said bodies is a rotor and the other of said bodies is a nonrotatable pintle the first of said bodies has a centric bore around one of said axial axes with an inner face interrupted by a passage extending from said inner face substantially normal to said one of said axial axes into said one of said bodies to facilitate substantially radial flows through said passage, wherein said pintle has an outer face of substantially cylindrical configuration of a diameter fitting into said inner face;

wherein said pintle has conduits for the supply of fluid into a high pressure control port which interrupts said outer face; wherein seating lands are formed axially of said control port by portions of said faces and are axially extending to unloading recesses which are cut into one of said faces parallel to the walls of said port, while said recesses are freed from pressure; werein said passage in said rotor periodically communicates with said port when one of said bodies revolves relative to the other of said bodies, wherein said pintle has on its other half which is diametrically oppositionally located respective to the first half which contains said port at least one substantially radially directed and radially outwardly open chamber which is communicated to said high pressure port;

wherein at least one substantially radially moveable thrust member is provided in said chamber and subjected on a radial inner portion to the high pressure in said chamber, while said thrust member forms on its radial outer end a sealing face of part cylindrical configuration formed complementary to a portion of said inner face with said sealing face being pressed by said high pressure in said chamber against said inner face to seal therealong, wherein said chamber is a thrust chamber of cross-sectionally cylindrical configuration around a substantially radial axis with said thrust member sealed and fitted in said thrust chamber for moveability therein along said radial axis and the center line of said sealing face of said complementary part-cylindrical configuration is parallel to the other axis of said axial axes of said two bodies;

wherein said radial outer end of thrust body is provided with a pocket through said sealing face with said pocket communicated to said thrust chamber; and;

wherein said substantial radial axis is directed through the center of the pressure area of said control port whereby the high pressure in said thrust chamber directs its thrust along said radial axis towards said sealing face while the opposing reaction force of the pressure in said thrust chamber directs its thrust along said radial axis onto said pintle to press said pintle continuously into an eccentric location relative to said rotor for sealing engagement of said high pressure port on the respective portion of said inner face of said rotor.

13. An assembly of two bodies with substantially parallel axes in a radial flow device wherein one of said bodies is a rotary body which forms a fluid handling rotor and the other of said bodies is a nonrotatable pintle, the first of said bodies has a centric bore around one of said axial axes with an inner face interrupted by a passage extending from said inner face substantially normal to said one of said axial axes into said one of said bodies;

wherein the second body of said bodies has an outer face of substantially cylindrical configuration of a diameter fitting into said inner face;

wherein the second body of said bodies has channels for the supply of fluid into a high pressure control port which interrupts said outer face; wherein sealing lands are formed axially of said control port by portions of said faces and are axially extending to unloading recesses which are cut into one of said faces parallel to the walls of said port, while said recesses are freed from pressure; werein said passage in said first body periodically communicates with said port when one of said bodies revolves relative to the other of said bodies, wherein said second body has on its other half which is diametrically oppositionally located respective to the first half which contains said port at least one substantially radially directed and radially outwardly open chamber which is communicated to said high pressure port;

wherein at least one substantially radially moveable thrust member is provided in said chamber and subjected on a radial inner portion to the high pressure in said chamber, while said thrust member forms on its radial outer end a sealing face of part cylindrical configuration formed complementary to a portion of said inner face with said sealing face being pressed by said high pressure in said chamber against said inner face to seal therealong, wherein said chamber is a thrust chamber of cross-sectionally rectangular configuration along a substantially radial axis with said thrust member sealed and fitted in said thrust chamber for moveability therein along said radial axis and the center line of said sealing face of said complementary part-cylindrical configuration is parallel to the other axis of said axial axes of said two bodies, wherein said pintle is continuously pressed into an eccentric location relative to said rotor, and, wherein said radial outer end of said thrust body is provided with a pocket through said sealing face with said pocket communicated to said thrust chamber.

14. A control pintle located in a hub of a rotor in a radial flow device with said rotor including a plurality of working chambers whose volumes periodically increase and decrease, with said rotor having a cylindrical inner face which borders said rotor hub and said control pintle having a cylindrical outer face substantially of the diameter of said inner face with a clearance between said faces smaller than a hundredth of the diameter of said inner face, substantially radially directed rotor ports for radial flow of fluid to and from said chambers with said rotor ports extending from said inner face into said rotor to said chambers, passages in said control pintle to lead fluid through said passages to control ports in said control pintle which port in said outer face at a location which meets said rotor ports, wherein a thrust chamber is provided in said control pintle with said thrust chamber having a communication at least indirectly to one of said control ports;

wherein a thrust body is provided in said thrust chamber and subjected to said communication and the fluid therein, wherein said thrust body is provided with a seal face of a configuration which is complementary to a portion of said inner face to slide and seal thereon, wherein said thrust chamber and said thrust member therein are substantially radially directed to oppose forces of fluid which appear on the diametrically opposite half of said control pintle, whereby said thrust body is pressed by high pressure fluid in said thrust chamber against a portion of said inner face of said rotor, and, wherein the cross sectional areas of said thrust chamber and of said thrust member therein multiplied by the high pressure fluid in said control ports exceeds slightly said forces of fluid on said diametrically opposite half to thereby continuously press said control pintle into an eccentric location in said hub of said rotary body towards closer facing of the respective portion of said inner face by a respective portion of said outer face of said control pintle which is located diametrically opposite respective to said control pintle and said thrust chamber with said thrust body therein.

15. The control pintle of claim 14, wherein said thrust chamber has a radially inner portion and a radially outer portion with the cross sectional area of said inner portion smaller than the cross sectional area of said outer portion and said inner portion has the configuration of a hollow cylindrical bore, and, wherein said thrust body in said thrust chamber has an inner and an outer portion with said inner portion fitting in said radially inner portion of said thrust chamber.

16. The control pintle of claim 14, wherein said thrust chamber extends into one of said passages, wherein a passage extends substantially radially through said thrust body to extend into a port in the radial outer portion of said thrust body, wherein said port is surrounded by a sealing land which is formed by said seal face of the thrust body; and;

wherein said port in said thrust body is radially aligned with said rotor ports, whereby said port in said thrust body obtains the ability to serve as a control port of said control pintle to lead and control one direction of flow of fluid through said control pintle into and out of said rotor ports of said rotor, while said sealing land is eccentrically located relative to said cylindrical outer face of said control pintle.

17. In a radial flow radial piston machine, in combination, a rotor revolvably borne in a housing and having a rotor face, a control pintle associated to said rotor and having a control face sliding and sealing along said rotor face and a sealing arrangement associate to said rotor and to said control pintle, wherein said housing has ports and fluid passages extending towards said control pintle, wherein said fluid passages extend through said control pintle and form control ports in said control face of said control pintle, wherein rotor passages extend from said rotor face through a portion of said rotor to working chambers provided in said rotor, wherein fluid can flow through one of said passages from one of said ports into at least one of said chambers and out of said chamber through another of said passages to another of said ports, wherein said sealing arrangement includes means for sealing along a portion of said faces, wherein said rotor has a substantially cylindrical and axially extending rotor-hub having an inner face, wherein said inner face is said rotor face, wherein said control pintle is a substantially cylindrical control pintle of a diameter only slightly smaller than the diameter of said rotor-hub, wherein said control pintle extends into said rotor-hub along said rotor face, wherein said control pintle has a substantially cylindrical outer face, wherein said outer face is said control face, wherein a small substantially cylindrical control-clearance is formed between said faces and wherein said sealing arrangement is associated to a portion of said cylindrical control clearance, wherein said control pintle has a pressure port portion formed around the respective acting control port of the higher pressure and a diametric portion, wherein said diametric portion is the opposite portion on the other side of the axis of said control pintle and thereby substantially diametrically and oppositely located on said control pintle relative to said high pressure port portion and to said axis of said control pintle wherein at least one fluid pressure thrust chamber is provided in said diametric portion, wherein said thrust chamber has a bottom portion and an outwardly open outer portion, wherein said thrust chamber extends substantially radially and substantially normal to the axis of said control pintle in said control pintle, wherein a communication means is provided to pass fluid from a respective control port of said high pressure port portion to said bottom portion of said thrust chamber and to maintain a fluid pressure in said bottom portion of said thrust chamber equal to the high pressure fluid in said respective control port, wherein a thrust member is respectively to said axis radially moveably provided in said thrust chamber and subjected to said pressure in the bottom portion of said thrust chamber, wherein said thrust member has an outer seal face of a radius substantially equal to the radius of the said inner face of said rotor, wherein said thrust member is pressed by said high fluid pressure in said bottom portion of said thrust chamber towards the adjacent portion of said inner face of said rotor whereby said outer seal face is pressed to a close engagement with the said respective portion of said inner face of said rotor, and whereby said high pressure port portion of said control pintle is permanently pressed towards the opposite portion of said inner face of said rotor to narrow at said high pressure port portion the clearance between the respective portion of said control face of said control pintle and the said inner face of said rotor for the purposes of reducing leakage of fluid along said high pressure port portion.

18. The machine of claim 17, wherein said rotor contains two cylinder groups which form said working chambers, wherein each of said cylinder groups consists of a plurality of individual working chambers, wherein said cylinder groups are distanced from each other relative to the axial direction of said rotor, wherein said control pintle has two pairs of control ports and wherein at least one unloading recess is provided between two of said control ports and communicated to a space under a pressure which is less than the pressure in said control ports between which said unloading recess is located.

19. The fluid machine of claim 18, wherein at least two unloading recesses are provided between said two of said ports and wherein at least each one additional unloading recess is provided on the outer side of each of said two control ports.

* * * * *